US010366873B2

(12) United States Patent
Polfer et al.

(10) Patent No.: US 10,366,873 B2
(45) Date of Patent: Jul. 30, 2019

(54) CRYOGENIC 2D LINEAR ION TRAP AND USES THEREOF

(71) Applicant: University of Florida Research Foundation, Inc., Gainesville, FL (US)

(72) Inventors: Nicolas Camille Polfer, Gainesville, FL (US); Todd A. Prox, Interlachen, FL (US); Larry F. Tesler, Gainesville, FL (US); Matthew Bell, Gainesville, FL (US); Adam P. Cismesia, Portland, OR (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

(21) Appl. No.: 15/970,348

(22) Filed: May 3, 2018

(65) Prior Publication Data

US 2018/0323051 A1 Nov. 8, 2018

Related U.S. Application Data

(60) Provisional application No. 62/663,095, filed on Apr. 26, 2018, provisional application No. 62/500,593, filed on May 3, 2017.

(51) Int. Cl.
*H01J 49/42* (2006.01)
*H01J 49/00* (2006.01)

(52) U.S. Cl.
CPC ..... *H01J 49/422* (2013.01); *H01J 49/0031* (2013.01)

(58) Field of Classification Search
CPC ..... H01J 49/422; H01J 49/0031
USPC ..... 250/281, 282, 283
See application file for complete search history.

(56) References Cited

U.S. PATENT DOCUMENTS 5,340,983 A * 8/1994 Deinzer ..... H01J 49/147 250/281
8,173,959 B1 * 5/2012 Boumsellek ..... G01N 27/622 250/281
2011/0168882 A1 * 7/2011 Hoyes ..... H01J 49/062 250/283
2013/0009051 A1 * 1/2013 Park ..... H01J 49/063 250/282
2013/0306858 A1 * 11/2013 Giles ..... G01N 27/622 250/283
2018/0002806 A1 * 1/2018 Verbeck, IV ..... C23C 14/14

OTHER PUBLICATIONS

Cismesia AP, Bailey LS, Bell MR, Tesler LF, Polfer NC. Making mass spectrometry see the light: the promises and challenges of cryogenic infrared ion spectroscopy as a bioanalytical technique. J Am Soc Mass Spectrom. 2016;27:757-766.

Kamrath MZ, Relph RA, Guasco TL, Leavitt CM, Johnson MA. Vibrational predissociation spectroscopy of the H2-tagged mono- and dicarboxylate anions of dodecanedioic acid. Int J Mass Spectrom. 2011;300:91-98.

(Continued)

*Primary Examiner* — Nicole M Ippolito
(74) *Attorney, Agent, or Firm* — Thomas|Horstemeyer, LLP

(57) ABSTRACT

Described herein are cryogenic linear ion traps and uses thereof.

20 Claims, 78 Drawing Sheets

(56) References Cited

OTHER PUBLICATIONS

Ouyang Z, Wu G, Song Y, Li H, Plass WR, Cooks RG. Rectilinear ion trap: concepts, calculations, and analytical performance of a new mass analyzer. Anal Chem, American Chemical Society. 2004;76:4595-4605.

Wang L, Xu F, Dai X, Fang X, Ding C-F. Development and investigation of a mesh-electrode linear ion trap (ME-LIT) mass analyzer. J Am Soc Mass Spectrom, Springer US. 2014;25:548-555.

Leavitt, C.M., Wolk, A.B., Fournier, J.A., Kamrath, M.Z., Garand, E., Van Stipdonk, M.J., Johnson, M.A.: Isomer-Specific IR-IR Double Resonance Spectroscopy of D2-Tagged Protonated Dipeptides Prepared in a Cryogenic Ion Trap. J. Phys. Chem. Lett. 3, 1099-1105 (2012).

Schwartz, J.C., Senko, M.W., Syka, J.E.P.: A two-dimensional quadrupole ion trap mass spectrometer. J. Am. Soc. Mass Spectrom. 13, 659-669 (2002).

* cited by examiner

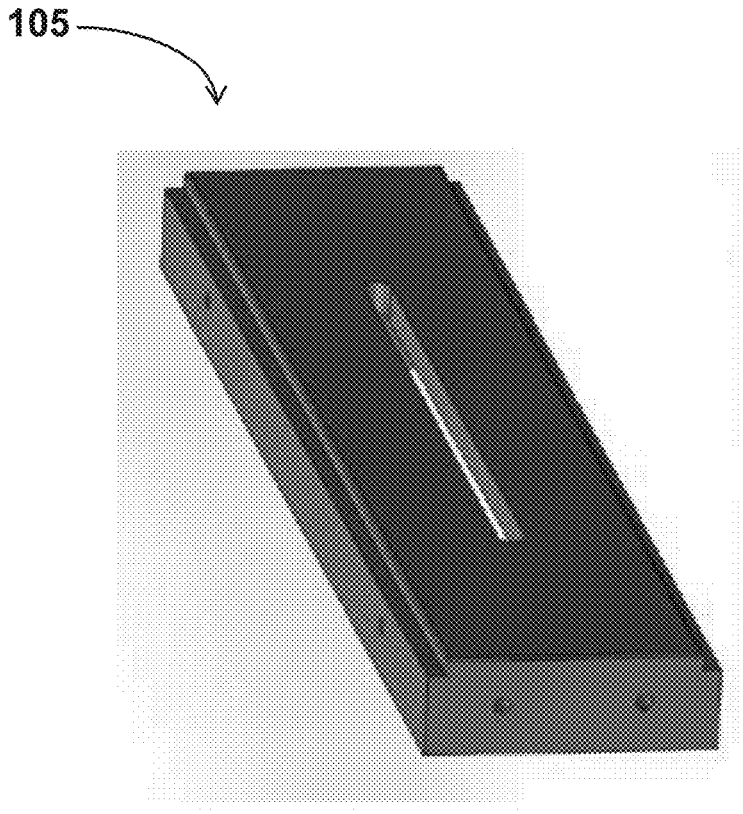
FIG. 23A
FIG. 23B
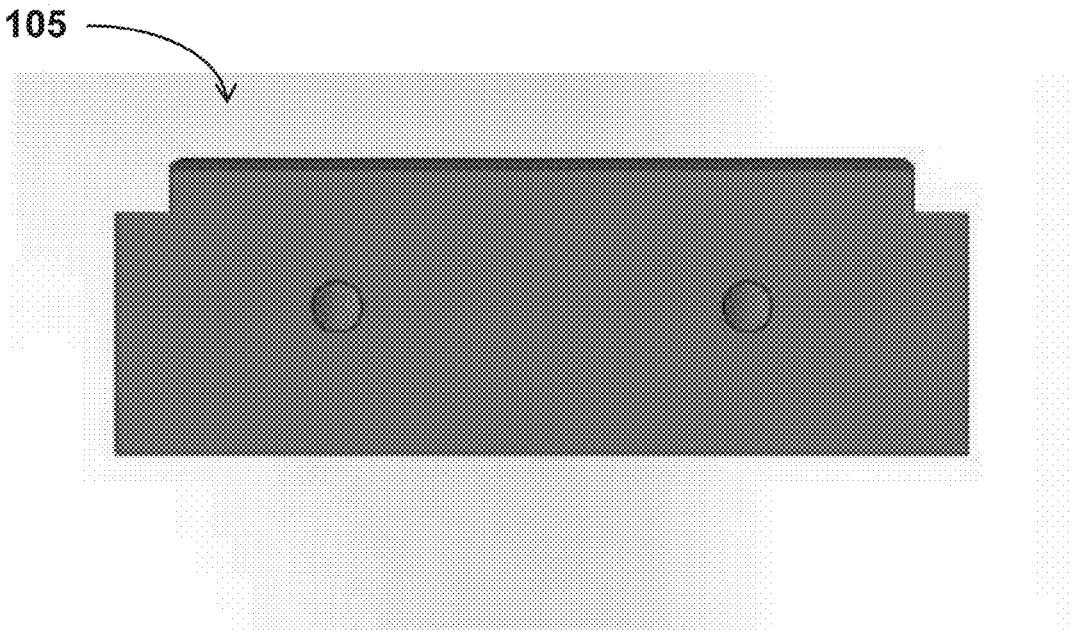

(A) Raw ESI Mass Spectrum
PABA
+41 amu : ACN
+18 amu : H2O
PABA•ACN (B) Mass Isolation
PABA•ACN (C) Resonant Photodissociation @ 3290cm-1
PABA
-41 amu : ACN
PABA•ACN
Intensity (V)
m/z

| Vibrational modes | Band positions/cm$^{-1}$ B3LYP/cc-PVTZ (scaling factor 0.960)[33] | Band positions/cm$^{-1}$ (FWHM) IRMPD experimental | Band positions/cm$^{-1}$ (FWHM) IRPD experimental |
|---|---|---|---|
| OH stretch | 3586 | 3565 (11) | 3580 (7.5) |
| $NH_3^+$ stretches | 3330, 3306, 3247 | 3250 (18) | 3345 (7.5)<br>3291 (8.5) |
| CH stretch | 3087 | - | 3088 (32.5) |
| ACN stretch | N/A | N/A | 2950 (3.5) |

FIG. 39

| Tagged ion mass | Assignment | Tagging efficiency |
|---|---|---|
| *m/z* 132 | *m/z* 91•ACN | 60.5% |
| *m/z* 144 | *m/z* 103•ACN | 74.7% |
| *m/z* 162 | *m/z* 121•ACN | 2.6% |
| *m/z* 173 | *m/z* 91•$ACN_2$ | 11.9% |
| *m/z* 179 | Tyramine•ACN | 12.6% |

FIG. 40

| Vibrational Modes | Band positions/ $cm^{-1}$ B3LYP/cc-PVTZ (scaling factor 0.960)[33] | Band positions/ $cm^{-1}$ (FWHM) IRMPD experimental | Band positions/ $cm^{-1}$ (FWHM) IRPD experimental (m/z 138) | Band positions/ $cm^{-1}$ (FWHM) IRPD experimental (m/z 121) |
|---|---|---|---|---|
| OH Stretch | 3673.8 | 3642 (15) | 3646 (7) | 3643 (7.5) |
| $NH_3$+ stretches | 3362.2 | 3347 (27.5) | 3351 (9) | |
| | 3357.65 | 3307 (35.5) | 3338 (12) | |
| | 3280.9 | | | |
| Aromatic CH Stretches | 3092.3 | 3122 (42) | 3187 (19) | |
| | 3064.3 | | | |
| | 3046.8 | | | |
| | 3046.2 | | | |
| Aliphatic CH Stretches | 3038.4 | | | |
| | 2982.5 | | 3046 (6.0) | 3046 (6.0) |
| | 2982.5 | | 3012 (8.5) | 3007 (4.5) |
| | 2984.5 | | | |
| | 2910.5 | | | |

FIG. 43

| Compound | IRMPD Band position/$cm^{-1}$ (FWHM) | IRMPD Vibrational mode | IRPD Band position/$cm^{-1}$ (FWHM) | IRPD Vibrational mode |
|---|---|---|---|---|
| Taurine | 3550 (25) | S–OH | 3574 (5) | S–OH |
| | 3334 (29) | $NH_3^+$ | 3350 (13.6) | $NH_3^+$ |
| | 3298 (37) | | | |
| 2-AEP | 3628 (30) | P–OH | 3648 (7) | P–OH |
| | 3352 (14) | $NH_3^+$ | 3357 (19) | $NH_3^+$ |
| | 3303 (19) | | 3314 (29) | |

FIG. 54

| 2P1EA IRMPD | | 2P1EA B3LYP/cc-pVTZ (scaling factor 0.960)[39] | | 2P1EA IRPD | |
|---|---|---|---|---|---|
| Band position /$cm^{-1}$ (FWHM) | Vibrational Mode | Band position /$cm^{-1}$ | Vibrational Mode | Band position /$cm^{-1}$ (FWHM) | Vibrational Mode |
| 3660 (15) | OH | 3675 | OH | 3659 (5) | OH |
| 3645 (12) | | | | | |
| 3351 (28) | $NH_3$+ | 3380 | $NH_3$+ | 3305 (30) | $NH_3$+ |
| 3310 (17) | | 3332 | | 3263 (8) | |
| 3242 (34) | | 3199 | | 3219 (10) | |
| – | – | 3093 | CH | | CH |
| | | 3084 | | | |
| | | 3075 | | 3096 (2) | |
| | | 3060 | | 3046 (19) | |
| | | 3055 | | 2989 (30) | |
| | | 2994 | | | |
| | | 2892 | | | |

FIG. 55

| Tyramine IRMPD | | Tyramine B3LYP/cc-pVTZ (scaling factor 0.960)[39] | | Tyramine IRPD | |
|---|---|---|---|---|---|
| Band position /$cm^{-1}$ (FWHM) | Vibrational Mode | Band position /$cm^{-1}$ | Vibrational Mode | Band position /$cm^{-1}$ (FWHM) | Vibrational Mode |
| 3642 (14) | OH | 3674 | OH | 3646 (7) | OH |
| 3346 (35) | $NH_3$+ | 3362 | $NH_3$+ | 3350 (9) | |
| 3305 (37) | | 3358 | | 3337 (9) | $NH_3$+ |
| 3128 (37) | | 3281 | | 3187 (13) | |
| - | - | 3092 | CH | | CH |
| | | 3064 | | 3045 (10) | |
| | | 3047 | | 3013 (19) | |
| | | 3046 | | 2975 (29) | |
| | | 3038 | | 2931 (28) | |
| | | 2983 | | | |
| | | 2949 | | | |
| | | 2910 | | | |

FIG. 55 (ctd.)

| Isomer | OH band position/$cm^{-1}$ (FWHM) | $NH_3^+$ band(s) position/$cm^{-1}$ (FWHM) |
|---|---|---|
| *p*-Aminobenzoic acid | 3577 (8) | 3339 (7), 3288 (8) |
| *m*-Aminobenzoic acid | 3577 (6) | 3334 (12), 3285 (16) |
| *o*-Aminobenzoic acid | 3563 (6) | 3322 (9) |
| Salicylamide | 3636 (6) | 3471 (10), 3437 (9), 3370 (12) |
| 3-Pyridylacietic acid | 3571 (10) | — |

FIG. 58

| *p*-Aminobenzoic acid | *m*-Aminobenzoic acid | *o*-Aminobenzoic acid | Salicylamide | 3-Pyridylacetic acid | |
|---|---|---|---|---|---|
| — | 8.4 | 17.3 | 23.4 | 36.6 | *p*-Aminobenzoic acid |
| 8.4 | — | 17.7 | 23.3 | 34.0 | *m*-Aminobenzoic acid |
| 17.3 | 17.7 | — | 21.0 | 39.0 | *o*-Aminobenzoic acid |
| 23.4 | 23.3 | 21.0 | — | 34.1 | Salicylamide |
| 36.6 | 34.0 | 39.0 | 34.1 | — | 3-Pyridylacetic acid |

FIG. 60

| Simulated Mass Instability | Multipole Expansion Fit | Eperimental Mass Instability | Ouyang & Cooks RIT [19] | Wang Mesh-LIT |
|---|---|---|---|---|
| 0.884 | 0.866 | 0.867 | 0.633 | 0.806 |

CRYOGENIC 2D LINEAR ION TRAP AND USES THEREOF

CROSS-REFERENCE TO RELATED APPLICATIONS

This application claims the benefit of and priority to co-pending U.S. Provisional Patent Application No. 62/500,593, filed on May 3, 2017, entitled "MASS SELECTIVE CRYOGENIC 2D LINEAR ION TRAP FOR HIGH RESOLUTION INFRARED SPECTROSCOPY OF MASS-SELECTED IONS," the contents of which is incorporated by reference herein in its entirety.

This application claims the benefit of and priority to co-pending U.S. Provisional Patent Application No. 62/663,095, filed on Apr. 26, 2018, entitled "MASS SELECTIVE CRYOGENIC 2D LINEAR ION TRAP FOR HIGH RESOLUTION INFRARED SPECTROSCOPY OF MASS-SELECTED IONS," the contents of which is incorporated by reference herein in its entirety.

STATEMENT REGARDING FEDERALLY SPONSORED RESEARCH

This invention was made with government support under grant number GM110077 awarded by the National Institutes of Health, grant number CHE1403262 awarded by the National Science Foundation. The government has certain rights in the invention.

BACKGROUND

Mass spectrometry is a useful technique for, inter alia, the analysis of analytes in samples. Mass spectrometry can be performed in sequence with other analyte analysis techniques. However, conventional mass spectrometers and components thereof, while optimized for mass spectrometry are not necessarily well suited for performance of additional analysis techniques. As such there exists a need for improved mass spectrometry devices and techniques for sequential mass spectrometric analysis with additional analysis techniques.

SUMMARY

Described herein are rectilinear ion traps that can include spaced x and y pairs of flat RF electrodes that can be disposed in the zx and zy plane to define a trap volume, wherein each of the x flat RF electrodes comprise a slit; a pair of DC plates, wherein the DC plates can be coupled to the x and y pairs of flat RF electrodes, wherein the DC plates can be disposed in the xy plane, and wherein each DC plate can include holes configured to receive a fastener; a base plate, wherein the base pate can be coupled to the DC plates, wherein the base plate can be positioned on top of the spaced x and y pairs of flat RF electrodes, and wherein the base plate can be disposed of in the zy plane, wherein the base plate can be parallel to the Y pair of flat RF electrodes, and wherein the base plate can include holes to receive a fastener, sapphire spacers, wherein the sapphire spacers can have two holes configured to receive a fastener, wherein the sapphire spacers can be placed between the base plate and the DC plate, wherein the sapphire spacers can be placed between the DC plates and the ends of the x and y flat RF electrodes; and fasteners, wherein the fasteners can be passed through the holes in the DC plates, base plates, x and y flat RF electrodes and sapphire spacers. The rectilinear ion trap can be configured to operate a cryogenic temperatures. The rectilinear ion trap can further include insulating spacers, wherein the insulating spacers are positioned between the ends of the x and y RF electrodes. The insulating spacers can be composed of Kel-F, PEEK, or Teflon insulating material. One or more components of the rectilinear ion trap can be composed of stainless steel. One or more components of the rectilinear ion trap can be composed of copper. The rectilinear trap can be configured to operate at cryogenic temperatures down to about 12K. The rectilinear ion trap can configured to perform mass selection of ions and infrared mass spectra analysis inside the rectilinear ion trap.

Also described herein are mass spectrometers that can include a rectilinear ion trap that can include one or more rectilinear ion traps that can include spaced x and y pairs of flat RF electrodes that can be disposed in the zx and zy plane to define a trap volume, wherein each of the x flat RF electrodes comprise a slit; a pair of DC plates, wherein the DC plates can be coupled to the x and y pairs of flat RF electrodes, wherein the DC plates can be disposed in the xy plane, and wherein each DC plate can include holes configured to receive a fastener; a base plate, wherein the base pate can be coupled to the DC plates, wherein the base plate can be positioned on top of the spaced x and y pairs of flat RF electrodes, and wherein the base plate can be disposed of in the zy plane, wherein the base plate can be parallel to the Y pair of flat RF electrodes, and wherein the base plate can include holes to receive a fastener, sapphire spacers, wherein the sapphire spacers can have two holes configured to receive a fastener, wherein the sapphire spacers can be placed between the base plate and the DC plate, wherein the sapphire spacers can be placed between the DC plates and the ends of the x and y flat RF electrodes; and fasteners, wherein the fasteners can be passed through the holes in the DC plates, base plates, x and y flat RF electrodes and sapphire spacers. The rectilinear ion trap can be configured to operate a cryogenic temperatures. The rectilinear ion trap can further include insulating spacers, wherein the insulating spacers are positioned between the ends of the x and y RF electrodes. The insulating spacers can be composed of Kel-F, PEEK, or Teflon insulating material. One or more components of the rectilinear ion trap can be composed of stainless steel. One or more components of the rectilinear ion trap can be composed of copper. The rectilinear trap can be configured to operate at cryogenic temperatures down to about 12K. The rectilinear ion trap can configured to perform mass selection of ions and infrared mass spectra analysis inside the rectilinear ion trap.

Also described herein are methods of using and/or operating the rectilinear ion trap and mass spectrometers containing a rectilinear ion trap as described herein that can include spaced x and y pairs of flat RF electrodes that can be disposed in the zx and zy plane to define a trap volume, wherein each of the x flat RF electrodes comprise a slit; a pair of DC plates, wherein the DC plates can be coupled to the x and y pairs of flat RF electrodes, wherein the DC plates can be disposed in the xy plane, and wherein each DC plate can include holes configured to receive a fastener; a base plate, wherein the base pate can be coupled to the DC plates, wherein the base plate can be positioned on top of the spaced x and y pairs of flat RF electrodes, and wherein the base plate can be disposed of in the zy plane, wherein the base plate can be parallel to the Y pair of flat RF electrodes, and wherein the base plate can include holes to receive a fastener, sapphire spacers, wherein the sapphire spacers can have two holes configured to receive a fastener, wherein the sapphire spacers can be placed between the base plate and the DC plate, wherein the sapphire spacers can be placed between the DC plates and the ends of the x and y flat RF electrodes; and fasteners, wherein the fasteners can be passed through the holes in the DC plates, base plates, x and y flat RF electrodes and sapphire spacers; removing mass interferences by ejecting some ions from the trap volume; tagging the ions remaining in the trap volume by pulsing a cooled gas containing the tagging agent into the trap volume; ejecting untagged ions from the trap volume based on mass; and irradiating the remaining ions in the trap volume with infrared radiation.

BRIEF DESCRIPTION OF THE DRAWINGS

Further aspects of the present disclosure will be readily appreciated upon review of the detailed description of its various embodiments, described below, when taken in conjunction with the accompanying drawings.

FIGS. 23A-23B show a perspective view (FIG. 22A) and a side view (FIG. 22B) of an x RF electrode.

(FIG. 38B) Room temperature IRMPD spectrum of protonated PABA (in black) compared with computed IR absorption spectrum (B3LYP/cc-PVTZ) of untagged PABA (in red). Band assignments indicated by color-coding.

FIG. 39 shows a table demonstrating the experimental IRMPD and IRPD band positions for PABA compared with computed band positions.

FIG. 40 shows a table demonstrating Tagging efficiency for tagged analytes in FIGS. 41-42.

FIG. 43 shows a table demonstrating Experimental IRPD band positions for tyramine•ACN and m/z121•ACN CID product ion compared with IRMPD results and computed band positions for tyramine.

FIG. 54 shows a table demonstrating Experimental IRMPD and IRPD band positions for taurine and 2-aminoethylphosphonic acid.

FIG. 55 shows a table demonstrating experimental IRMPD and IRPD band positions for 2-phenyl-1-ethanolamine and tyramine compared to computed band positions.

FIG. 58 shows a table demonstrating Experimental IRPD band positions for several m/z 138 isomers.

FIG. 60 shows a table demonstrating a comparison of m/z 138 isomers based on their difference scores (egn 3) for the IR spectra in FIG. 59.

DETAILED DESCRIPTION

Figure 1:
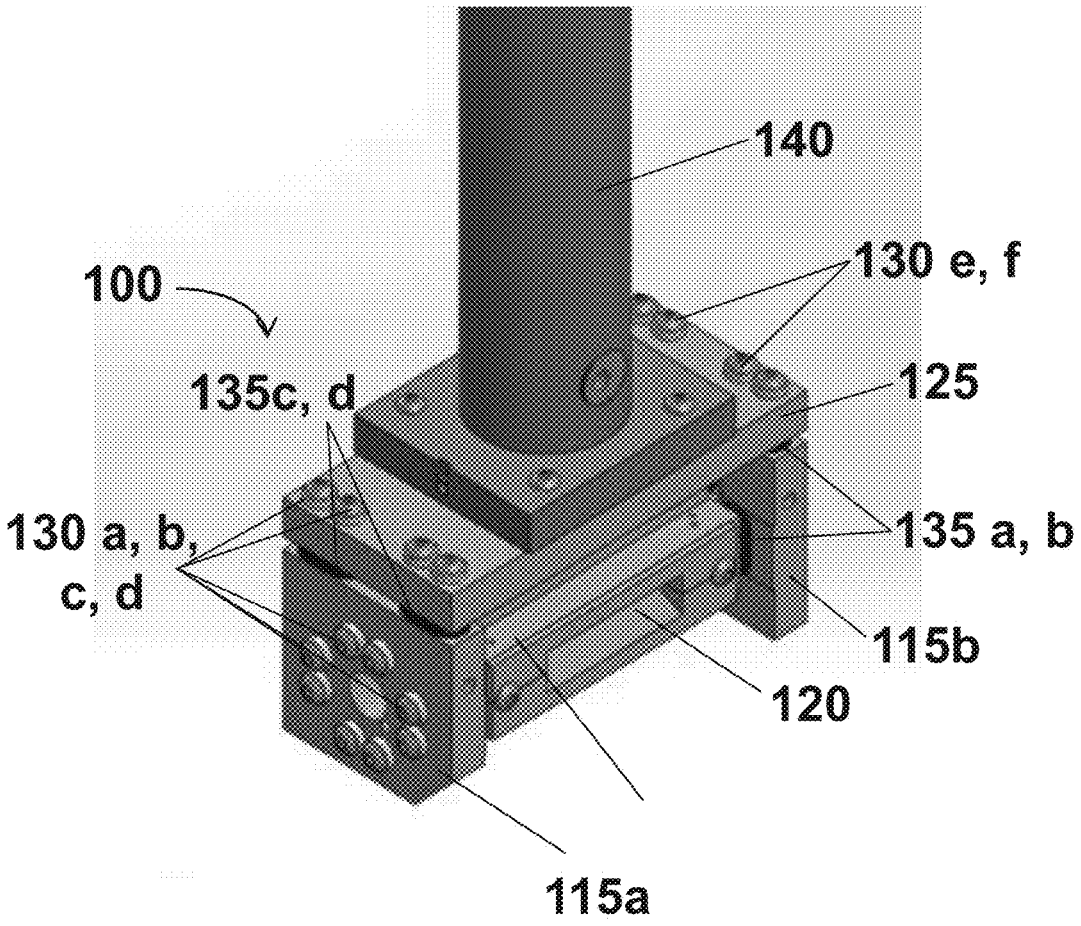
FIG. 1 shows a perspective view of a cryoLIT as described herein.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of molecular biology, microbiology, organic chemistry, biochemistry, physiology, cell biology, cancer biology, and the like, which are within the skill of the art. Such techniques are explained fully in the literature.

Discussion

The infrared spectra of mass-selected ions in a mass spectrometer can be recorded via "action" or "consequence" spectroscopy approaches, where the ion is photodissociated with a tunable light source. The most readily implementable infrared ion spectroscopy technique is infrared multiple-photon dissociation (IRMPD) spectroscopy, where typically room-temperature ions are subjected to intense radiation to cause absorption of several IR photons, leading to the cleavage of covalent bonds. IRMPD spectroscopy has been shown to be powerful in answering certain chemical questions about the structures of ions. Nonetheless, the broader spectral features in IRMPD are an impediment to differentiate between closely related molecules, especially when the number of putative structures is large. Higher resolution IR spectra can be generated at cryogenic temperatures; however, those approaches require custom instrumentation.

The first cryogenic IR "action" spectra of ions were recorded in supersonic experimentations in the 1980's in the so-called messenger spectroscopy scheme. In the expansion, ions are cooled to cryogenic temperatures, allowing inert gas atoms such as Ar (or e.g. Ne or He) to condense onto the ion. As the binding energy of this Van der Waals-tagged atom is lower than the energy of a single IR photon, resonant absorption of an IR photon leads to detachment of the Ar atom. The basic premise of the messenger spectroscopy scheme is that detachment of the weakly-bound tag reports on photon absorption. Another assumptions that the weak binding of the tag only subtly affects the inherent absorption spectrum of the ion. In the 2000's, it was demonstrated that ions could also be cooled and tagged in cryogenic ion traps, and that this approach could then be employed to measure cryogenic IR spectra of ions. This major advance allowed the coupling of any ionization technique with cryogenic spectroscopic interrogation. In terms of biomolecular structure identification, the coupling of electrospray ionization (ESI) especially stands out, and correspondingly there has been a surge in papers in recent years to demonstrate bioanalytical applications of IR spectroscopy.

Cryogenic IR ion spectroscopy has the potential to become a gold standard technique for molecular identification in mass spectrometry, but still faces some significant challenges with respect to instrumentation and methodology to make the technique analytically useful. A key challenge in this respect is the low duty cycle of the experiment, as typically only one molecular species is probed at one light frequency at one time. In principle, the tagging scheme in cryogenic IR ion spectroscopy lends itself to a multiplexed approach, as the mass decrease/increase upon (de)tagging is completely predictable. Thus, the IR spectra of multiple tagged ions could be probed in parallel. As tagging efficiencies are generally low (e.g. a few %), and ion intensities fluctuate from shot-to-shot, for signal-to-noise reasons it is not ideal to measure the depletion of the tagged ion as a function of IR frequency. Instead, by mass selecting the tagged ion, the appearance of the photodissociated untagged ion can be recorded in a background-free scheme. The measurement of the photodissociation yield compensates for random fluctuations in the tagged ion signal. In order to carry out such a background-free scheme on multiple tagged ions, it is important that the ions can be mass isolated inside a mass-selective cryogenic trap.

With that said, described herein is a cryogenic linear ion trap (CryoLIT) that can be configured to allow mass selection and infrared analysis of the molecules with in the ion trap. The cryoLIT describe herein can allow for multiplexing and increased mass range, which can inter alia allow for higher resolution of analytes. Other compositions, compounds, methods, features, and advantages of the present disclosure will be or become apparent to one having ordinary skill in the art upon examination of the following drawings, detailed description, and examples. It is intended that all such additional compositions, compounds, methods, features, and advantages be included within this description, and be within the scope of the present disclosure.

Figure 2:
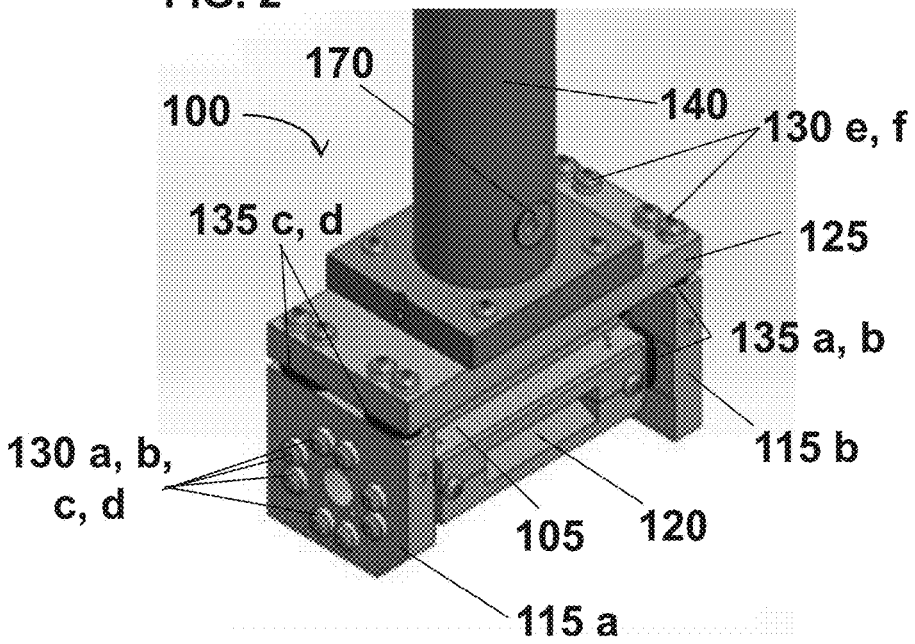
FIG. 2 shows a perspective view of a cryoLIT as described herein.
Figure 3:
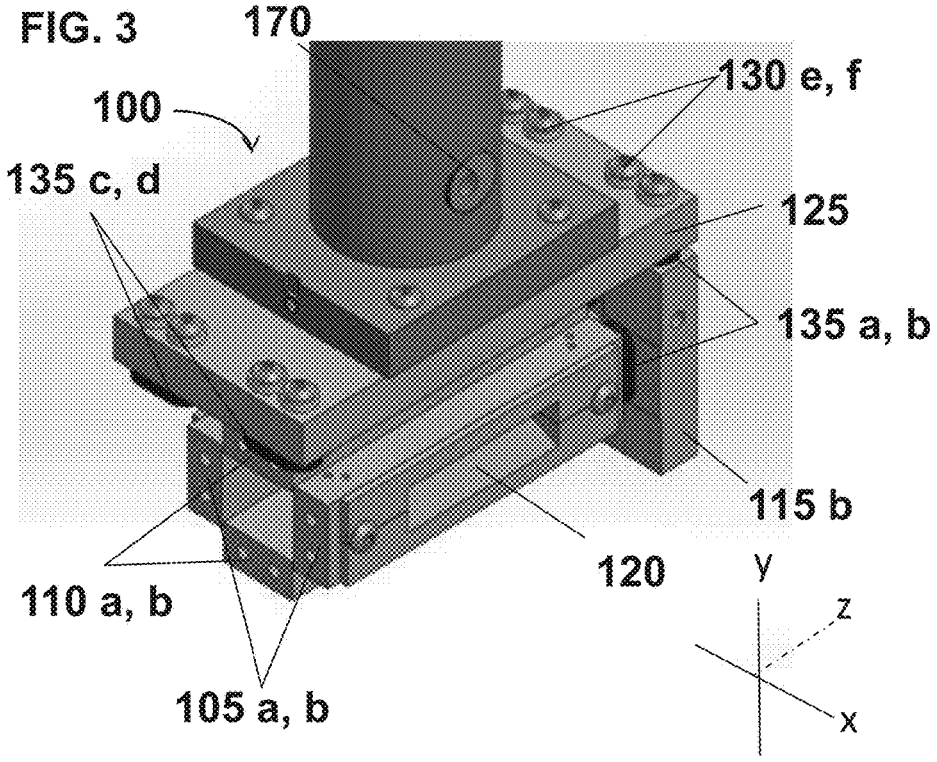
FIG. 3 shows a perspective view of a cryoLIT as described herein.
Figure 4:
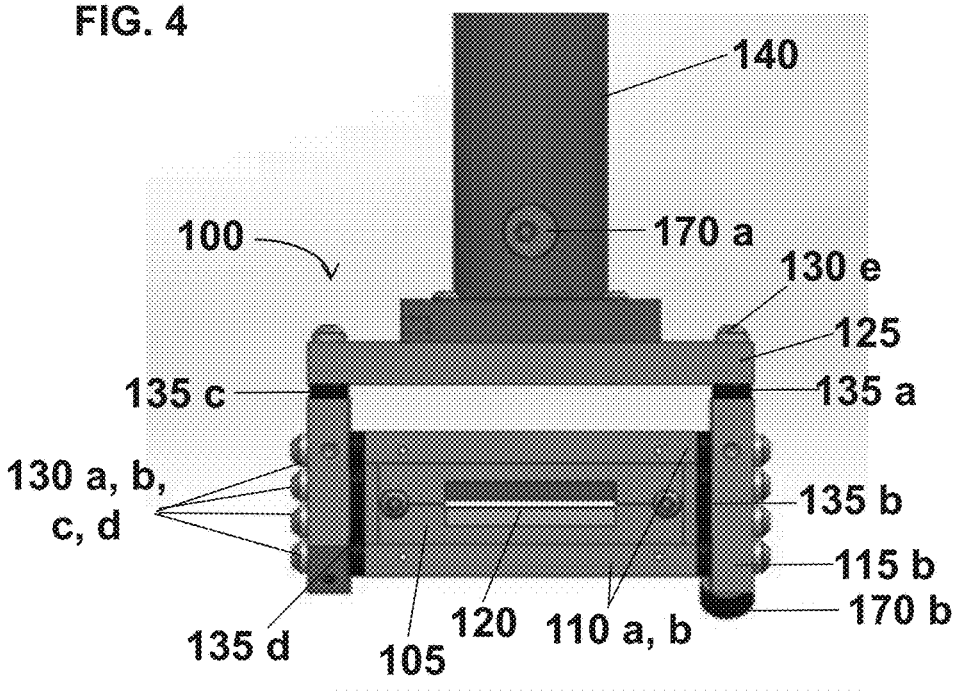
FIG. 4 shows a side view (view 1) of the cryoLIT of FIG. 1.
Figure 5:
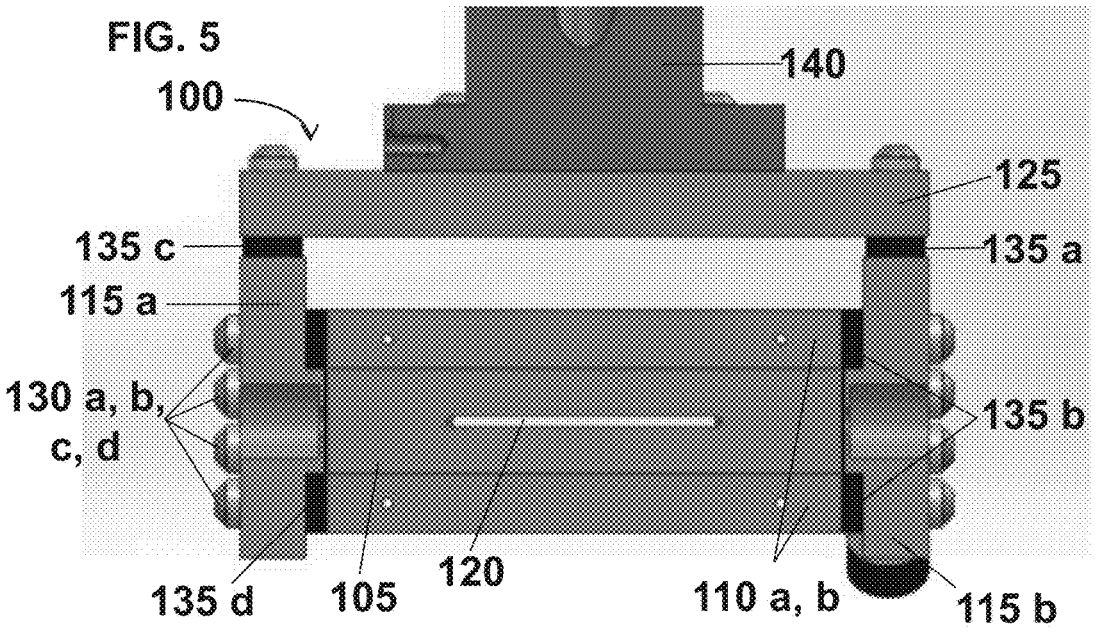
FIG. 5 shows a sectional view of the cryoLIT of FIG. 4
Figure 6:
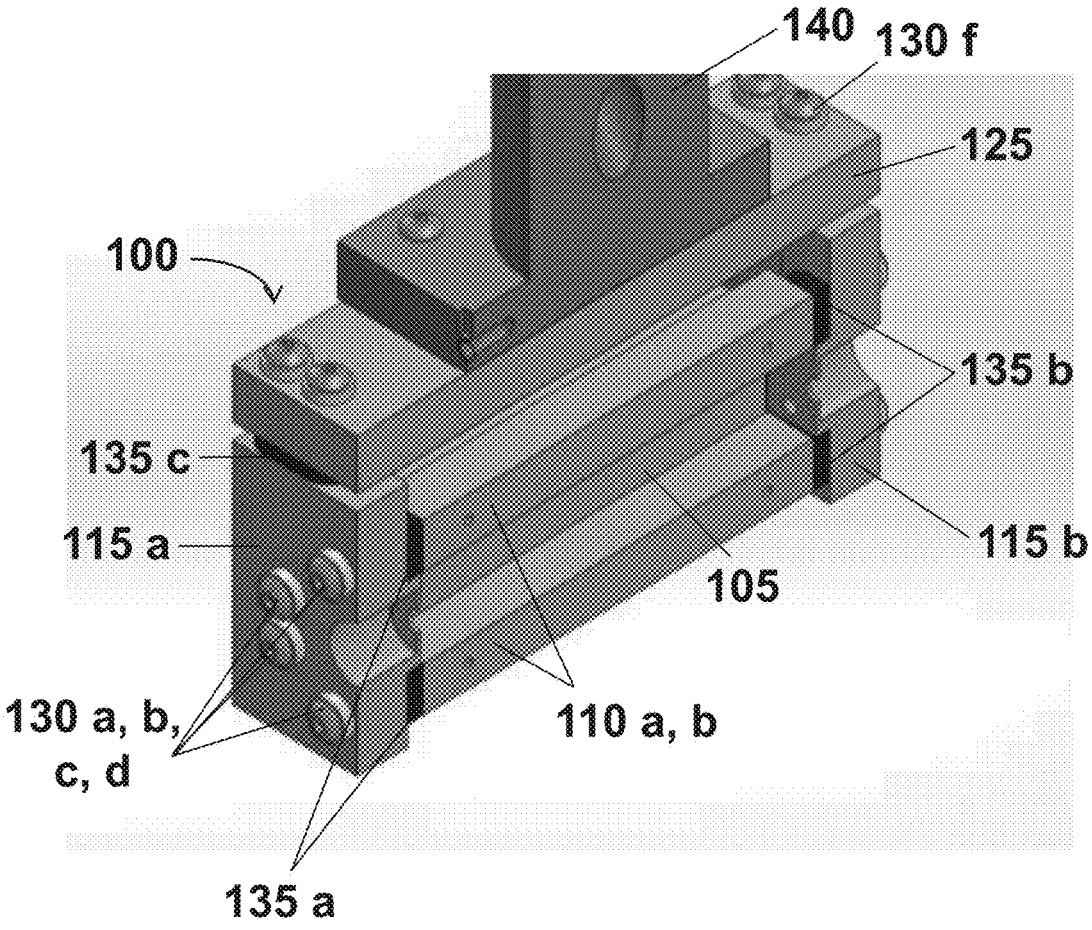
FIG. 6 shows a sectional perspective view of the cryoLIT of FIG. 1.

With the general description in mind attention is directed to FIGS. 1-24 which show aspects of a cryoLIT 100 as described herein. FIGS. 1-3 show various perspective views of a cryoLIT 100 as described herein. FIG. 4 shows a side view of the cryoLIT 100 of FIG. 1. FIG. 5 shows a sectional view of the cryoLIT 100 of FIG. 4 FIG. 6 shows a sectional perspective view of the cryoLIT 100 of FIG. 1. The cryoLIT can include a head extension 140. The cryoLIT 100 can include a linear ion trap. The ion trap can be configured as a rectilinear ion trap. The cryoLIT 100 can include spaced x (105*a, b*, collectively 105) and y (110*a, b*, collectively 105) pairs of RF electrodes. The y 110 and x 105 RF electrodes can be disposed in the zx and zy plane to define a trap volume. The x 105 and y 110 electrodes that can be flat. The x 105 and y 110 RF electrodes can be rectangular. The x 105 and y 110 RF electrodes can each have a length (l), a width (w), and a height (h). The length can range from about 1 cm to 30 cm. The width can range from about 0.3 cm to 10 cm. The height can range from about 0.1 cm to 3 cm. The x RF electrode(s) 105 can include a slit 120. The slit 120 can be rectangular. The slit can run along the length (e.g. along the z axis) of the x RF electrode 105. The slit 120 can be substantially centered on the face of the x electrode 105. As used herein, "about," "approximately," and the like, when used in connection with a numerical variable, can generally refers to the value of the variable and to all values of the variable that are within the experimental error (e.g., within the 95% confidence interval for the mean) or within +/−10% of the indicated value, whichever is greater.

Figure 7:
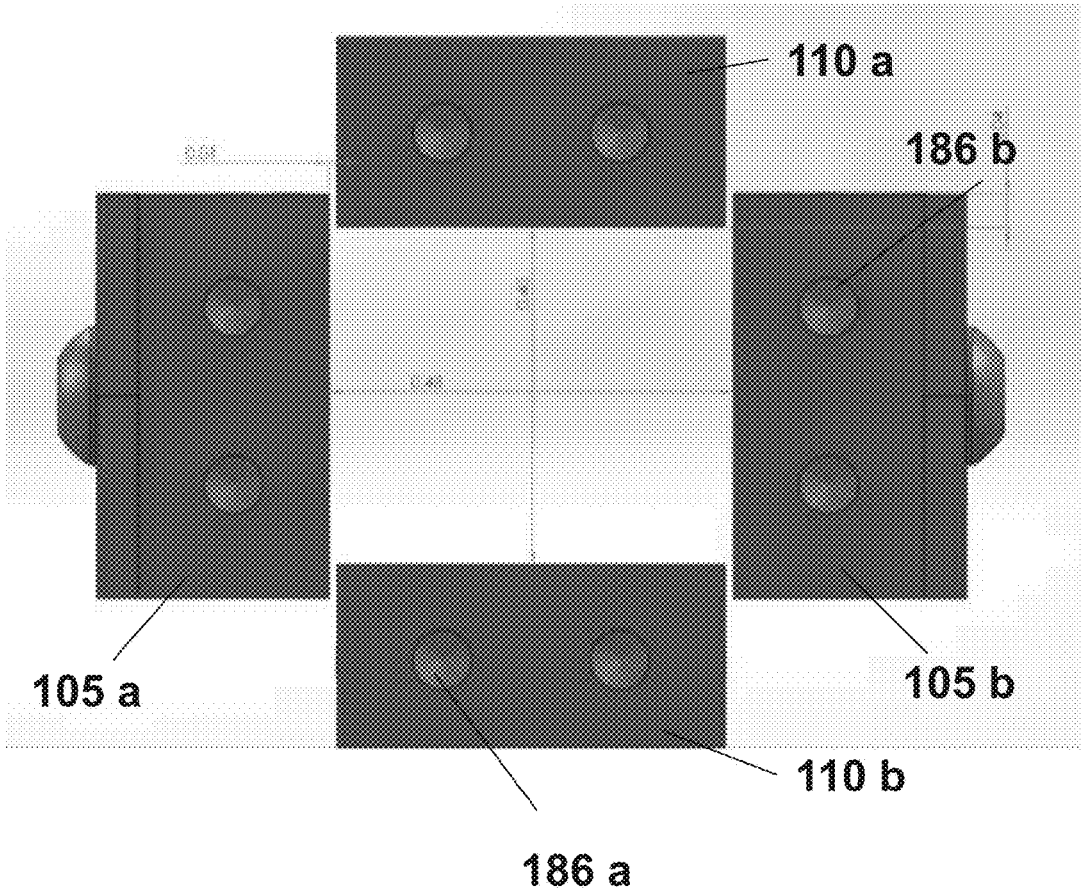
FIG. 7 shows an end view of the RF electrodes of a cryoLIT as described herein.

FIG. 7 shows an end view of the RF electrodes of a cryoLIT 100 as described herein. As shown in FIG. 7, the ends of the RF electrodes 105, 110 can include holes 186 to receive a fastener 130. The holes 186 can also be configured to receive a fastener insulator 175. As shown e.g. FIG. 17, the cryoLIT 100/x RF electrodes 105 can include/be coupled to, respectively, an x RF electrode face plate 190. The x RF electrode face plate 190 can be employed to sandwich a fine metal mesh between the x RF electrode 105 and the x RF electrode face plate 190, which can compensate for electric field imperfections due to the presence of the slit 120.

Figure 12:
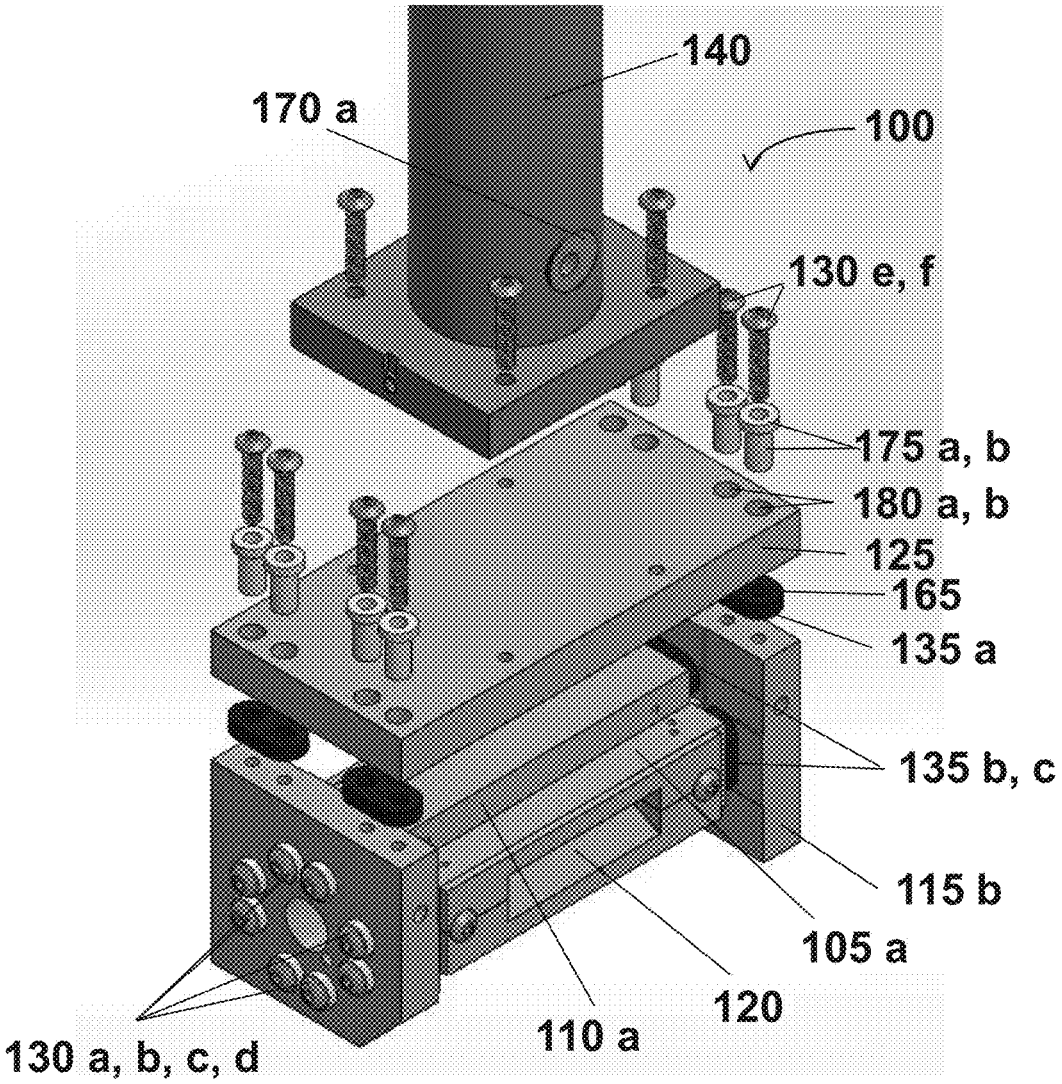
FIG. 12 shows an exploded perspective view of the cryoLIT of FIG. 1.
Figure 13:
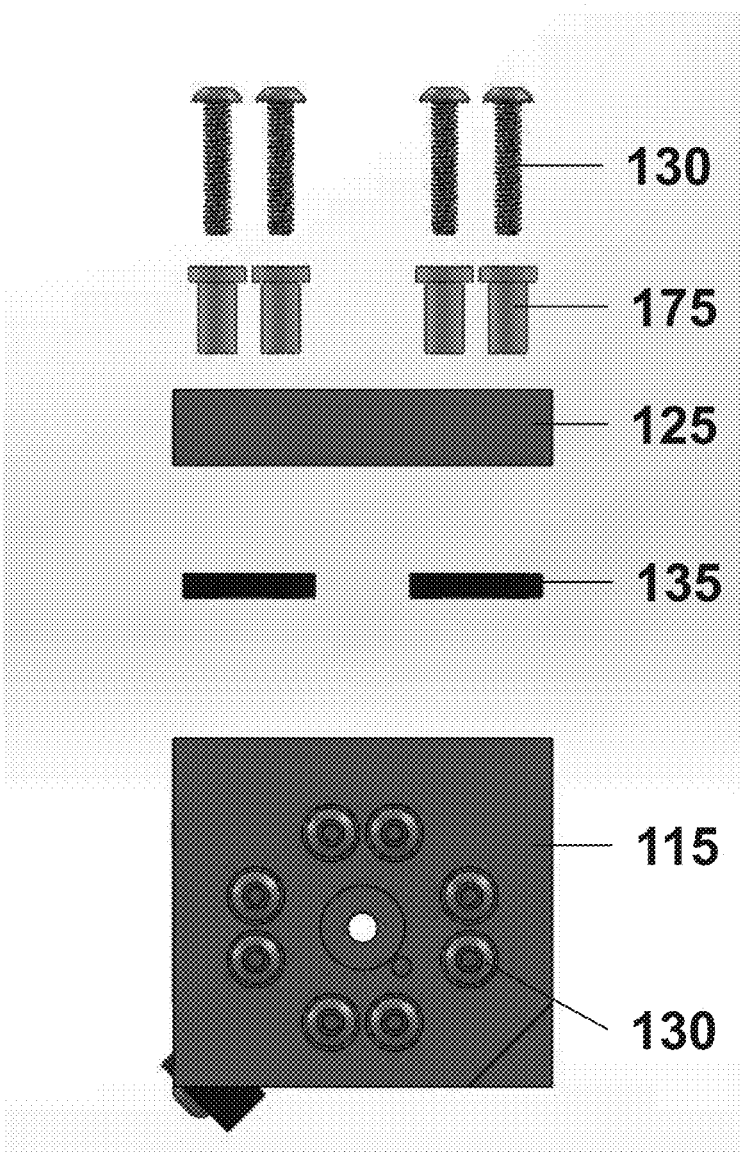
FIG. 13 shows an exploded end view of the cryoLIT of FIG. 1.
Figure 14:
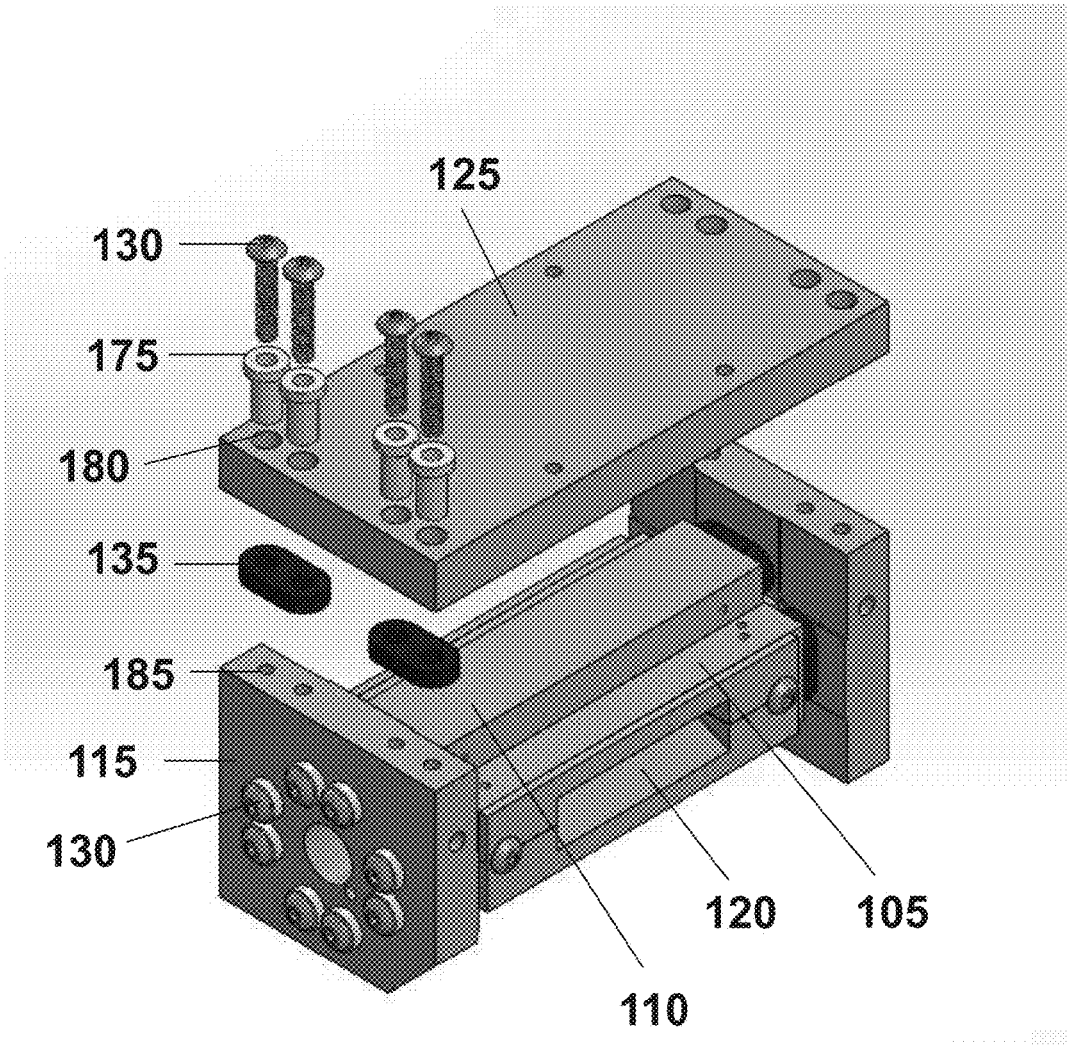
FIG. 14 shows an exploded perspective view of the cryoLIT of FIG. 1.
Figure 15:
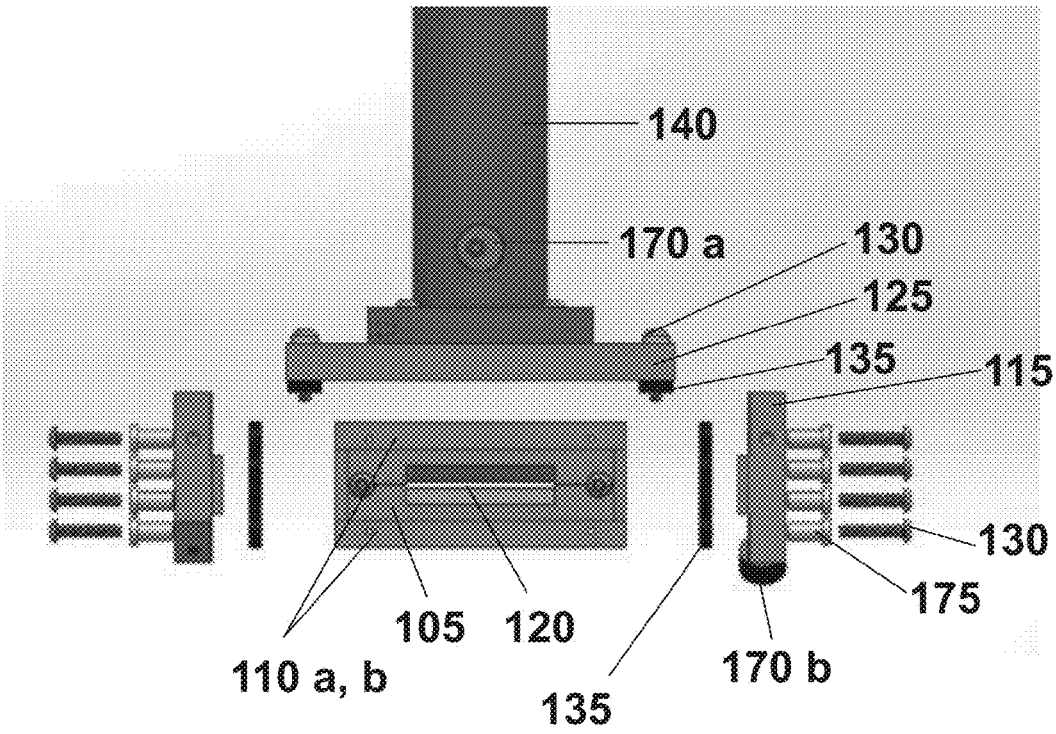
FIG. 15 shows an exploded side view of the cryoLIT of FIG. 1.
Figure 16:
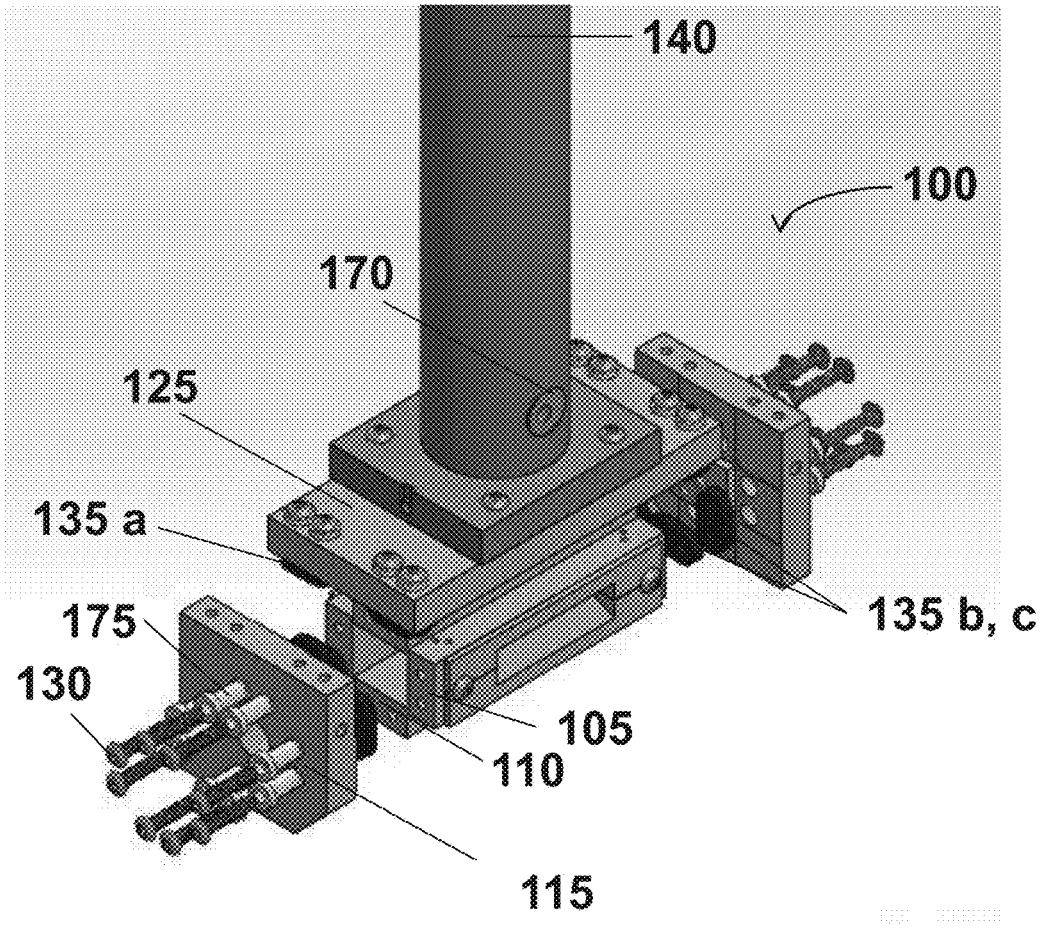
FIG. 16 shows an exploded perspective view of the cryoLIT of FIG. 1.
Figure 17:
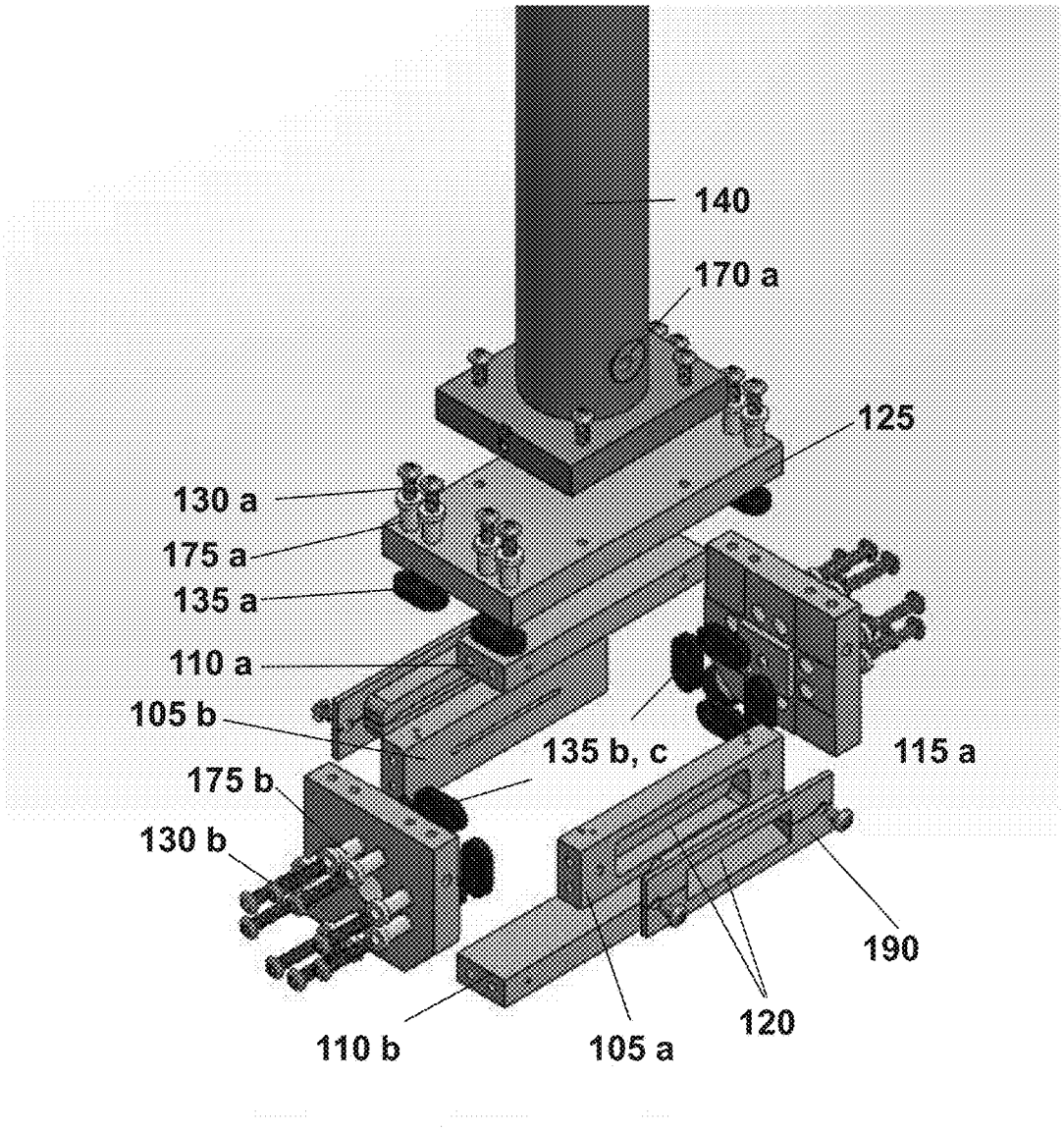
FIG. 17 shows an exploded perspective view of the cryoLIT of FIG. 1.
Figure 18:
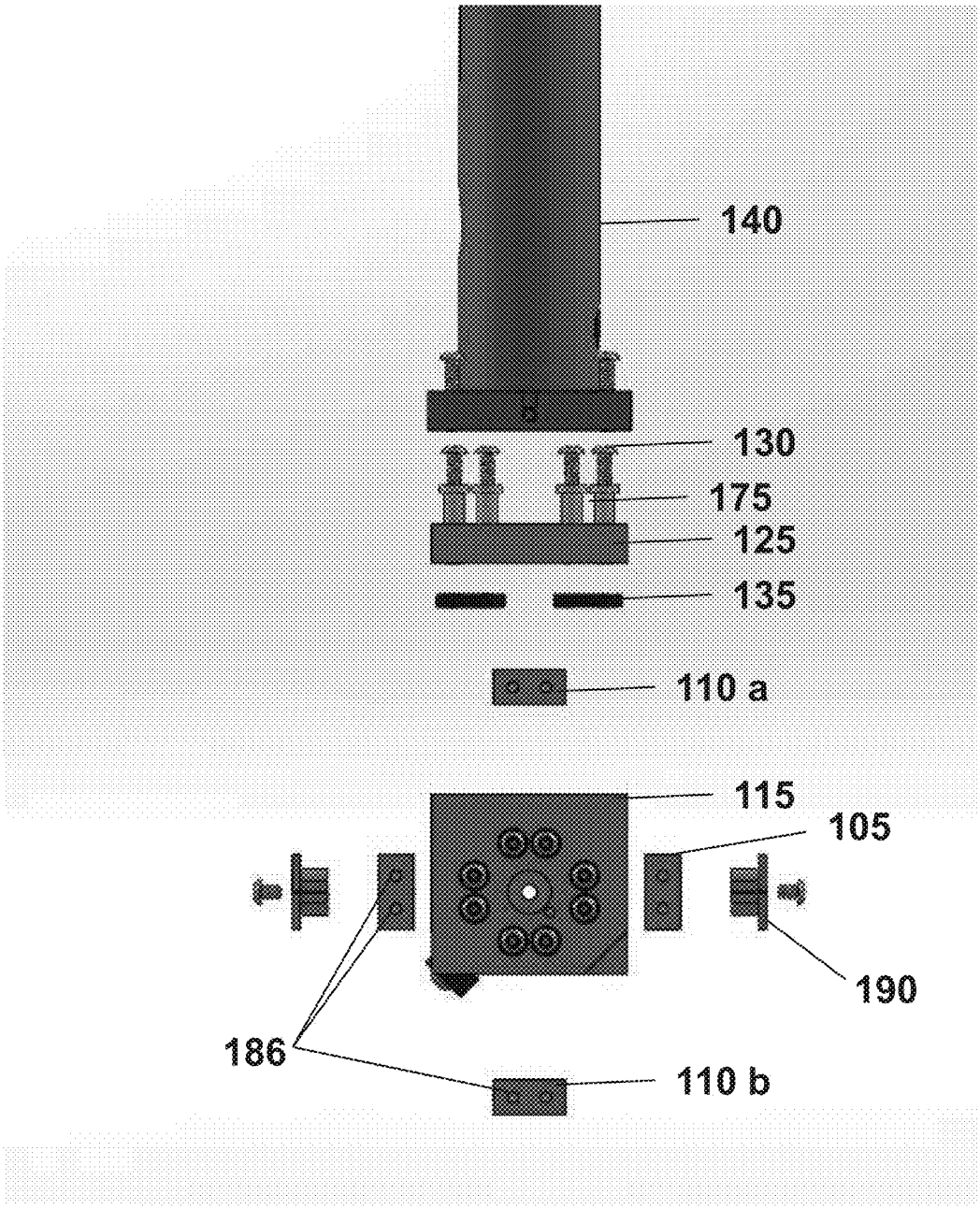
FIG. 18 shows an exploded end view of the cryoLIT of FIG. 1.
Figure 19:
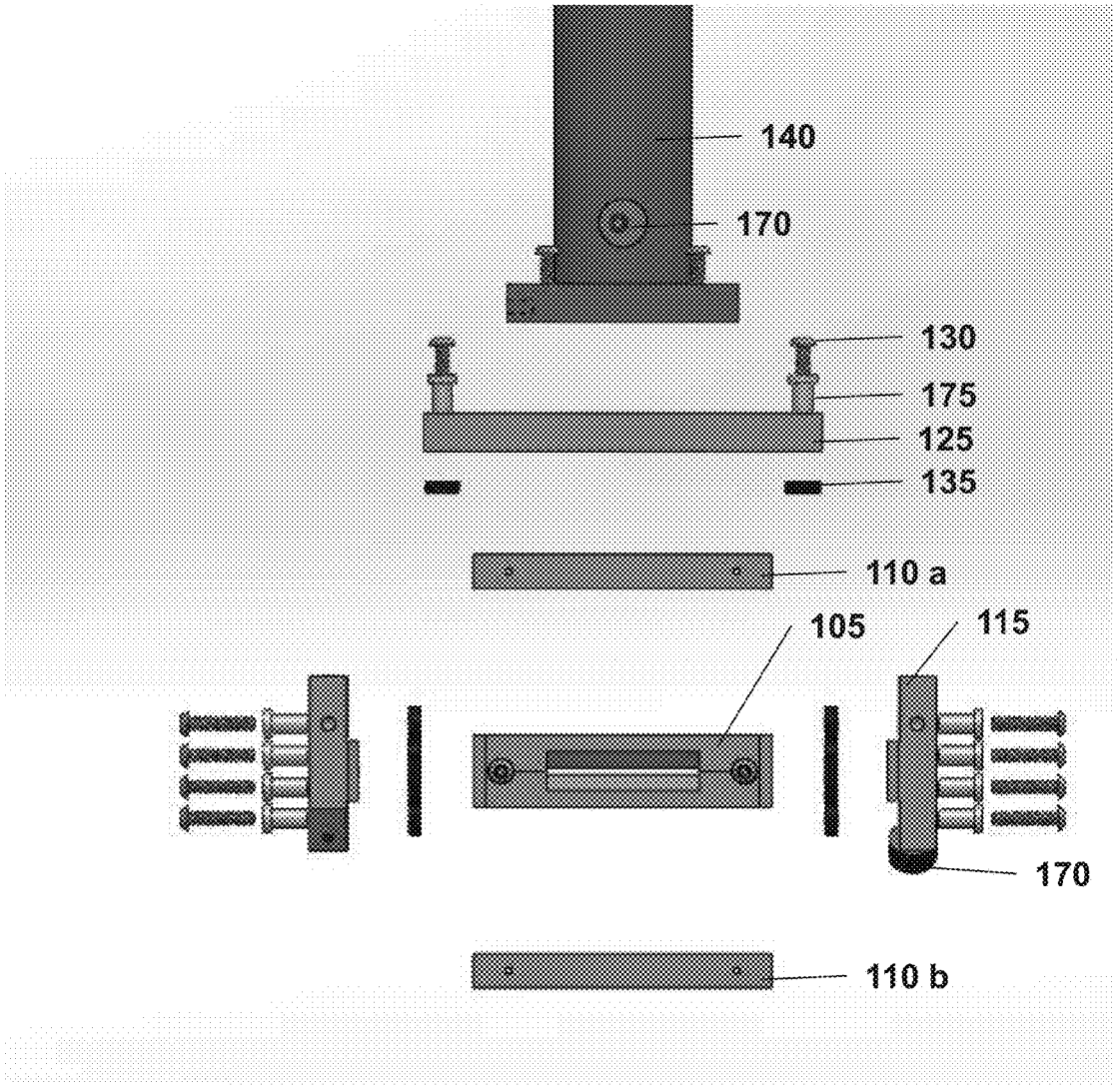
FIG. 19 shows an exploded side view of the cryoLIT of FIG. 1.
Figure 20:
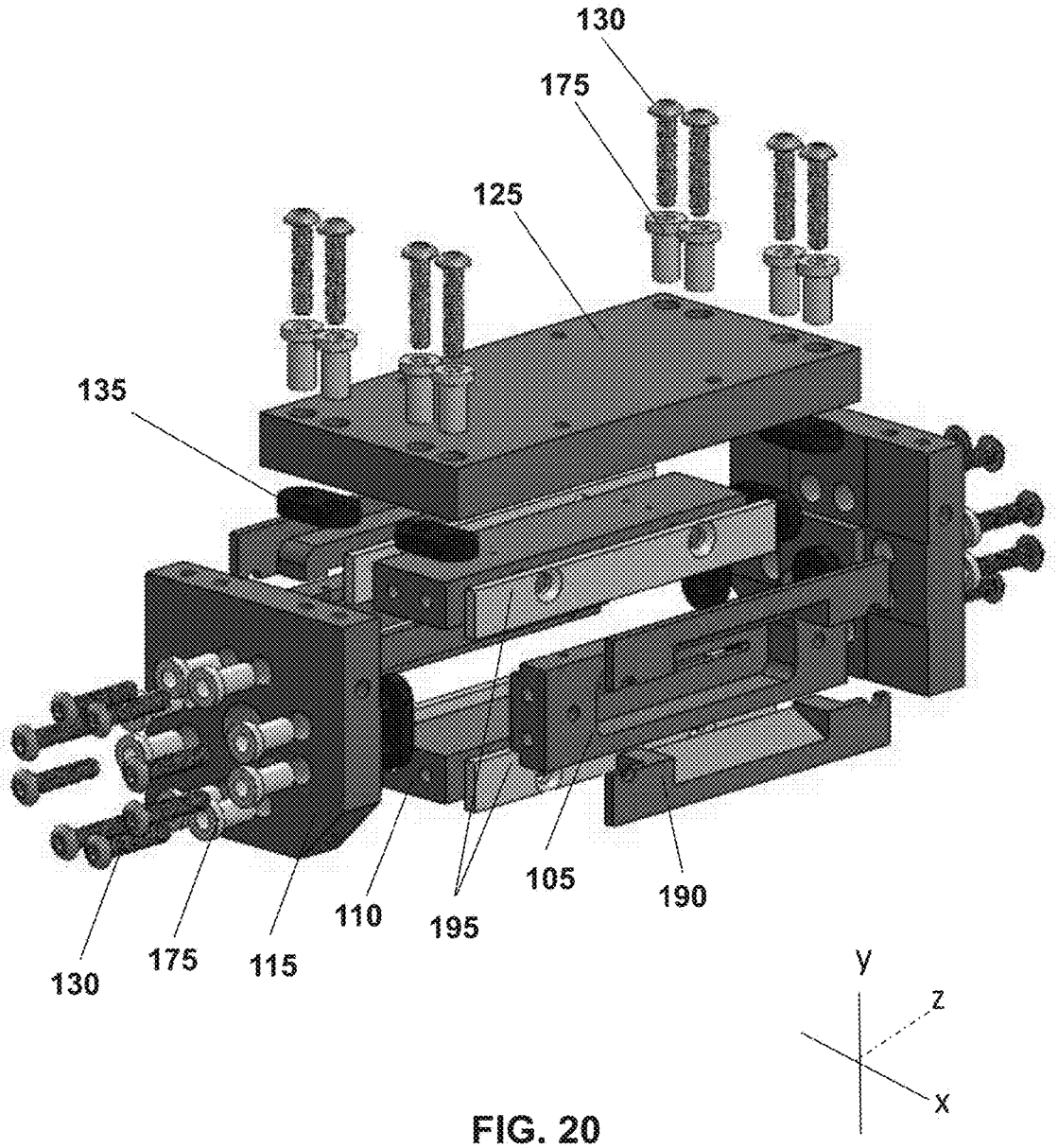
FIG. 20 shows an exploded perspective view of a cryoLIT as described herein having electrode insulators.
Figure 21:
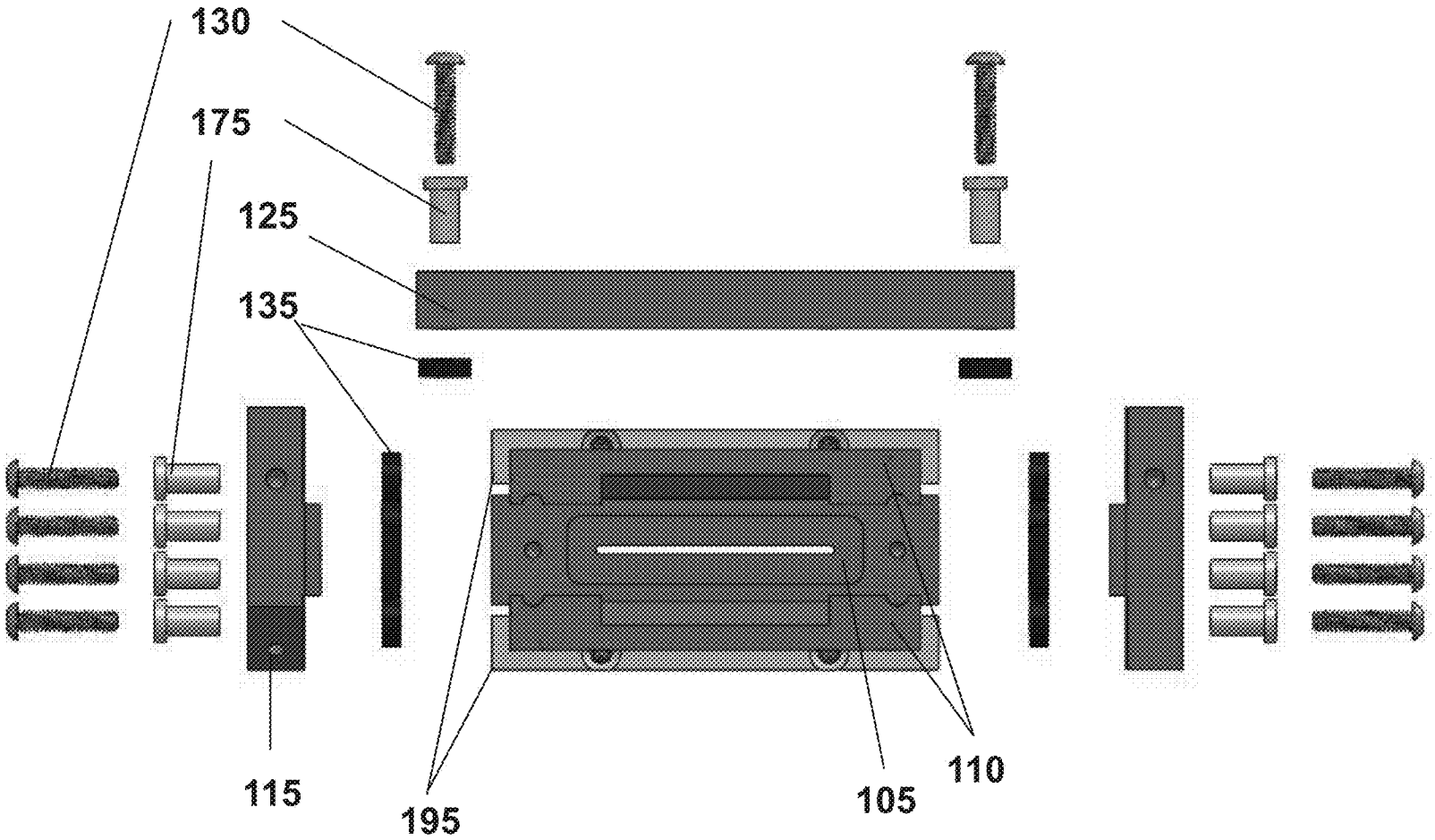
FIG. 21 shows an exploded side view of a cryoLIT as described herein having electrode insulators.
Figure 22:
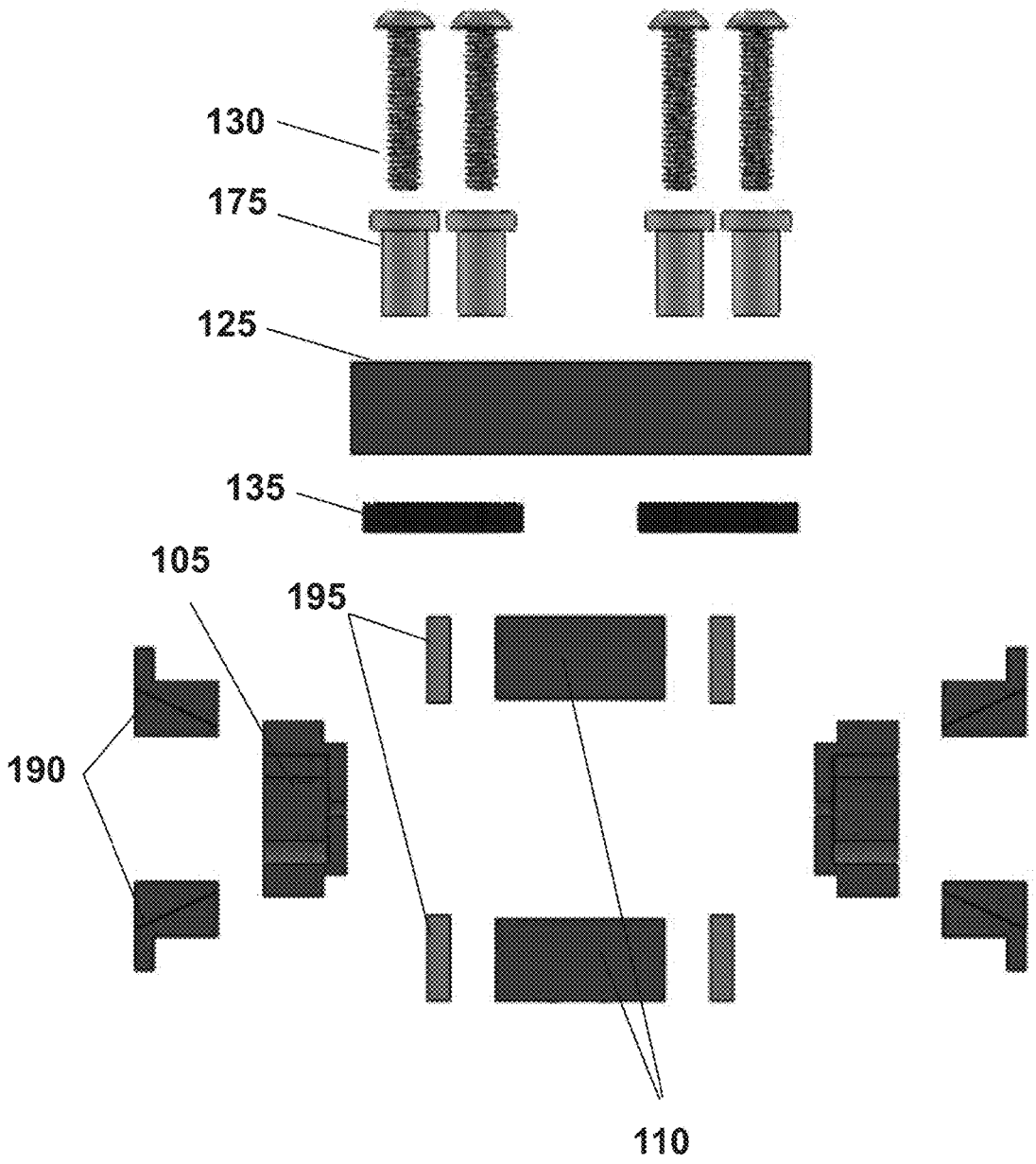
FIG. 22 shows an exploded end view of a cryoLIT as described herein having electrode insulators.
Figure 24:
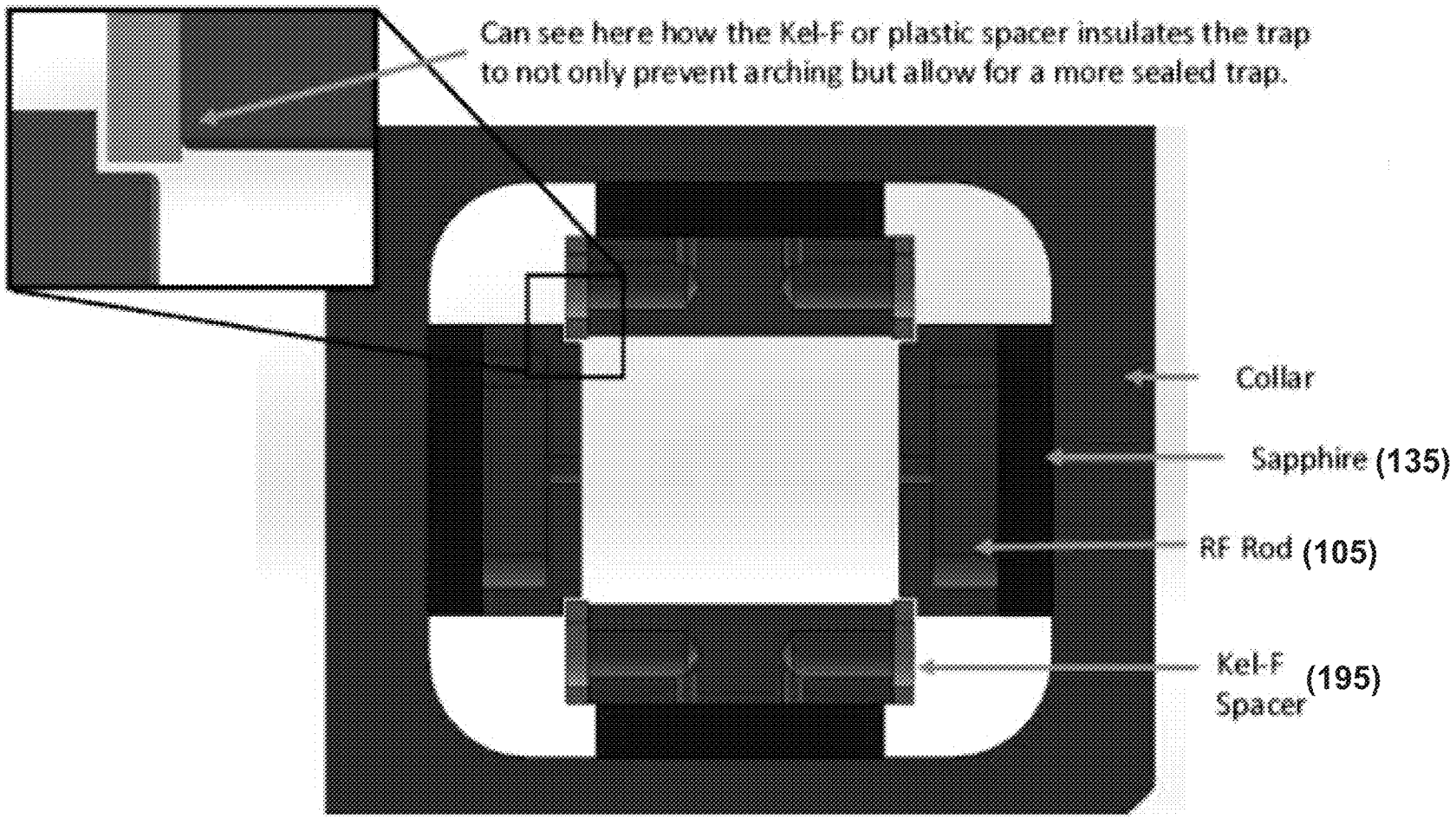
FIG. 24 shows an end view of a cryoLIT as described herein having electrode insulators. The inset shows a close up view of an intersection of RF electrodes and the electrode insulator (e.g. a Kel-F spacer as shown in FIG. 24)
Figure 25:
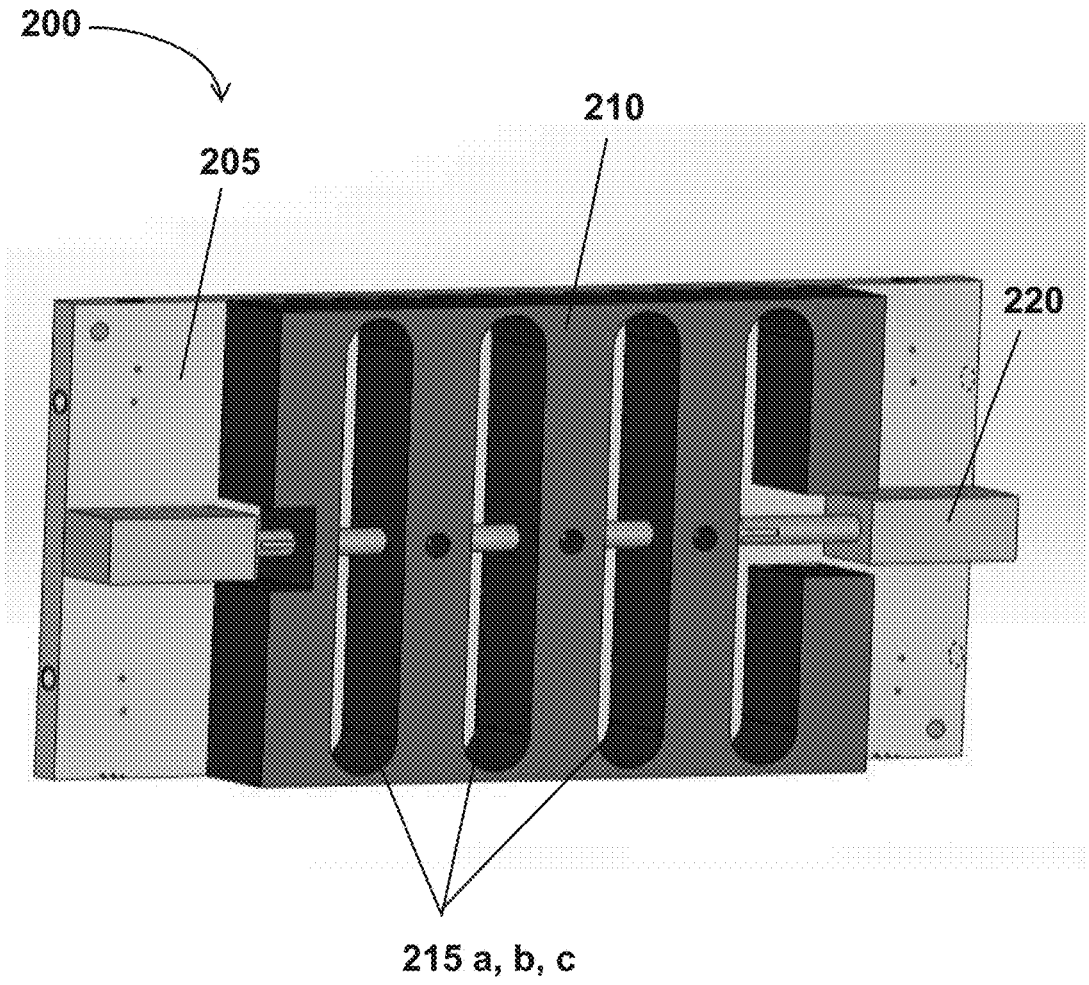
FIG. 25 shows a perspective view of a shutter that can be included on a heat shield or ion trap enclosure.
Figure 26:
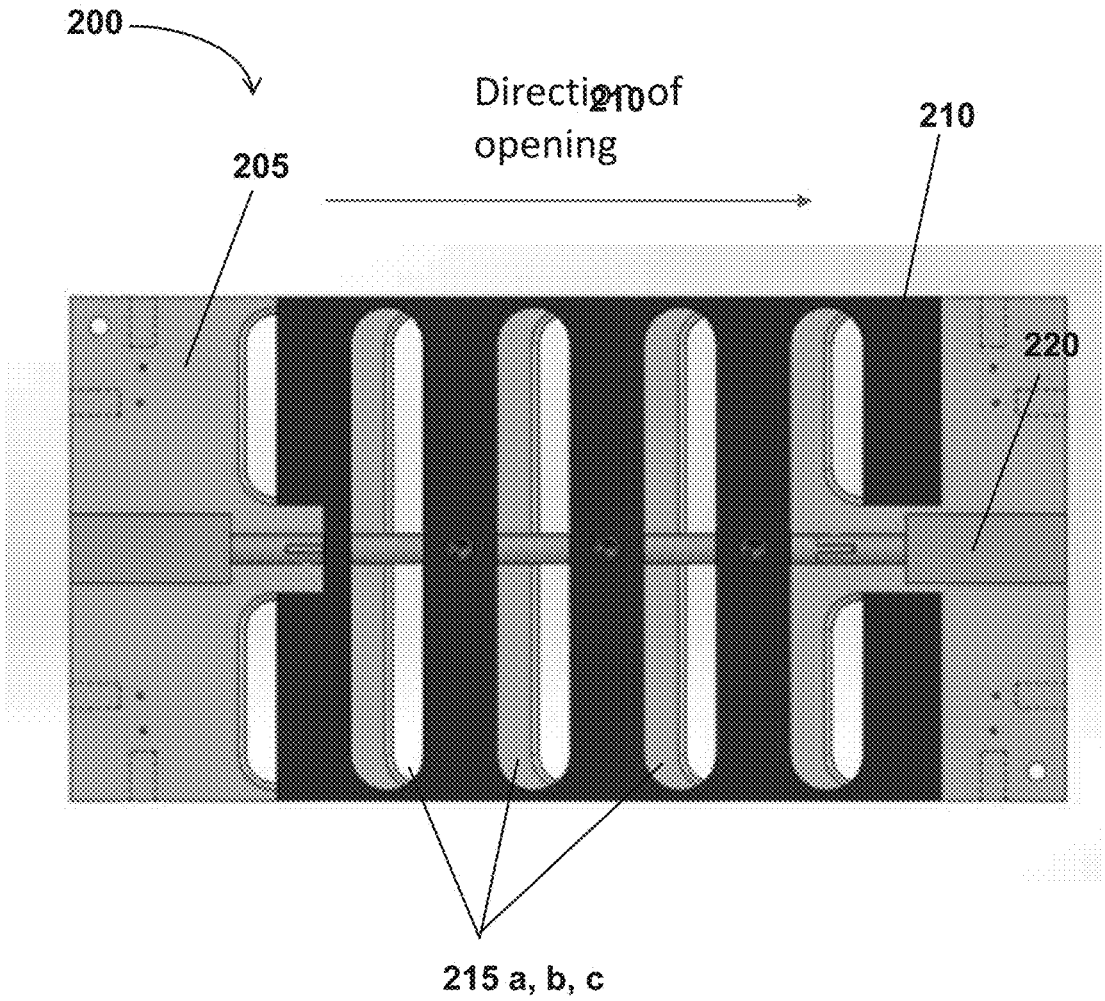
FIG. 26 shows a side view of a shutter that can be included on a heat shield or ion trap enclosure with the shutters partially closed.

The cryoLIT 100 can include a pair of DC plates 115*a, b* (collectively 115), where the DC plates 115 can be coupled to the ends of the x 105 and y 110 pairs of RF electrodes, wherein the DC plates 115 can be disposed in the xy plane, and wherein each DC plate 115 can include holes 185 (see e.g. FIGS. 12, 14, and 16 configured to receive a fastener 130. The holes 185 can also be configured to receive a fastener insulator 175. The fastener insulators 175 can be configured to receive the fastener 130. The fastener insulators 175 can be composed of Kel-F, PEEK, and/or Teflon.

The fastener 130 can be a bolt, screw, rivet, or other fastening device. In some aspects the fastener can have threads. In some aspects the holes 185 can be threaded. The zx and zy ends/sides of the electrodes can contain one or more holes 186 that can be configured to receive the fastener 130 (see e.g. FIG. 18). The holes 186 can be configured to receive the fastener insulator 175. The cryoLIT 100 can include a base plate 125, wherein the base pate can be coupled to the DC plates 115 near the ends of the base plate 125. The base plate 125 can positioned on top of the spaced x 105 and y 110 pairs of RF electrodes. The base plate 125 can be disposed in the zx plane. The base plate 125 can positioned such that it is substantially parallel to the Y pair 110 of RF electrodes. The base plate 125 can include holes 180 (see e.g. FIGS. 12, 14, and 16) that can be configured to receive a fastener 130 and fastener insulator 175 similar to that described with respect to the DC plate holes 185.

Figure 9:
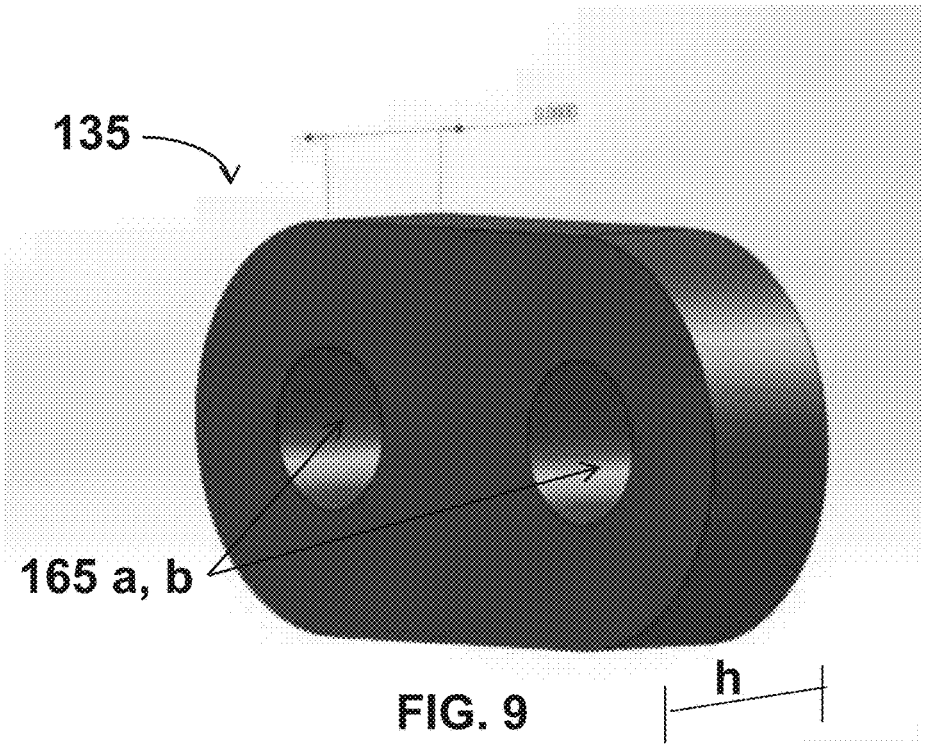
FIG. 9 shows a perspective view of a sapphire spacer.
Figure 10:
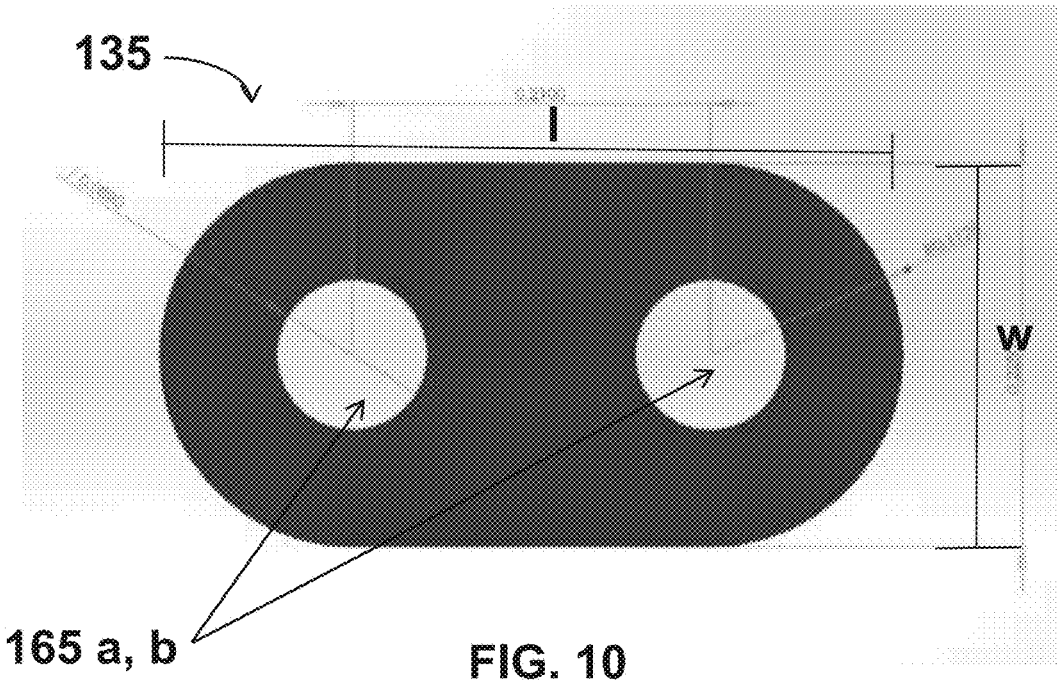
FIG. 10 shows a side view of a sapphire spacer.
Figure 11:
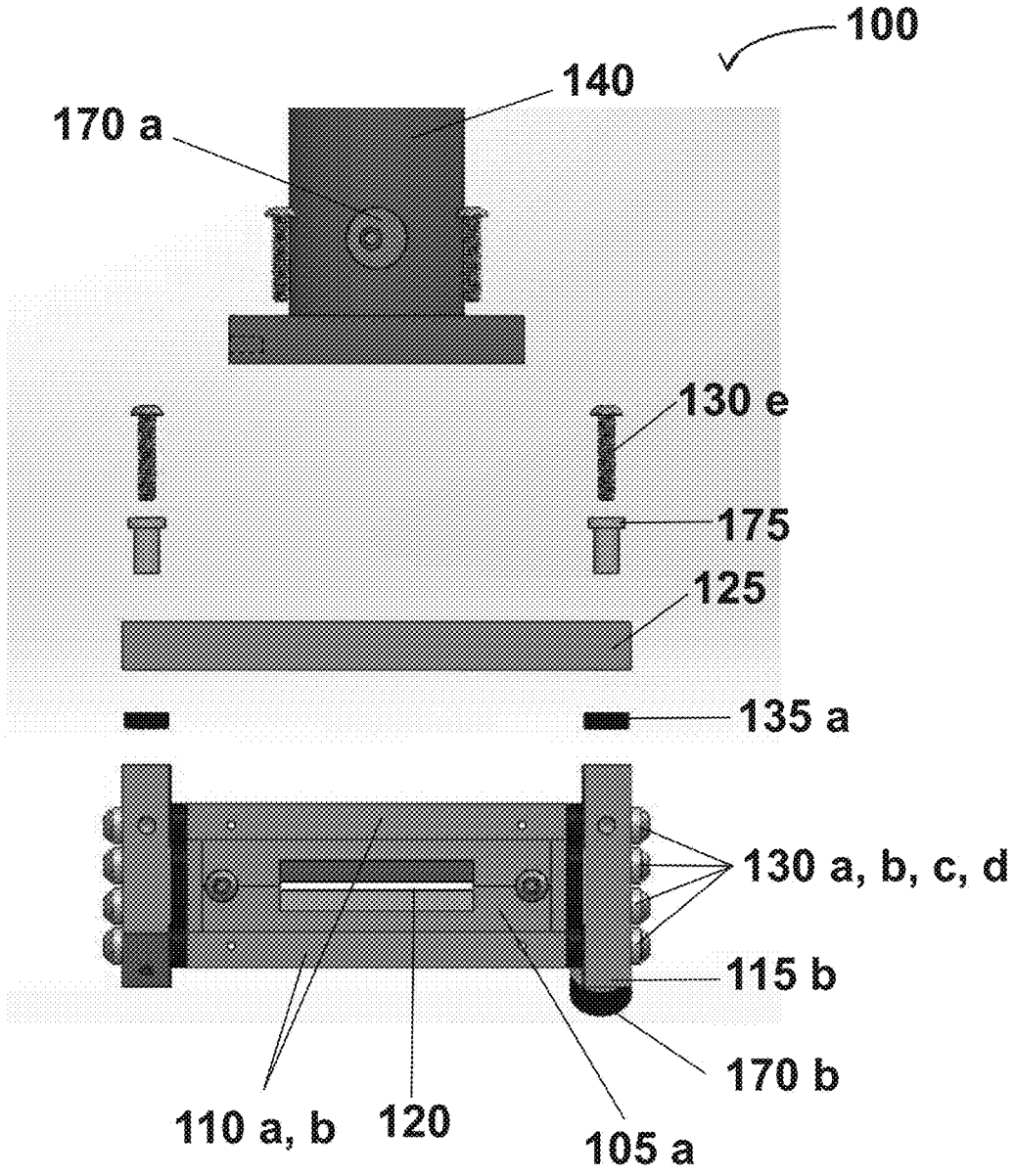
FIG. 11 shows an exploded side view of the cryoLIT of FIG. 1.

The cryoLIT 110 can also include sapphire spacers (135*a, b*, etc., collectively 135). The sapphire spacers 135 can be composed in part or entirely out of sapphire and can have holes 165*a, b* (collectively 165) (e.g. 2 holes) configured to receive a fastener 130. FIG. 9 shows a perspective view of a sapphire spacer. FIG. 10 shows a side view of a sapphire spacer. The sapphire spacer holes 165 can configured to receive a fastener insulator 175 The sapphire spacers 135 can be placed between the base plate 125 and the DC plate 115 and/or between the DC plates and the ends of the x 105 and y 110 RF electrodes. The sapphire spacers 135 and their positioning within the cryoLIT 100 are further discussed below. The sapphire spacers 135 can allow for the use of fasteners 130 to couple the components of the device together and provide proper alignment of the cryoLIT during assembly. This such assembly can permit, among other things, the cryoLIT 100 to withstand the pressures and temperatures that it is operated under without significant loss of alignment. As shown in e.g. FIGS. 9-10 the sapphire spacer 135 can be rectangular with substantially rounded ends. The sapphire spacer 135 can have a length, a width, and a height. The length can range from about 0.4 cm to 5 cm. The width can range from about 0.4 cm to about 4 cm. The height can range from about 0.1 cm to 2 cm.

As discussed above and shown e.g. in FIGS. 12, 14, 16-17, the cryoLIT 100 can also include fasteners 130, wherein the fasteners 130 can be passed through the DC plate holes 185, base plates 180, x and y RF electrode holes 186 and sapphire spacer holes 165 to couple the various components together and to maintain proper alignment of the cryoLIT. As described above and as is shown e.g. in FIGS. 12, 14, 16-17 the fasteners 130 can be inserted into a fastener insulator 174 which can then be inserted into the various holes as described above.

As discussed above and shown in the various FIGS (e.g. FIGS. 11-19), the sapphire spacers 135 can be placed in between various components, e.g. the DC plates 115 and the electrodes 105, 110 and/or the base plate 125 and the DC plates 115. The sapphire spacers 135 can be configured to receive one or more fasteners 130 and/or fastener insulators 175 that can be passed through other components such that the sapphire spacers 135 are sandwiched between both of the components. In operation, the cryoLIT expands and contracts. The sapphire spacers 135 can act as a guide for assembly but also help keep the cryoLIT in alignment throughout operation of the ion trap. Current ion traps do not include such features and fail to maintain alignment during temperature and pressurization cycling during cryogenic operation. Thus current ion traps are not suitable for use for completing mass separation and photodissociation analysis within the trap because the pressurization cycling and temperature cycling results in misalignment of the device. The cryoLIT 100 as described above can allow operation at temperatures ranging from room temperature down to about 17 K.

Figure 8:
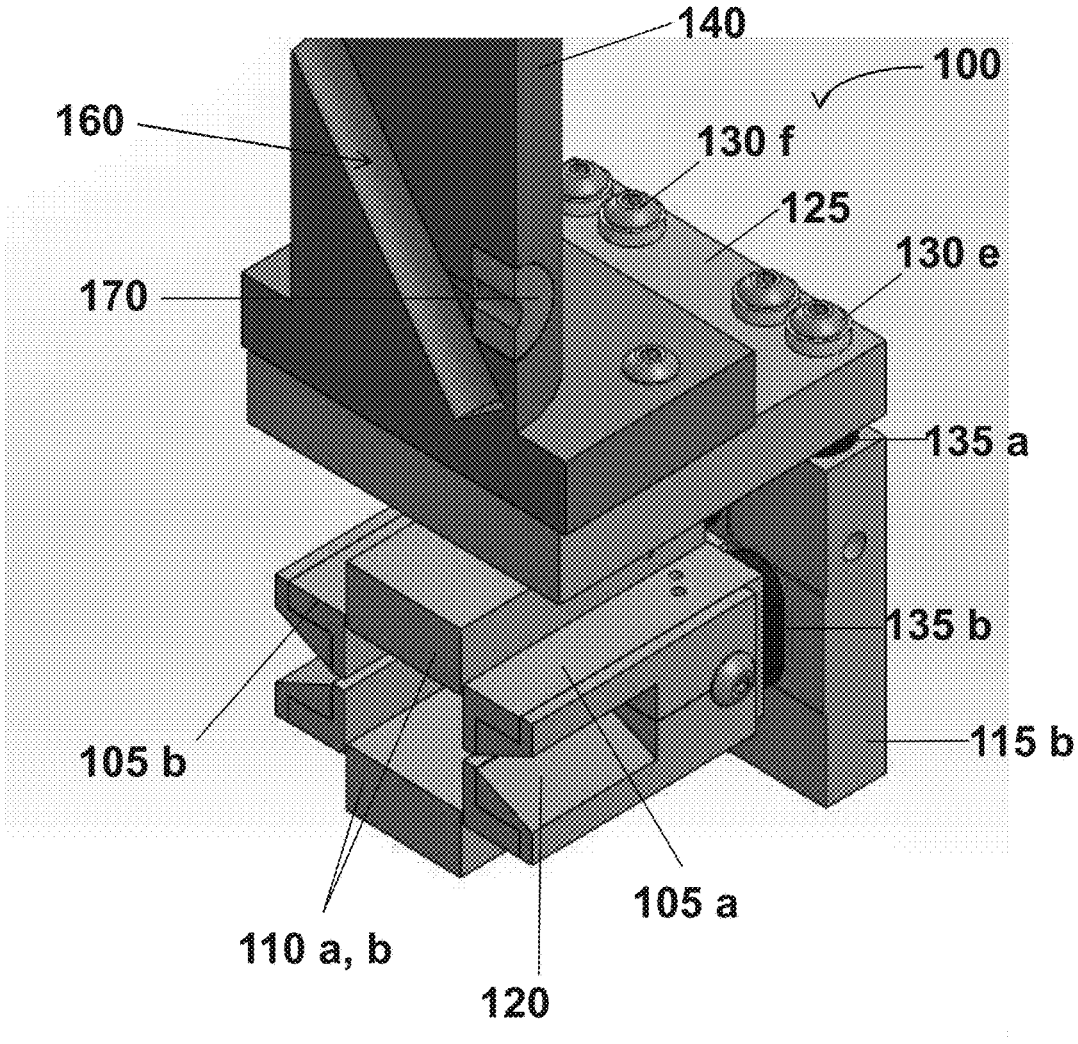
FIG. 8 shows a perspective sectional view of the cryoLIT of FIG. 1.

The cryoLIT 100 can include one or more temperature sensors 170. As shown in FIG. 8, the head extension 140 can include a heat cartridge slot for temperature control.

As shown in FIGS. 20-24, the cryoLIT 100 described herein can include electrode insulator spacers 195, which can allow x 105 and y 110 RF electrodes to be placed close together without arching during operation. This can increase the stability of the ion trap when cycling though cryogenic temperatures and facilitate operation at even lower (less than 17K) temperatures. In some aspects, the cryoLIT 100 that includes the electrode insulator spacers 195 can be operated as from room temperature to about 12 K. Operation of the ion trap down to temperatures of 12 K can allow for the use of tags in addition to $N_2$, such as Ne, $H_2/D_2$.The insulator electrode spacers 195 can be composed of Kel-F, PEEK, and/or Teflon. The insulator electrode spacers 195 can run the entire length and width of the y electrode 110. The thickness as measured along the x axis of the insulator electrode spacers 195 can range from about 0.1 cm to 1 cm. The improved shielding of the RF electrodes can further extend the mass range of the ion trap.

The RF electrodes 105, 110, DC plates 115, base plate 125, face plate 190, and/or head extension 140 can be composed of a suitable metal. Suitable metals include stainless steel and copper. In some aspects, when these components are copper, the cryoLIT can be operated at temperatures less than 17K (e.g. from room temperature down to about 12 K). Operation of the ion trap down to temperatures of 12 K can allow for the use of tags in addition to $N_2$, such as Ne, $H_2/D_2$.

Figure 27:
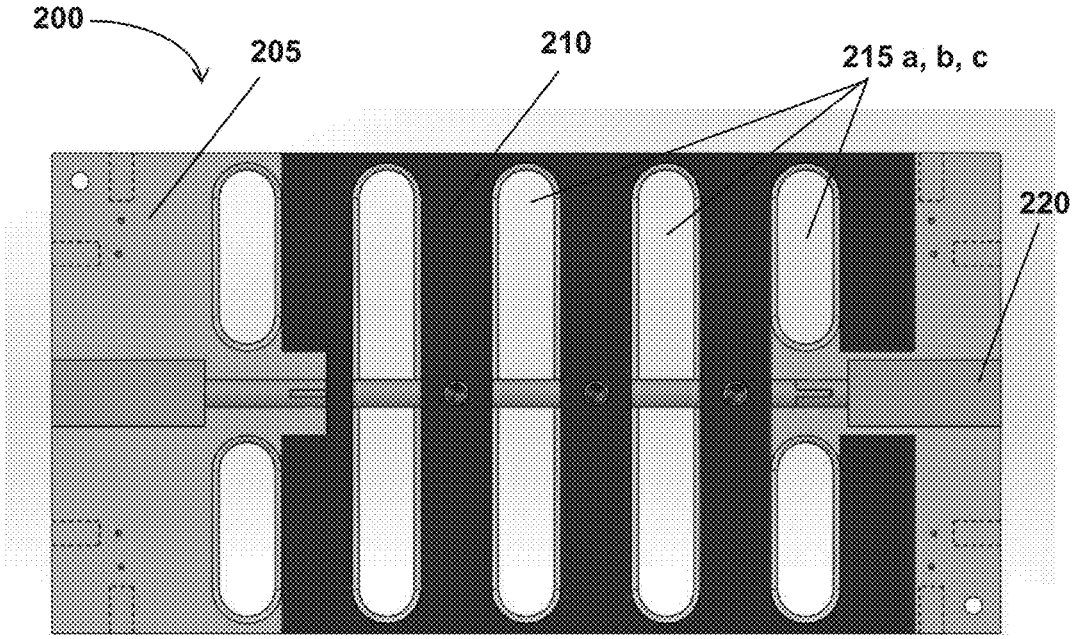
FIG. 27 shows a side view of a shutter that can be included on a heat shield or ion trap enclosure with the shutters open.
Figure 28:
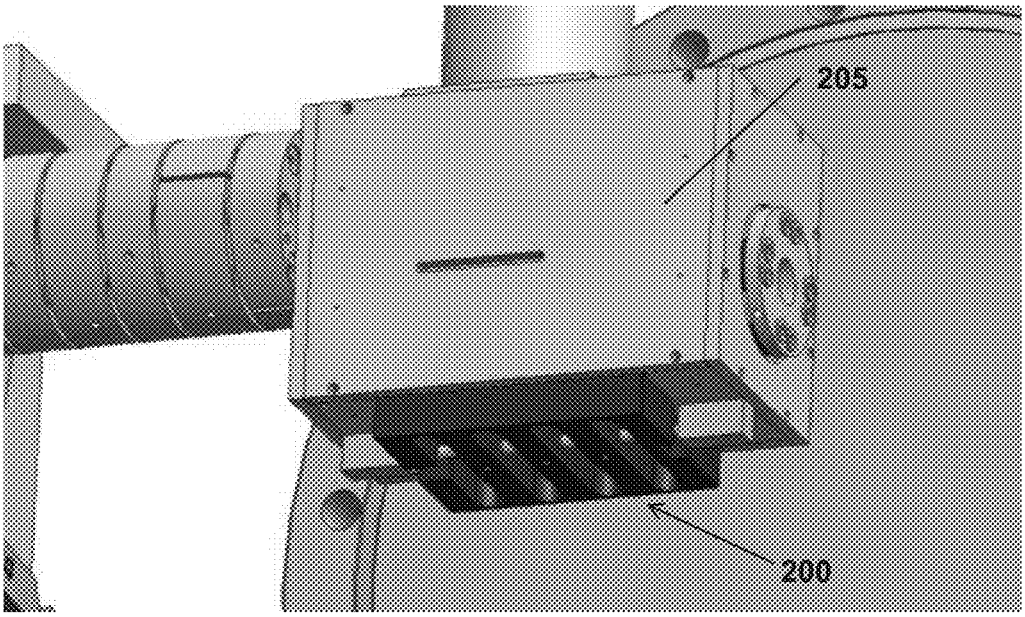
FIG. 28 shows a perspective view of a heat shield enclosure of a cryoLIT as described herein with the shutter of FIGS. 25-27 installed.
Figure 29:
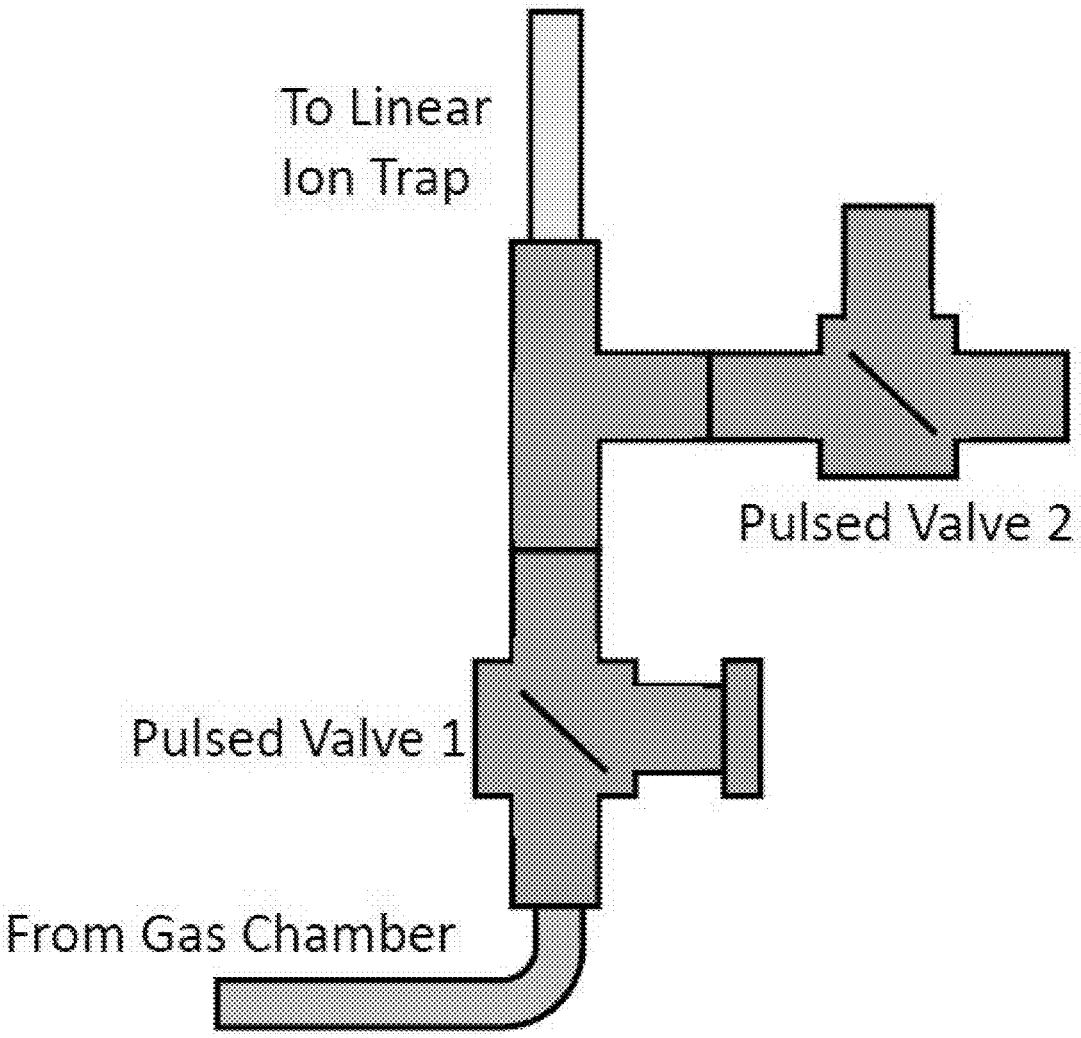
FIG. 29 shows a schematic of an arrangement of pulse valves in a gas delivery system configured to deliver gas to the cryoLIT described herein.

The cryoLIT can include an enclosure and/or a heat shield 205 which can surround the all or part of the components discussed above. As shown in FIGS. 25-28 the enclosure and/or heat shield 205 can include a shutter 200 to facilitate in venting gas after pressurization from the ion trap. The shutter 200 can include a slotted top cover 210 that can include slots 215*a, b, c*, etc. (collectively 215). The slots 215 on the top cover 210 can align or overlap with corresponding slots in the enclosure or heat shield 205 when in the open or partially open position, respectively. A solenoid driver 220 can be used to facilitate the opening and closing of the shutter 210. To open the shutter 200, the top cover 210 can be slide along the enclosure/heat shield 205 to move the slots 215 of the top cover 210 and enclosure/ heat shield to complete alignment as shown in FIG. 27.

Figure 30:
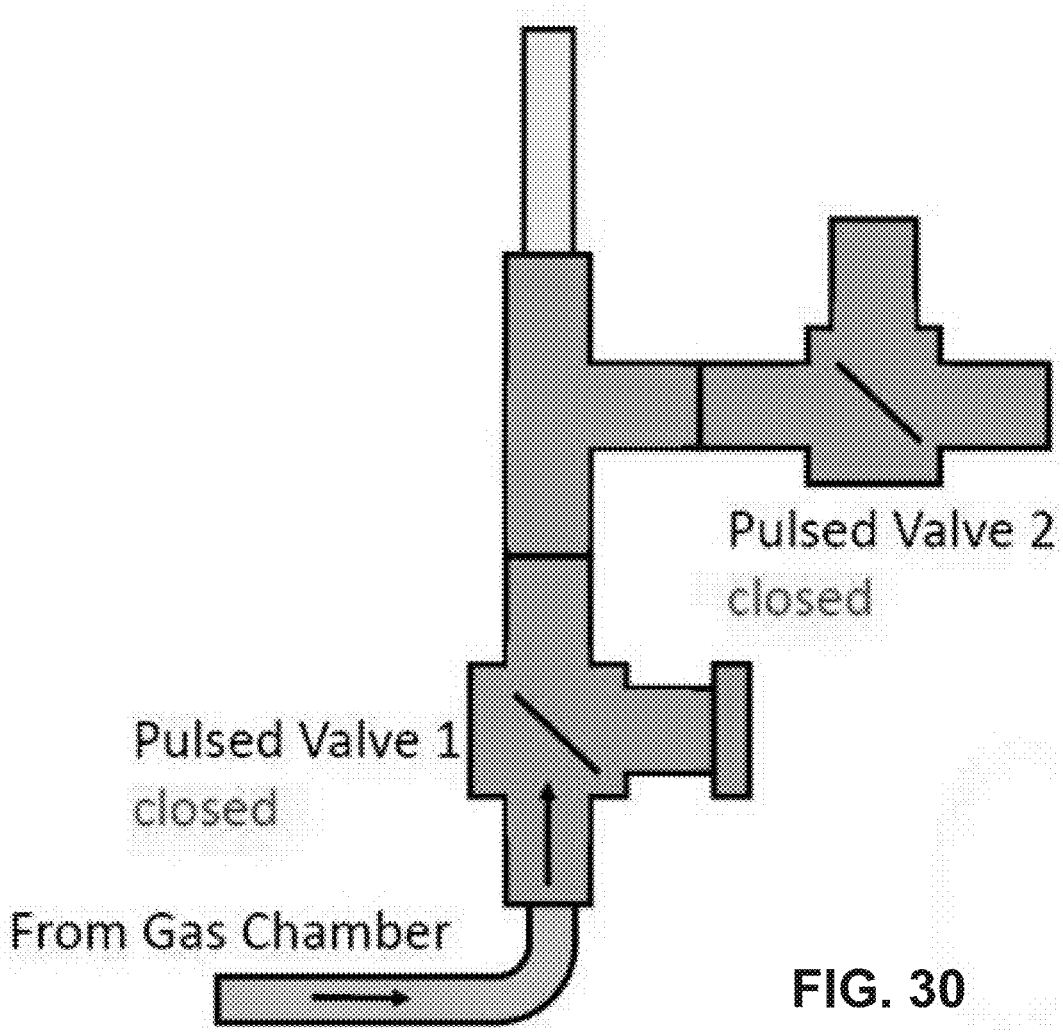
FIG. 30 shows a schematic of an arrangement of pulse valves in a gas delivery system configured to deliver gas to the cryoLIT described herein with the valves closed.
Figure 31:
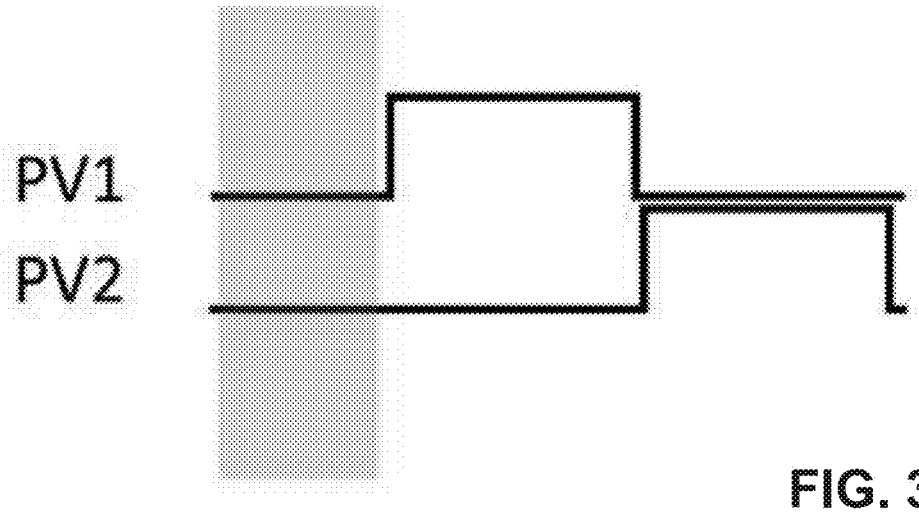
FIG. 31 shows a time trace of the pulse valves open and closed states with the shaded bar indicating the state of the system as depicted in FIG. 30.
Figure 32:
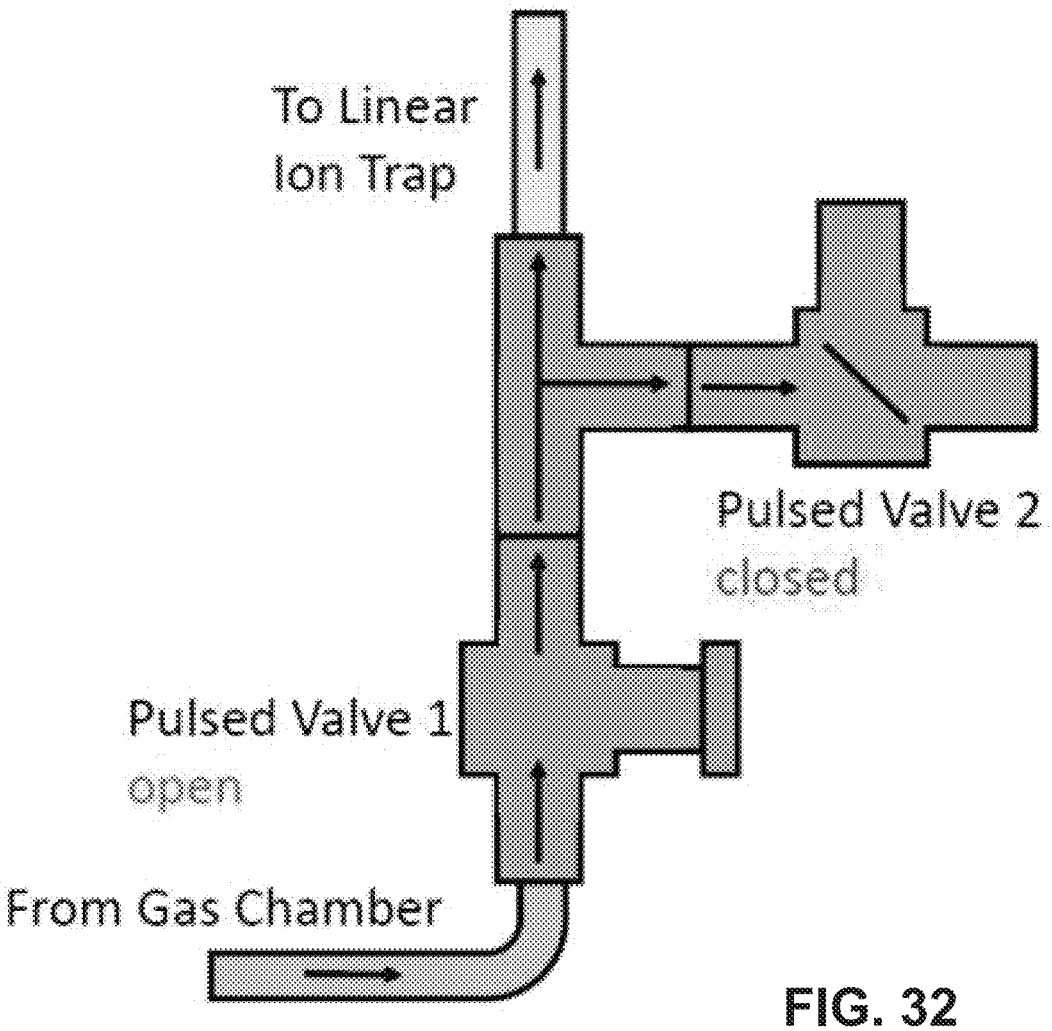
FIG. 32 shows a schematic of an arrangement of pulse valves in a gas delivery system configured to deliver gas to the cryoLIT described herein with the first valve open and the second valve closed to allow gas to flow into the cryoLIT.
Figure 33:
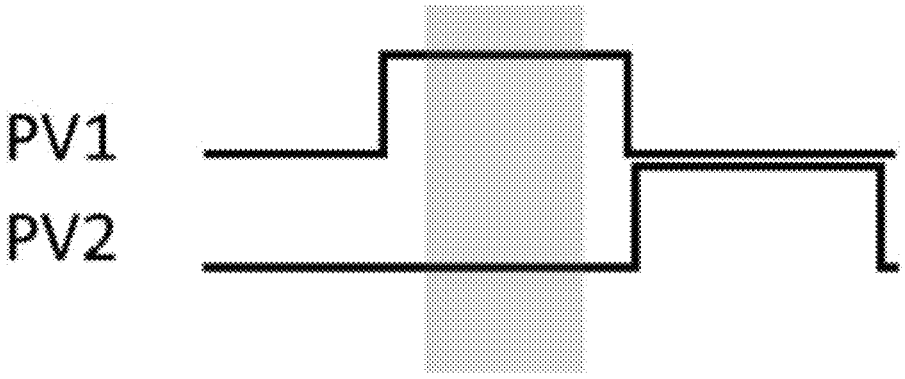
FIG. 33 shows a time trace of the pulse valves open and closed states with the shaded bar indicating the state of the system as depicted in FIG. 32.
Figure 34:
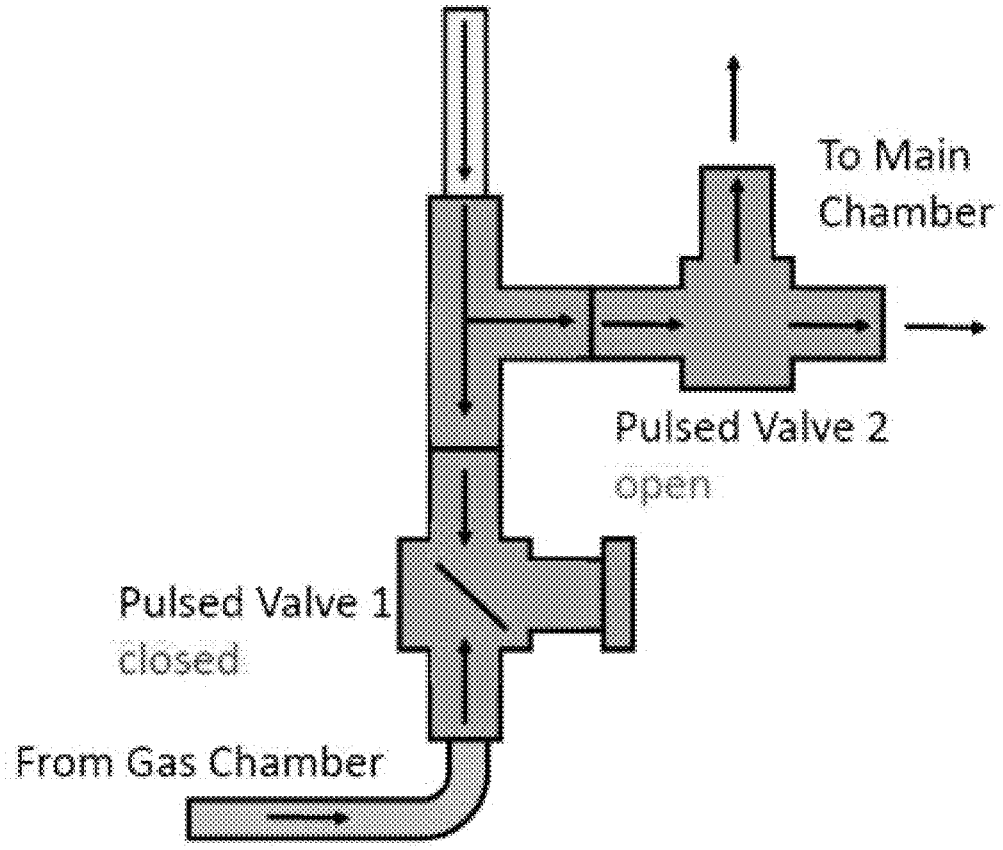
FIG. 34 shows a schematic of an arrangement of pulse valves in a gas delivery system configured to deliver gas to the cryoLIT described herein with the first valve closed and the second valve open to prevent additional gas to flow into the cryoLIT and depressurization of the ion trap.
Figure 35:
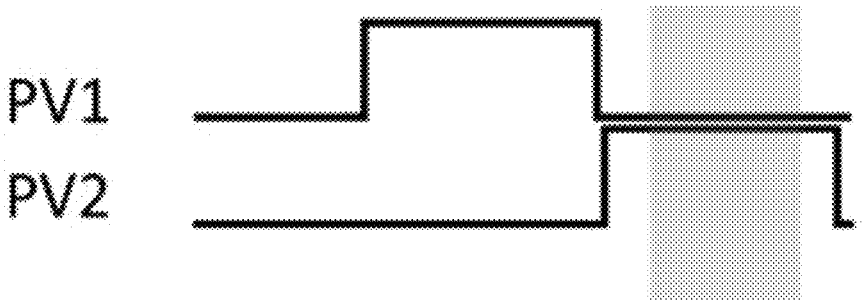
FIG. 35 shows a time trace of the pulse valves open and closed states with the shaded bar indicating the state of the system as depicted in FIG. 34.

Attention is now directed to FIGS. 29-35, which can show aspects of a pulsed valve configuration for providing gas to the cryoLIT as described herein. As shown in FIGS. 30-31, during operation, pulse valve 1 can be capped off such that gas can only escape through one orifice, while both orifices on pulse valve 2 are open. As shown in FIGS. 32-33, the first pulsed valve can then be opened, which can allow gas to flow into the ion trap. The second pulse valve can be kept closed. As shown in FIGS. 34-35, the first pulsed valve can be closed that no additional gas can enter the system while the second pulse valve can be opened, which can allow for faster depressurization of the cryoLIT due to additional escape pathways for the gas.

The cryoLIT described here can be incorporated with a mass spectrometer. In some aspects, the mass spectrometer can include more than one cryoLIT as described herein. In some aspects of operation, ions can be trapped in the trap volume of the cryoLIT described above. Mass interferences can be removed by ejecting some ions from the trap volume. The ions can be ejected via the slit in the X RF electrode. The remaining ions in the cryoLIT can be tagged by pulsing a cooled gas containing the tagging agent into the trap volume. Untagged ions can be ejected from the trap volume based on mass. The remaining ions in the trap volume, which can be tagged, can be irradiated with infrared radiation to induce photodissociation. By recording the mass spectrum after irradiation, the remaining tagged ions and the photodissociation product, namely the untagged ion, are measured. The IR spectrum of a tagged ion is measured by monitoring the photodissociation yield (i.e., loss of the tag) as a function of light source frequency. Because of the predictable mass loss of the tag, the IR spectra of multiple tagged analytes can be recorded in parallel.

EXAMPLES

Now having described the embodiments of the present disclosure, in general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

Example 1

Infrared Ion Spectroscopy Inside a Mass-Selective Cryogenic 2D Linear Ion Trap.

Introduction

Infrared (IR) ion spectroscopy combines the sensitivity and separation capabilities of mass spectrometry with the high structural information from vibrational spectroscopy. The specific information on a wide range of chemical moieties (based on diagnostic vibrations) makes IR ion spectroscopy stand out among the structural mass spectrometry techniques. For small molecule identification (e.g., metabolites, illicit drugs), where spectral congestion is limited, the technique presents a potential "game changer". Yet, despite this potential, key challenges remain to make IR ion spectroscopy a routine bioanalytical technique.[1] Currently, the most popular IR ion action spectroscopy approach, IR multiple-photon dissociation (IRMPD) spectroscopy,[2,3] has some shortcomings that are in fact related to the multiple-photon absorption scheme. Multiple-photon absorption leads to band broadening and redshifts (i.e., shifts to lower frequencies), which may obfuscate inherent, more subtle differences in the absorptions of closely related ions and structures. This also leads to distortions in the relative band intensities, making a comparison to computed IR spectra more challenging. Finally, multiple-photon absorption requires intense tunable light sources, which constrains its spectral range to the hydrogen stretching region for bench-top light sources (2000-4000 $cm^{-1}$). Measurements in the important fingerprint region (500-2000 $cm^{-1}$) require free electron lasers housed at user facilities (FELIX,[4] CLIO,[5] FHI[6]).

Infrared ion spectroscopy carried out at cryogenic temperatures overcomes some of these challenges. In IR predissociation spectroscopy[7-11], which is also referred to as vibrational predissociation spectroscopy,[8] "messenger"[7] or "tagging"[12] spectroscopy, an ion of interest forms a non-covalent complex with a weakly bound atom or molecule, a "tag", such as $H_2$,[8] Ne, or $N_2$.[13] Upon resonant absorption of a single photon, this weakly bound tag is detached, changing the mass back to the bare mass of the ion. Critically, this means that the action spectroscopy approach reverts to a single-photon and thus linear spectroscopy regime. Additionally, the bands in cryogenic IR ion spectra are generally narrower than the corresponding IRMPD spectra, due to a combination of factors. There are of course drawbacks to this method, including perturbation from the tag which may affect the IR spectrum, as well as reduced ion signal due to low tagging efficiencies.

A solvent-adducted complex presents another form of a tagged analyte ion. IR spectroscopic studies on hydrated clusters allow elucidation of solvation processes[14,15] and are therefore of great interest in fundamental studies. However, their rich OH stretch modes are a complicating factor for more analytical applications, where the purpose of the tag is mainly to facilitate photodissociation. The solvent molecule acetonitrile (ACN) considered here does not exhibit hydrogen stretching modes that would overlap with diagnostic OH and NH stretching modes. The strong dipole of ACN, however, leads to a stronger interaction energy than H2 or N2, thus potentially requiring absorption of more than 1 photon to induce photodissociation. Therefore the more generic term IR photodissociation (IRPD) was employed to denote dissociation of these solvent-tagged analytes.

Designs of cryogenic ion traps are another area that requires further developments in order to make the technique compatible with the high sensitivity requirements of biological samples. Cryogenic trap designs thus far have emphasized the capabilities of these traps to cool ions down to very low temperatures.[8,10,13,16-21] Tagged ions are then generally moved to other mass analyzers, such as a time-of-flight drift8-10 tube for mass-selective manipulation. A few studies have demonstrated mass-selective cryogenic Fourier transform ion cyclotron resonance (FTICR) traps,[15,18, 22] but no mass-selective 2D RF ion traps have been reported to date. Here, we report cryogenic IR spectroscopy inside a mass-selective 2D linear ion trap (LIT). Ions are cooled to cryogenic temperatures, mass isolated, irradiated, and mass detected in the same device. The advantages of this design with respect to operation, sensitivity, duty cycle, and other experimental considerations are discussed.

Experimental

Figure 36:
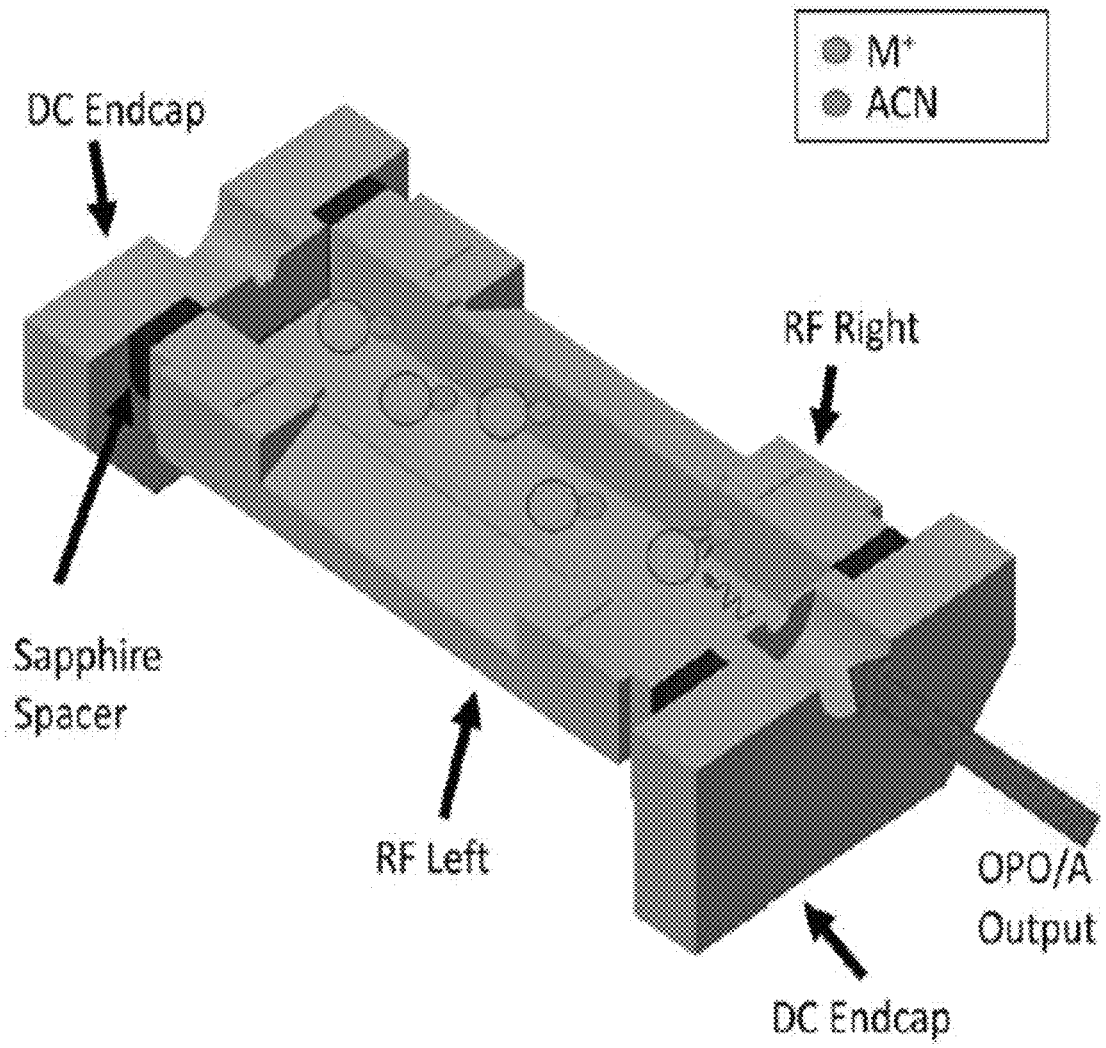
FIG. 36 shows an isometric sectional view of cryogenic 2D linear ion trap (cryoLIT). DC endcap electrodes, RF electrodes, and sapphire spacers are indicated. Resonant photon absorption from an IR light source leads to photodissociation of tagged analyte M+•ACN ions.

Mass Spectrometry. A custom mass spectrometer employed in a series of IRMPD studies has been described in detail elsewhere.[23] Briefly, the instrument can include a commercial electrospray ionization (ESI) source (Analytica of Branford, Branford, Conn.) fitted with a custom ion funnel.[24] The ions are then bent 90° by an ion deflector into a quadrupole mass filter (QMF) (Ardara Technologies, Monroeville, Pa.) for mass selection. A second ion deflector allows either detection of ions on a conversion dynode electron multiplier, or, if bent the other way, movement of the ions to a 3D quadrupole ion trap (QIT) (Jordan ToF Products, Grass Valley, Calif.). Here, the compact ion cloud is subjected to intense radiation from a tunable optical parametric oscillator/amplifier (OPO/A), followed by ejection of the photofragment ions and remaining precursor ions into the drift tube of a time-of-flight (TOF) mass analyzer (Jordan TOF Products, Grass Valley, Calif.). This instrument has now been updated with an extension to allow cryogenic IR ion spectroscopy studies. This extension is positioned off the "empty" port on the second deflector. It consists of an accumulation trap, Einzel, and steering lenses, as well as a cryogenic 2D LIT, which is mounted from a closed cycle helium cryostat. FIG. 36 depicts a cross-sectional view of this custom cryogenic 2D LIT, named cryoLIT for the purpose of this paper. The cryoLIT is composed of planar RF electrodes for radial trapping, and DC electrodes for axial trapping, and thus has some similarities in design to previously published works on non-cryogenic 2D LITs.[25,26] All electrodes are made of stainless steel, and custom sapphire spacers are employed to allow heat conduction between the electrodes and the cryostat cold finger. Sapphire is commonly employed in cryogenic traps, due to its high thermal conductivity at cryogenic temperatures, while also being a suitable electrical insulator. A heat shield (not shown) is placed around the cryoLIT to minimize black-body radiation of the electrodes and ions. The cryoLIT is driven by a commercial Velos RF power supply (Thermo-Fisher, San Jose, Calif.) operated at a drive frequency of 1.108 MHz. Trapping of externally injected ions is facilitated by a helium gas pulse using a solenoid pulsed valve (Parker Series 99, Hollis, N.H.). This gas pulse also serves the purpose of collisionally cooling ions down to cryogenic temperatures. After a pump-down delay (200-480 ms), ions of interest are mass isolated via dipolar excitation on the left/right RF electrodes with a stored waveform inverse Fourier transform (SWIFT),[27] followed by irradiation from the tunable output from the OPO/A, and mass detection via an instability scan. By applying a dipolar waveform (at 369 kHz) on the left/right RF electrodes, ions are selectively ejected through slits in those 2 electrodes to be directed to a conversion dynode/electron multiplier detector. Currently, these experiments have been conducted at a speed of 1 spectrum per second; however, by reducing the pump-down delay, it is possible to perform these experiments considerably faster. Timings of voltages in the experiments are under the control of TTL pulses, delay generators, and microcontrollers (Teensy LC, Sherwood, Oreg.), to ensure that the experimental sequence is in sync with the OPO/A output. Data acquisition is handled by a custom LabView program. Para-aminobenzoic acid (PABA) and tyramine (4-hydroxyphenethylamine) come from commercial vendors (Sigma Aldrich, St. Louis, Mo.) and are used without further purification. ESI solutions consist of analyte concentrations down to 10-7M in ACN, with 1% (vol) formic acid added to assist ionization in positive ion mode. ESI source conditions and ion transfer optics are optimized to generate abundant ion signal of the solvent-tagged analyte ions, denoted as M•ACN. Total sample consumption for a complete IR spectrum can be estimated at 60 μmol, based on infusion rates of 2 μL/min for about 300 minutes.

Infrared Spectroscopy. The tunable OPO/A (LaserVision, Bellevue, Wash.) is pumped by a Surelite III unseeded 1064 nm Nd:YAG laser (Continuum, San Jose, Calif.) producing a pump photon λpump. A detailed description of this OPO/A setup has been given previously[29] and thus here the focus is only on aspects prescient to wavelength calibration and power normalization. The OPO/A output wavelength, AOPO/A, is generated in a difference-frequency process described by the following energy conservation equation:

$$\frac{1}{\lambda_{OPO/A}} = \frac{1}{\lambda_1} - \frac{1}{\lambda_{pump}} \qquad \text{Equation (1)}$$

where $\lambda_1$ is generated in the first non-linear crystal and is tunable from 700 to 920 nm. By measuring $\lambda_1$ and, in our case, the doubled pump photon at 532 nm, $\lambda_{pump}/2$, with appropriate wavemeters (HR2000+/4000, Ocean Optics, Dunedin, Fla.), a calibrated value of AOPO/A can be derived. The central wavelength of the doubled pump is measured at 532.106 nm, which is equivalent to 18 793 $cm^{-1}$ at a full-width half-maximum (FWHM) of about 2 $cm^{-1}$, compared with a FWHM of about 7 $cm^{-1}$ for $\lambda_1$. The resolution of the wavemeters is 0.04 to 0.05 nm, which is equivalent to 0.7 to 1 cm−1, and thus the central wavenumber of the OPO/A output can be established at an accuracy of ≤1.2 cm−1. The OPO/A pulse energy is measured with energy meters suitable for various energy ranges (Models PE9-C and PE50BF-DIF-C, Ophir, North Logan, Utah). For the IR beam alignments employed here, the cryogenic IRPD experiments made use of pulse energies up to 10 mJ, which compares to pulse energies up to 25 mJ for IRMPD spectroscopy. Note that in all photodissociation experiments, the ions are irradiated with a single OPO/A pulse, even if in a trap, the ion cloud could be subjected to multiple pulses. The photodissociation yields for an analyte molecule M that are employed in IRMPD and IRPD are given by the following equations:

$$\text{yield}_{IRMPD} = -\ln\left[1 - \frac{\sum(photofragments)}{\sum(photofragments + M)}\right] \quad \text{Equation (2)}$$

$$\text{yield}_{IRPD} = -\ln\left[1 - \frac{M}{M + M\bullet ACN}\right] \quad \text{Equation (3)}$$

Somewhat confusingly, the ion signal for M is a precursor ion for IRMPD, but a photofragment for IRPD. This reflects the different methodologies employed, as tagged ions are photodissociated to the bare ion in IRPD. In all cases, the yields are normalized for OPO/A output power.

Results and Discussion

Figures 37A, 37B, 37C:
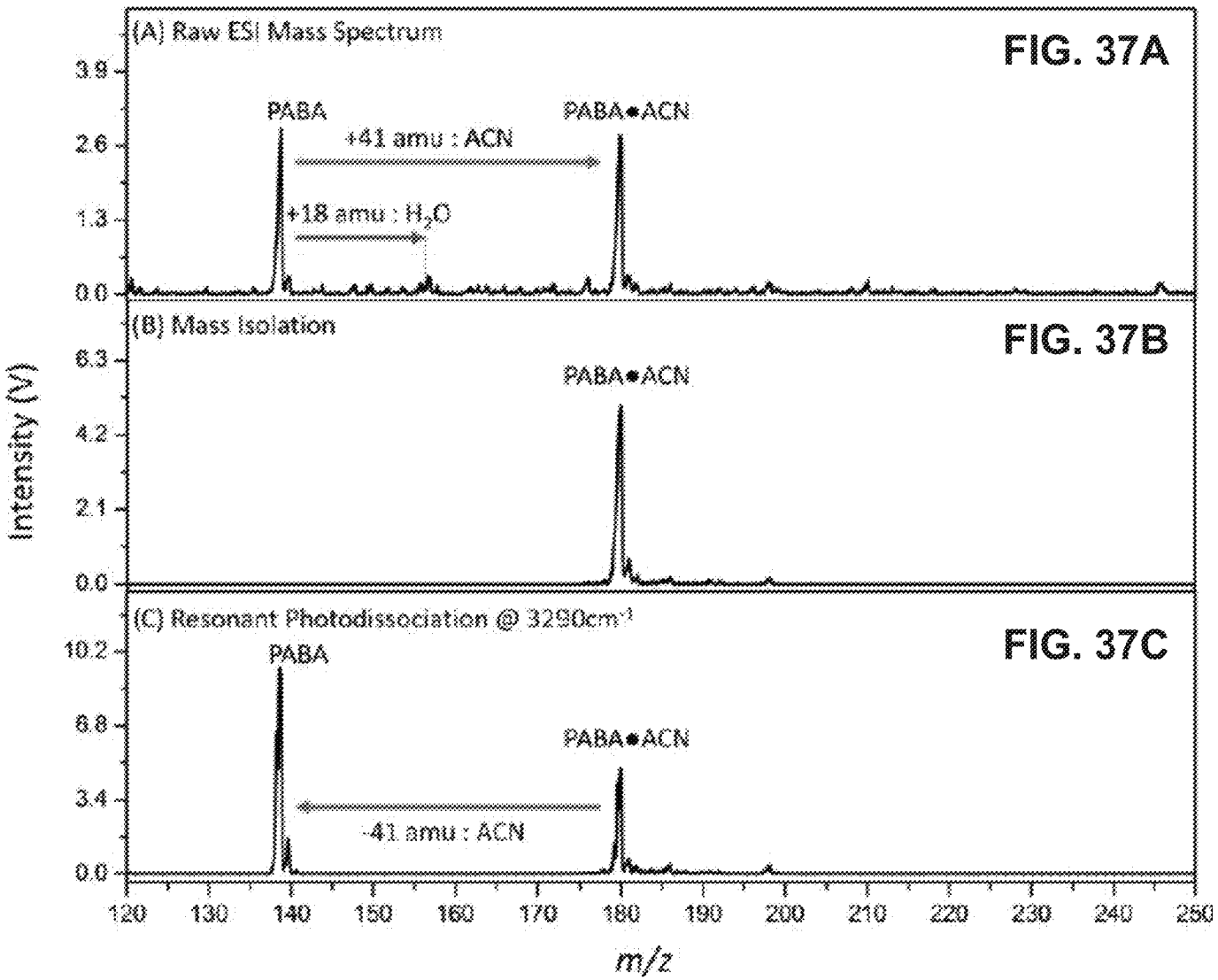
FIGS. 37A-37C Mass spectra of (FIG. 36A) electrosprayed PABA solution trapped and detected in cryoLIT, (FIG. 37B) SWIFT isolation of tagged ion PABA•ACN, and (FIG. 37C) resonant photodissociation of PABA•ACN to PABA.

Para-aminobenzoic acid. The protonation of PABA presents an intriguing case for ion structure studies.[24,30-32] When electrosprayed from protic solvents, the carboxylic acid group is the observed site of proton attachment. Conversely, when sprayed from the aprotic solvent ACN, the amino group is found to be protonated. FIGS. 37A-37C show a series of mass spectra for the PABA experiments. The raw ESI mass spectrum in FIG. 37A shows the abundant ACN adduct. It also shows a lesser abundance of the hydrated complex PABA•$H_2O$. This species was not considered here, due to its (likely) more congested IR spectrum. The PABA•CAN complex can be readily mass selected, without any trace of background dissociation to the bare PABA ion (FIG. 37B). Upon resonant absorption, abundant photodissociation to bare PABA is observed (FIG. 37C), demonstrating the action spectroscopy scheme. Note that the observation of PABA•ACN may in principle be due to incomplete desolvation, or alternatively and additionally, due to attachment of ambient ACN in the source.

An important factor to consider in tagging spectroscopy is the efficiency with which tagged ions can be generated. The efficiency with which a particular tagged state with x ACN molecules is generated, M•$ACN_x$, is defined here as:

tagging efficiency for $$M \cdot ACN_x(\%) = \frac{M \cdot ACN_x}{\sum_{i=0}^{n}(M \cdot ACN_i)} \times 100 \quad \text{(Equation 4)}$$

where the relative abundance of a particular tagged ion M•ACNx is divided by the summed abundances of all untagged (M•ACN0=M) and tagged (M•ACNi) ions up to a maximum n.

The high single tagging efficiency for PABA (e.g., 53.4%) stands out, yet there is no evidence of doubly or even more highly tagged ions (FIG. 37A). This means that the analyte ion signal is minimally diluted, resulting in enhanced sensitivity. This behavior stands in sharp contrast with cryogenic tagging approaches using for instance $H_2$, where single tagging efficiencies are rarely higher than a few percent, and where the signal can be distributed over multiple tagged species[8]

Figures 38A, 38B:
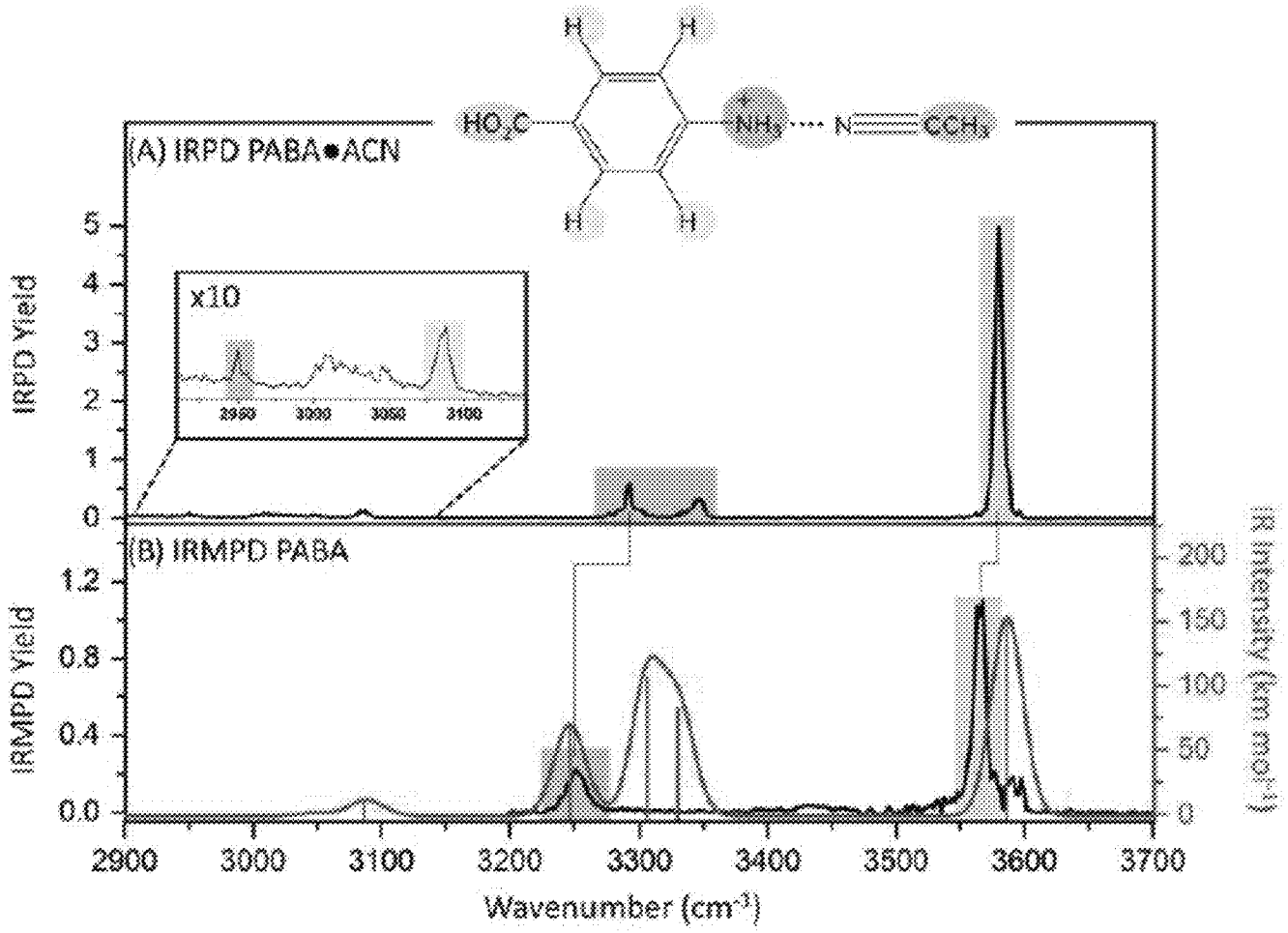
FIGS. 38A-38B show (FIG. 38A) Cryogenic IRPD spectrum of protonated PABA•ACN.
Figure 44:
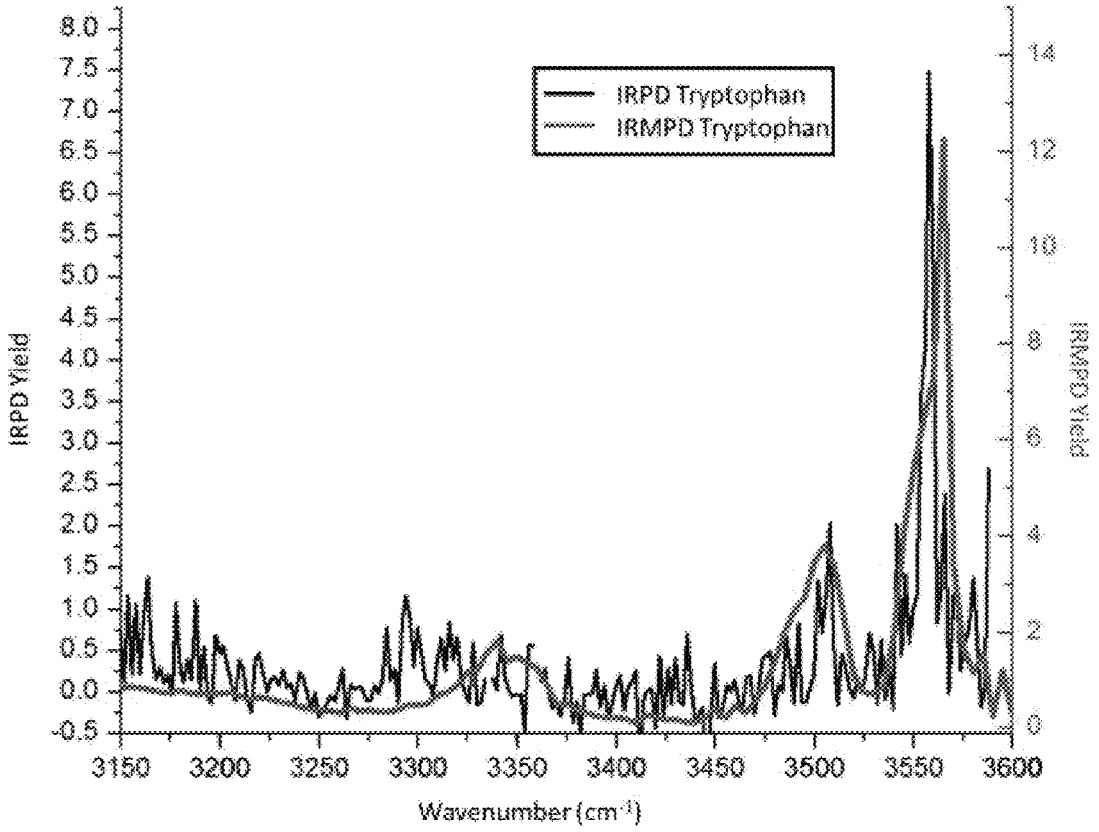
FIG. 44 shows IRPD spectrum for protonated tryptophan for spectral range 3150 $cm^{-1}$-3600 $cm^{-1}$.

FIGS. 38A-38B contrasts the cryogenic (17 K) IRPD spectrum for ACN-tagged PABA (FIG. 38A) with a previously recorded IRMPD spectrum of bare PABA (FIG. 38B),[24] both in the protonated form. It should be noted that the actual temperature of the ions is not known in these experiments. Still, tagging experiments at 25 K have shown that $N_2$ could be attached to the protonated tryptophan ions, and that a rough IRPD spectrum could be recorded in that way (see FIG. 44). FIG. 44 shows an IRPD spectrum for protonated tryptophan for spectral range 3150 $cm^{-1}$-3600 $cm^{-1}$.

The vibrational mode assignment is based on a comparison to a computed IR spectrum for bare PABA, and this is summarized in FIG. 39. Carboxylic acid OH, amino NH3+ and aromatic CH stretches can be detected for the analyte. Based on gas-phase IR absorption measurements, it known that ACN has a CH stretching mode at 2954 $cm^{-1}$,[34] which is thus assigned to the tag. Not surprisingly, the bands in the IRMPD spectrum are slightly broader, and the band positions are redshifted (e.g., observed at lower frequencies) compared with the IRPD spectrum (by 15-40 $cm^{-1}$). Even more crucially, the IRMPD spectrum shows very limited evidence for the higher-frequency $NH_3$ stretching bands. All of these observations can be rationalized by the well-documented anharmonic effects associated with multiple-photon absorption. Each photon absorbed in IRMPD causes a redshift in the vibrational frequency, and thus the mode shifts out of resonance with the laser. If it were not for band broadening effects (due to a higher density of states at higher internal energies), molecules would not be able to absorb multiple photons from a monochromatic light source. Still, for some vibrational modes, this redshift is pronounced enough to prevent the ion from reaching the dissociation threshold, and thus no photodissociation is observed.

For PABA•ACN, the relative IRPD band intensities for the NH and CH stretching bands are much suppressed compared with the OH stretching mode, in marked contrast to their relative computed IR intensities. This suggests that more than 1 IR photon needs to be absorbed to induce photodissociation, at least over some of this wavelength range. In other words, IRPD is also subject to anharmonic effects because of multiple-photon dissociation, as well as redshifting due to hydrogen bonding in the tagged complex. Nonetheless, all of the IRPD bands are observed at higher frequencies than the corresponding IRMPD bands. Even more importantly, the observation of a higher-frequency $NH_3$+ band (which is not seen in IRMPD) and even low-intensity CH stretches illustrate the sensitive detection scheme of this cryogenic tagging spectroscopy approach.

Figure 41A:
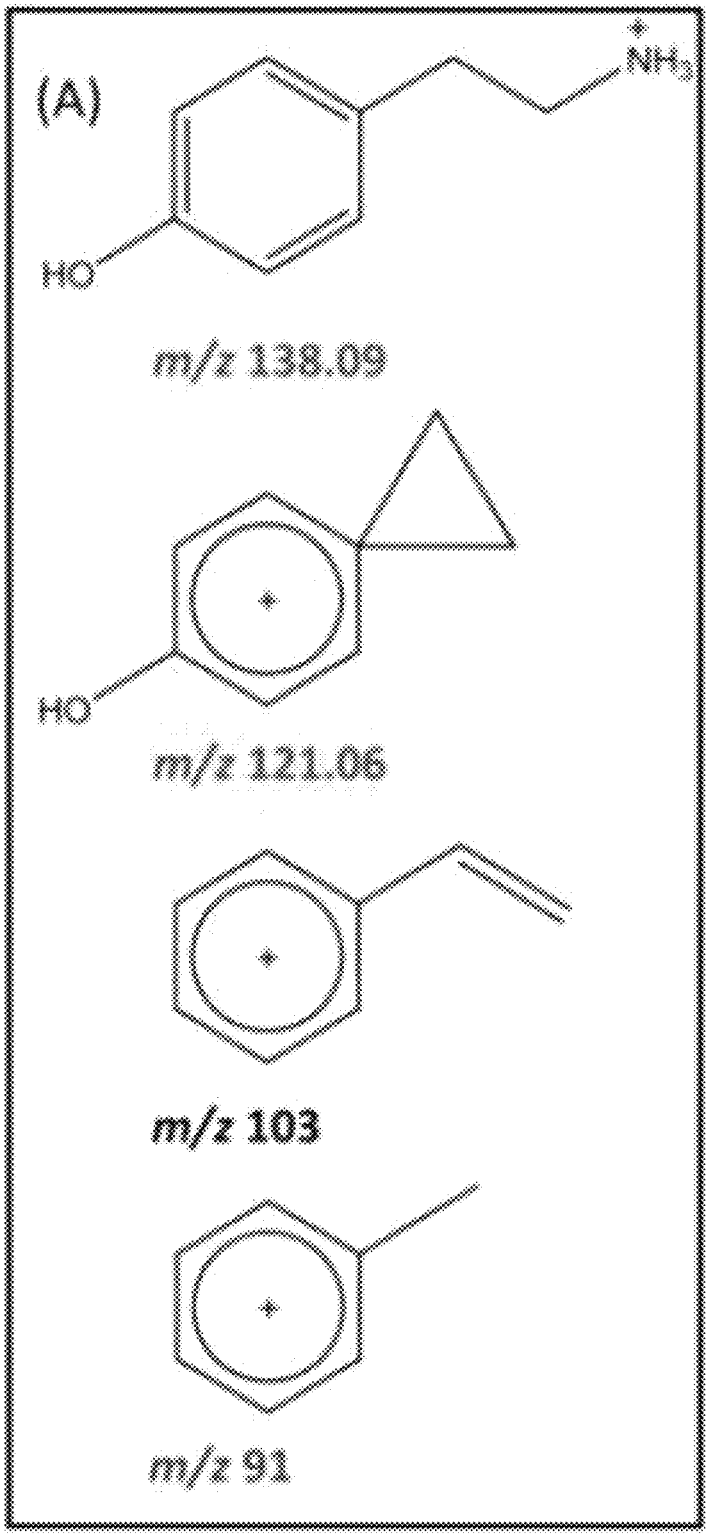
FIG. 41A shows proposed structures for protonated tyramine (m/z 138) and various CID products.

Tyramine. The very large dipole for N-protonated PABA (e.g, 13D) accounts for the stronger PABA•ACN binding energy, which may not be completely representative of ACN-tagging spectroscopy of other analytes. The molecular system tyramine and its proposed CID product ion structures are depicted in FIG. 41A. The spirocyclopropane structure for the ammonia loss m/z 121 product can be rationalized by a nucleophilic attack from the aromatic ring, meaning that the positive charge is delocalized over the aromatic ring. Similar structures were suggested in the fragmentation chemistry of protonated tryptophan, which were later confirmed based on IRMPD spectra.[36]

Figures 41B, 41C:
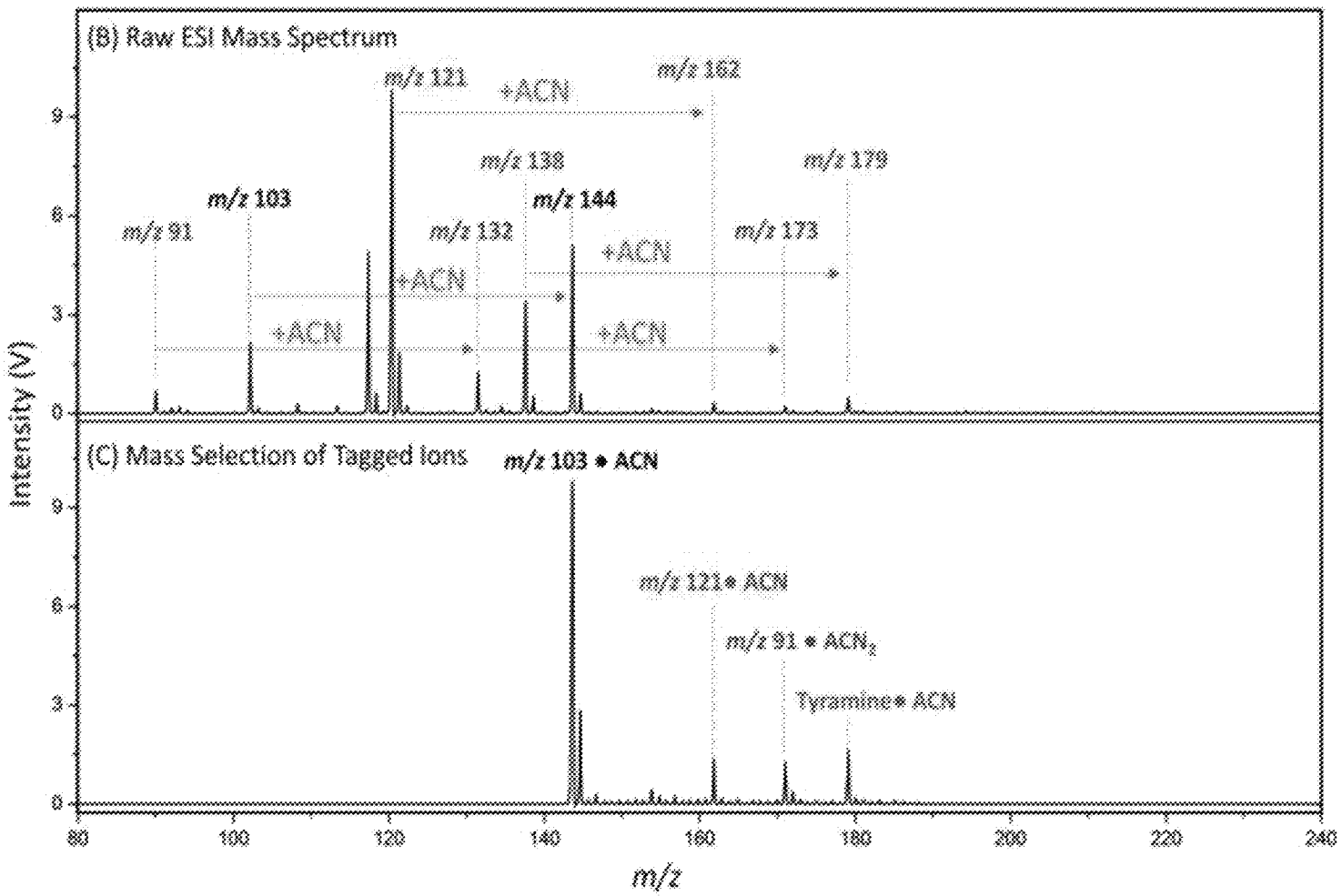
FIGS. 41B-41C shows mass spectra of (FIG. 41A) electrosprayed tyramine solution trapped and detected in cryoLIT, and (FIG. 41B) SWIFT isolation of tagged ions at m/z 144 (m/z103•ACN), 162 (m/z121•ACN), 173 (m/z91•ACN2), and 179 (m/z138•ACN=tyramine•CAN).

The raw ESI mass spectrum in FIG. 41B shows the presence of tyramine, its CID product ions, and their corresponding tagged complexes. The apparent tagging efficiencies are shown to vary quite considerably between different analyte ions, as summarized in FIG. 40. The observation of tagged CID product ions would seem to support the thesis that those tagged complexes are formed by gas-phase attachment after nozzle-skimmer dissociation. As will be shown later, this hypothesis is not correct. FIG. 41C illustrates how four discrete tagged species can be mass selected in the same experiment. As the precursor and photofragment mass channels are all independent of each other, irradiation of this mixture would in principle allow recording of the IRPD spectra of all 4 tagged ions in parallel in a multiplexed approach.

Figures 42A, 42B:
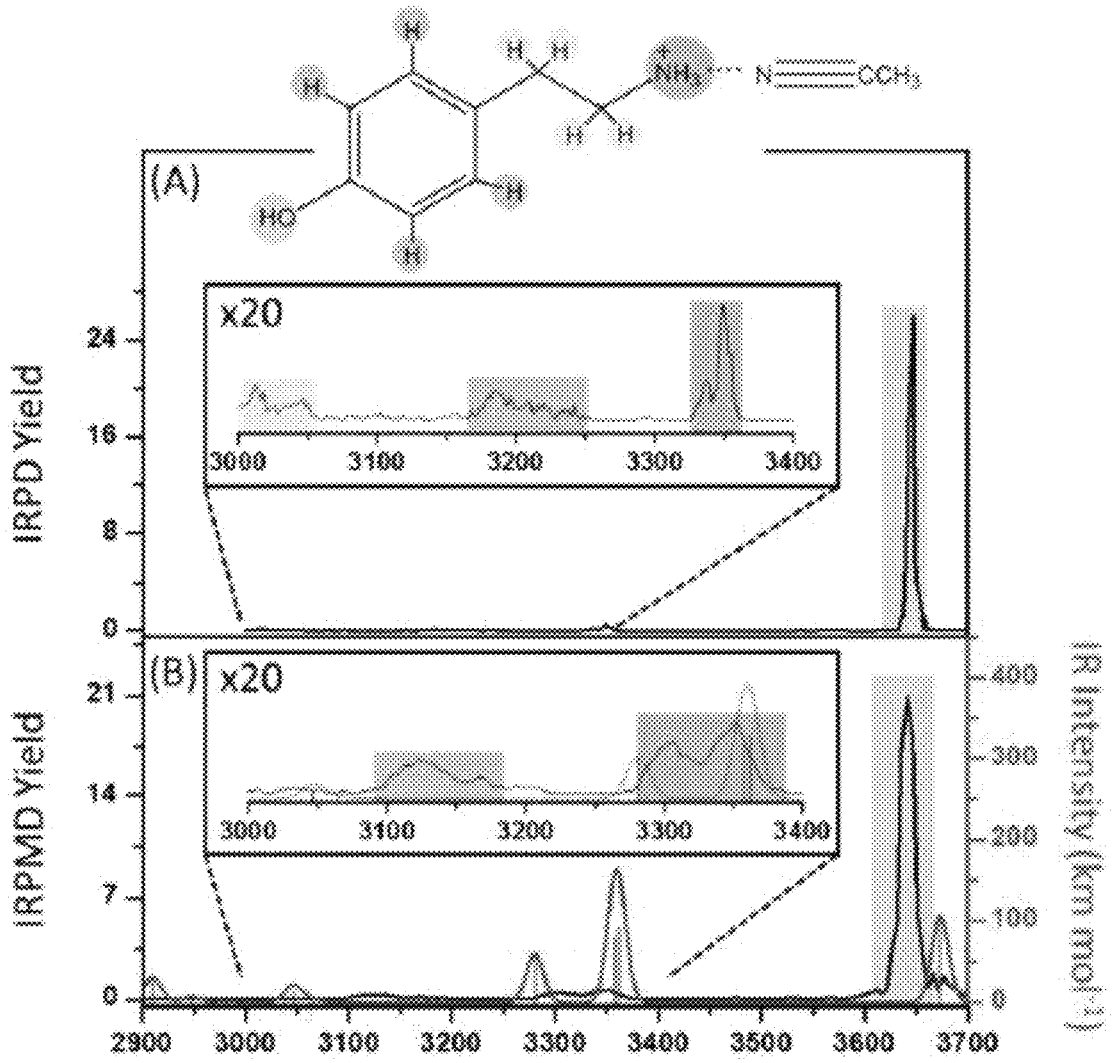
FIGS. 42A-42B show a Comparison of (FIG. 42A) IRPD spectrum of tyramine•ACN, and (FIG. 42B) IRMPD spectrum of tyramine (in black) and its DFT computed spectrum (in red).
Figure 42C:
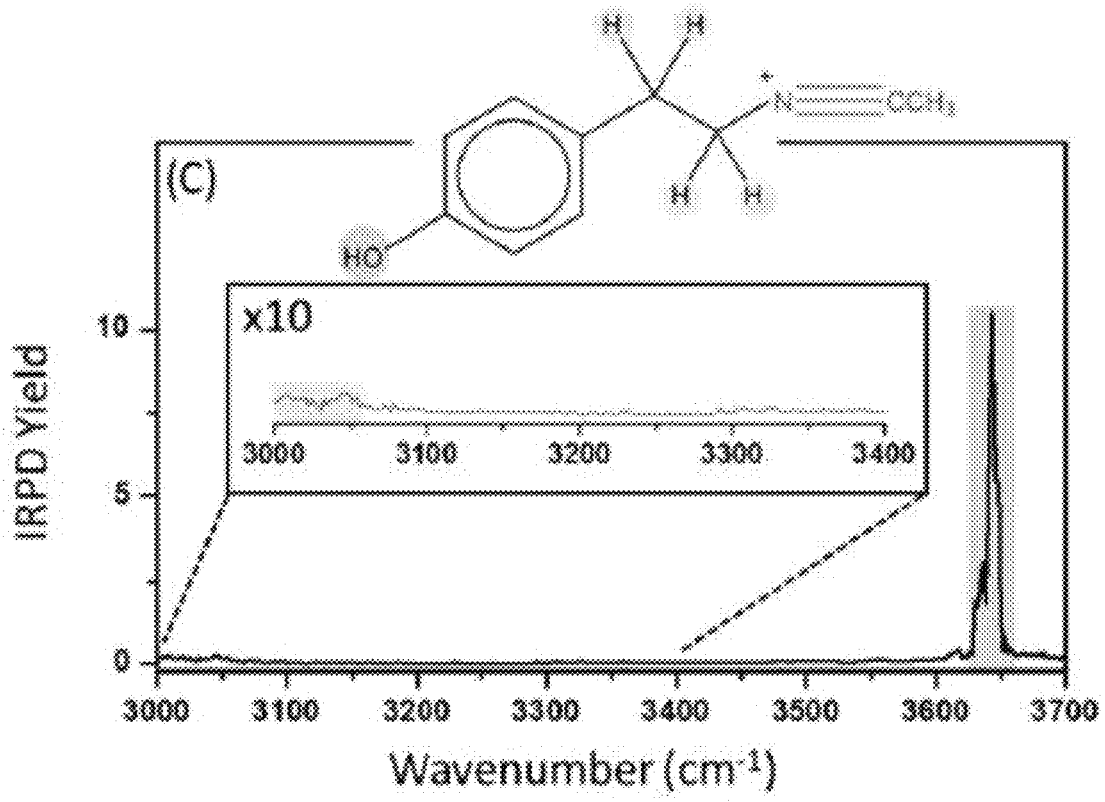
FIG. 42C shows an IRPD spectrum of tagged m/z 121 fragment, m/z121•ACN, for which a covalently tagged structure is proposed.

FIGS. 42A-42C show the IRPD spectra of tyramine•ACN (FIG. 42A) and m/ z121•ACN (FIG. 42C), as well as the IRMPD spectrum for tyramine (FIG. 42B) for comparison. Note that the IRPD spectra for m/z103•ACN and m/z91•$ACN_2$ did not yield any detectable IR photodissociation (not shown). This indicates that those molecular ions are strongly bound to the ACN molecules, possibly forming a covalent complex. Such a hypothesis would also rationalize the unusually high apparent tagging efficiencies for m/z103•ACN and m/z91•$ACN_2$ FIG. 40.

Figure 46A:
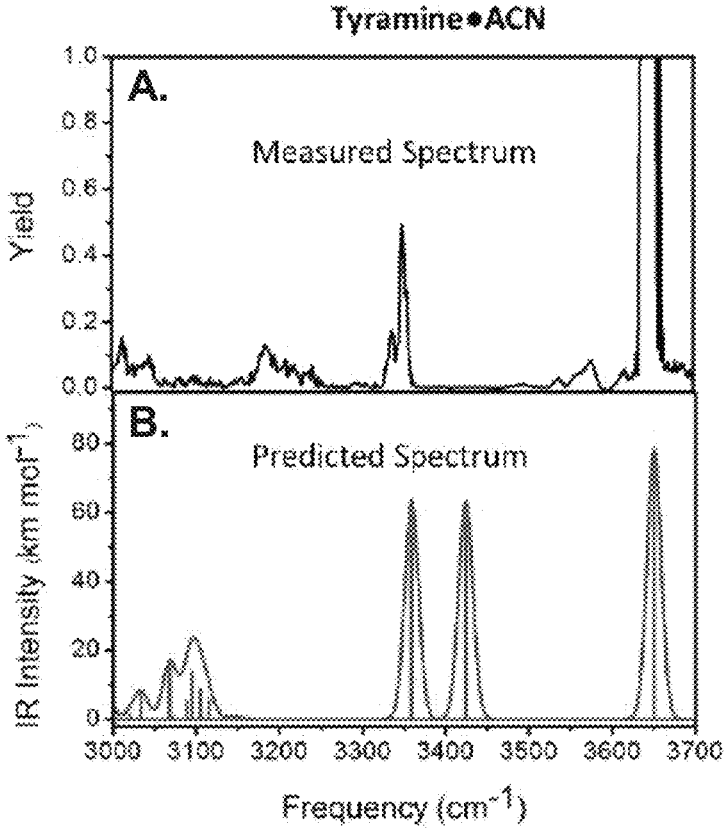
FIGS. 46A-46B shows a comparison of the measured IRPD spectrum (FIG. 46A) for tyramine●ACN to DFT computations (B3LYP/6-31G(d), 0.976 scaling factor) (FIG. 46B).
Figure 46B:
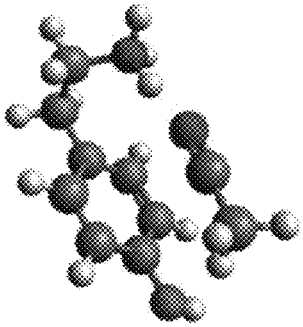
Figures 47A, 47B, 47C:
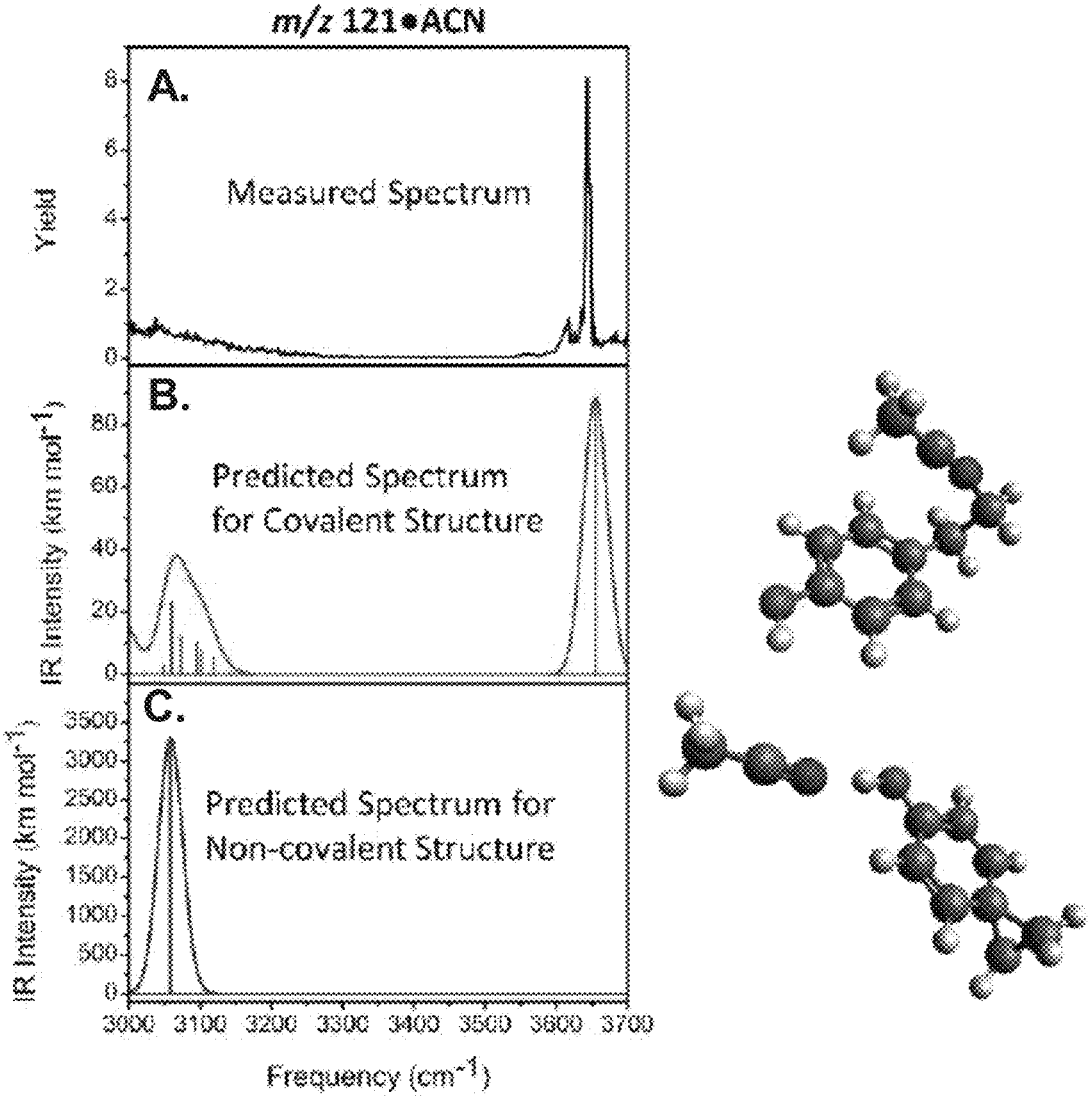
FIGS. 47A-47C shows a comparison of the measured IRPD spectrum for m/z121●ACN to DFT-computed structures shows that only the covalent structure correctly predicts the phenol OH stretch ~3650 $cm^{-1}$ (middle spectrum), whereas this band is considerably redshifted (to 3050 $cm^{-1}$) for the non-covalent structure (bottom spectrum).

FIGS. 46A-46B and FIGS. 47A-47C show the interpretation of IRPD spectra fortyramine•CAN m/z121•CAN. FIGS. 46A-46C show a comparison of the measured IRPD spectrum for tyramine●ACN to DFT computations (B3LYP/6-31G(d), 0.976 scaling factor) shows that the phenol OH stretch is confirmed at about 3650 $cm^{-1}$. Only two $NH_3$+ stretching modes are predicted (at 3350 and 3420 $cm^{-1}$), as also corroborated in the experiment. The third $NH_3$+ stretching mode is redshifted due to hydrogen bonding with the ACN tag (to 2822 $cm^{-1}$). FIGS. 47A-47C show a comparison of the measured IRPD spectrum (top spectrum) for m/z121●ACN to DFT-computed structures shows that only the covalent structure correctly predicts the phenol OH stretch about 3650 cm−1 (middle spectrum), whereas this band is considerably redshifted (to 3050 $cm^{-1}$) for the non-covalent structure (bottom spectrum).

A number of modes can be distinguished in FIGS. 42A-42C, including the phenol OH stretch, as well as various NH and CH stretches. The band assignments and positions are summarized in FIG. 43. The band positions for m/z121•ACN are not compatible with a con-covalent complex. The phenol OH stretch is only very slightly redshifted for m/z121•ACN compared with tyramine•ACN. This is unexpected, as the ACN in m/z121•ACN would almost certainly have to bind to the phenol OH, in the process significantly redshifting the phenol OH stretch.

Figure 45:
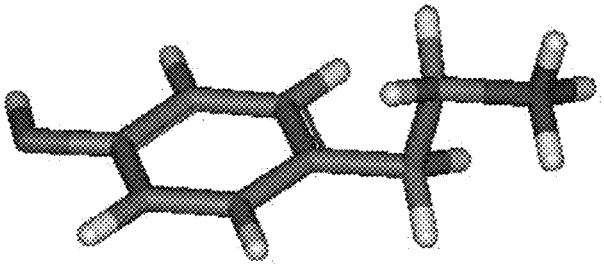
FIG. 45 shows the computed protonated tyramine lowest energy structure using B3LYP/cc-pVTZ. The ZPE-Corrected energy is −411.785166 Hartrees and the electronic energy is −441.97827 Hartrees.

Tentatively, a covalent structure is proposed for m/z121•CAN. The lowest-energy structure of protonated tyramine is shown in FIG. 45. The comparisons between the tyramine•ACN IRPD and tyramine IRMPD spectra are again telling, as modes are sometimes redshifted substantially in the IRMPD spectra (eg, 65 $cm^{-1}$ for aromatic CH stretches), but sometimes only marginally redshifted (e.g., 4 $cm^{-1}$ for phenol OH stretch). This once again underlines the dynamic nature of redshifting in IRMPD due to anharmonic effects.

Summary

In this example it is shown that IR ion spectroscopy on tagged ions can be carried out inside a mass-selective cryogenic 2D LIT. This approach presents a number of advantages in terms of carrying out IR photodissociation experiments, including, but not limited to, (1) The instrument is compact, requiring no mass analyzer after the cryogenic trap, (2) Tagging efficiency is found to be relatively high for singly ACN-tagged ions, which minimizes ion signal dilution, and thus maximizes sensitivity, (3) Several tagged ions can be mass isolated together, thus allowing a multiplexed approach, where the IR spectra of multiple tagged analyte ions are recorded in parallel. This increases the duty cycle of IR ion spectroscopy, where normally only 1 analyte ion is probed at 1 wavelength at any one time, and (4) Photodissociation efficiency is high even at lower pulse energies, which suggests a good overlap between the OPO/A beam and the ion cloud.

As has been shown in many studies, cryogenic temperatures are essential in order to achieve higher spectral resolution. In future studies, we will demonstrate the effect of the trap temperature on how well bands can be separated. Operating a 2D LIT at cryogenic temperatures does not diminish its performance as a mass spectrometer, even if the trap does need to be warmed up periodically to prevent icing, and thus build-up of charges. OPO/As remain the state-of-the-art technology for tunable IR output from 2000 to 4000 $cm^{-1}$. By use of down-conversion crystals, the important fingerprint region (800-2000 $cm^{-1}$) can also be accessed. The sensitivity limit of a 2D LIT is excellent, making it in principle a powerful tool in IR action spectroscopy; the lower concentrations studied here (e.g., $10^{-7}$M) are certainly biologically relevant. The key improvement in terms of sample consumption now lies in a faster duty of the experiment, ideally matching the 10 Hz of the OPO/A. The greatest potential for cryogenic IR ion spectroscopy is probably in the realm of small molecule identification, as discussed in some detail in a critical insight article.[1] It remains to be seen how useful solvent tagging would be in terms of identifying unknown analytes. The interactions of the sol-vent with the analyte can shift vibrational modes, and the solvent has IR-active modes of its own that may obfuscate interpretation. For the analytes and tag considered here, the binding energies likely exceed a single photon, thus making the IRPD yield non-linear with power. Tagging with more weakly bound atoms or molecules, which have no or fewer IR-active modes, would overcome this problem. Preliminary experiments have shown that in-trap $N_2$-tagging is possible, but challenges remain to make the ion signal more stable. A constraint in the current design is the rather lengthy pump-down delay, which does not make use of the 10-Hz repetition rate of the OPO/A. Improved designs for pulsed gas injection could address this issue. Despite these challenges, the development of a mass-selective cryogenic LIT is an important first step for making cryogenic IR ion spectroscopy a more routine bioanalytical tool for low-abundance biological samples.

REFERENCES FOR EXAMPLE 1

1. Cismesia A P, Bailey L S, Bell M R, Tesler L F, Polfer N C. Making mass spectrometry see the light: the promises and challenges of cryogenic infrared ion spectroscopy as a bioanalytical technique. J Am Soc Mass Spectrom. 2016; 27:757-766.
2. Oomens J, Sartakov B G, Meijer G, von Heiden G. Gas-phase infrared multiple photon dissociation spectroscopy of mass-selected molecular ions. Int J Mass Spectrom. 2006; 254:1-19.
3. Polfer N C. Infrared multiple photon dissociation spectroscopy of trapped ions. Chem Soc Rev, The Royal Society of Chemistry. 2011; 40:2211-2221.
4. Oepts D, van der Meer A F G, van Amersfoort P W. The free-electron-laser user facility FELIX. Infrared Phys Technol. 1995; 36:297-308.

5. Lemaire J, Boissel P, Heninger M, et al. Gas phase infrared spectroscopy of selectively prepared ions. Phys Rev Lett, American Physical Society. 2002; 89:273002.
6. Schöllkopf W, Gewinner S, Junkes H, Paarmann A, von Helden G, Bluem H, Todd A M M. The new IR and THz FEL facility at the Fritz Haber Institute in Berlin. 2015; Vol. 9512, pp 95121L-95121L-13.
7. Okumura M, Yeh L I, Myers J D, Lee Y T. Infrared spectra of the cluster ions H7O+3.H2 and H9O+4.H2. J Chem Phys. 1986; 85:2328-2329.
8. Kamrath M Z, Relph R A, Guasco T L, Leavitt C M, Johnson M A. Vibrational predissociation spectroscopy of the H2-tagged mono- and dicarboxylate anions of dodecanedioic acid. Int J Mass Spectrom. 2011; 300:91-98.
9. Thompson M C, Ramsay J, Weber J M. Solvent-driven reductive activation of CO2 by bismuth: switching from metalloformate complexes to oxalate products. Angew Chem Int Ed. 2016; 55:15171-15174.
10. Duffy E M, Marsh B M, Voss J M, Garand E. Characterization of the oxygen binding motif in a ruthenium water oxidation catalyst by vibrational spectroscopy. Angew Chem Int Ed. 2016; 55:4079-4082.
11. Masson A, Kamrath M Z, Perez M A S, et al. Infrared spectroscopy of mobility-selected H+-Gly-pro-Gly-Gly (GPGG). J Am Soc Mass Spectrom. 2015; 26:1444-1454.
12. Goebbert D J, Wende T, Bergmann R, Meijer G, Asmis K R. Messenger-tagging electrosprayed ions: vibrational spectroscopy of suberatedianions. Chem A Eur J, American Chemical Society. 2009; 113:5874-5880.
13. Jašik J, Roithová J. Infrared spectroscopy of CHCl2+ molecular dications. Int J Mass Spectrom. 2015; 377:109-115.
14. Power B, Haldys V, Salpin J-Y, Fridgen T D. Structures of [M(Ura-H) (H2O)n]+(M=Mg, Ca, Sr, Ba; n=1-3) complexes in the gas phase by IRMPD spectroscopy and theoretical studies. J Mass Spectrom. 2016; 51:236-244.
15. Chang T M, Prell J S, Warrick E R, Williams E R. Where's the charge? Protonation sites in gaseous ions change with hydration. J Am Chem Soc, American Chemical Society. 2012; 134:15805-15813.
16. Ishiuchi S-i, Wako H, Kato D, Fujii M. High-cooling-efficiency cryogenic quadrupole ion trap and UV-UV hole burning spectroscopy of proton- ated tyrosine. J Mol Spectrosc. 2017; 332:45-51.
17. Burke N L, Redwine J G, Dean J C, McLuckey S A, Zwier T S. UV and IR spectroscopy of cold protonated leucine enkephalin. Int J Mass Spectrom. 2015; 378:196-205.
18. Mohrbach J, Lang J, Dillinger S, Prosenc M, Braunstein P, Niedner-Schatteburg G. Vibrational fingerprints of a tetranuclear cobalt carbonyl cluster within a cryo tandem ion trap. J Mol Spectrosc. 2017; 332:103-108.
19. Heine N, Asmis K R. Cryogenic ion trap vibrational spectroscopy of hydrogen-bonded clusters relevant to atmospheric chemistry. Int Rev Phys Chem, Taylor & Francis. 2015; 34:1-34.
20. Gunther A, Nieto P, Müller D, Sheldrick A, Gerlich D, Dopfer O. BerlinTrap: A new cryogenic 22-pole ion trap spectrometer. J Mol Spectrosc. 2017; 332:8-15.
21. Fanghänel S, Asvany O, Schlemmer S. Optimization of RF multipole ion trap geometries. J Mol Spectrosc. 2017; 332:124-133.
22. Chang T M, Chakrabarty S, Williams E R. Hydration of gaseous m-aminobenzoic acid: ionic vs neutral hydrogen bonding and water bridges. J Am Chem Soc, American Chemical Society. 2014; 136:10440-10449.
23. Gulyuz K, Stedwell C N, Wang D, Polfer N C. Hybrid quadrupole mass filter/quadrupole ion trap/time-of-flight-mass spectrometer for infra-red multiple photon dissociation spectroscopy of mass-selected ions. Rev Sci Instrum. 2011; 82:054101
24. Patrick A L, Cismesia A P, Tesler L F, Polfer N C. Effects of ESI conditions on kinetic trapping of the solution-phase protonation isomer of p-aminobenzoic acid in the gas phase. Int J Mass Spectrom. 2017; 418:148-155.
25. Ouyang Z, Wu G, Song Y, Li H, Plass W R, Cooks R G. Rectilinear ion trap: concepts, calculations, and analytical performance of a new mass analyzer. Anal Chem, American Chemical Society. 2004; 76:4595-4605.
26. Wang L, Xu F, Dai X, Fang X, Ding C-F. Development and investigation of a mesh-electrode linear ion trap (ME-LIT) mass analyzer. J Am Soc Mass Spectrom, Springer US. 2014; 25:548-555.
27. Guan S, Marshall A G. Stored waveform inverse Fourier transform axial excitation/ejection for quadrupole ion trap mass spectrometry. Anal Chem, American Chemical Society. 1993; 65:1288-1294.
28. Cismesia A P, Bell M R, Tesler L F, Bailey L S, Polfer N C. A mass-selective cryogenic 2D linear ion trap for infrared ion spectroscopy. in preparation.
29. Bosenberg W R, Guyer D R. Broadly tunable, single-frequency optical parametric frequency-conversion system. J Opt Soc Am B, OSA. 1993; 10:1716-1722.
30. Schmidt J, Meyer M M, Spector I, Kass S R. Infrared multiphoton dissociation spectroscopy study of protonated p-aminobenzoic acid: does electrospray ionization afford the amino- or carboxy-protonated ion? Chem A Eur J, American Chemical Society. 2011; 115:7625-7632.
31. Campbell J L, Le Blanc J C Y, Schneider B B. Probing electrospray ionization dynamics using differential mobility spectrometry: the curious case of 4-aminobenzoic acid. Anal Chem, American Chemical Society. 2012; 84:7857-7864.
32. Seo J, Warnke S, Gewinner S, et al. The impact of environment and resonance effects on the site of protonation of aminobenzoic acid derivatives. Phys Chem Chem Phys, The Royal Society of Chemistry. 2016; 18:25474-25482.
33. Lanucara F, Chiavarino B, Scuderi D, Maitre P, Fornarini S, Crestoni M E. Kinetic control in the CID-induced elimination of H3PO4 from phosphorylated serine probed using IRMPD spectroscopy. Chem Commun, The Royal Society of Chemistry. 2014; 50:3845-3848.
34. NIST Chemistry WebBook. In: Linstrom P J, Mallard W G, ed. NIST Standard Reference Database Number 69. Gaithersburg Md.: National Institute of Standards and Technology, 20899.
35. Lioe H, O0 Hair R A J, Reid G E. Gas-phase reactions of protonated tryptophan. J Am Soc Mass Spectrom. 2004; 15:65-76.
36. Mino W K, Gulyuz K, Wang D, Stedwell C N, Polfer N C. Gas-phase structure and dissociation chemistry of protonated tryptophan elucidated by infrared multiple-photon dissociation spectroscopy. J Phys Chem Lett, American Chemical Society. 2011; 2:299-304.

Example 2

Introduction. Metabolomics involves the study of small molecules (metabolites) that are products or bi-products of cellular processes.[1] Such studies range from the screening of endogenous and exogenous metabolites in humans, to the study of primary and secondary metabolites in plants.[2-4]

Many of these processes reveal unknown metabolites, in which multiple techniques have been employed for identification and characterization, the most common of which are nuclear magnetic resonance (NMR) and liquid chromatography tandem mass spectrometry (LC-MS/MS).5 Both techniques have strengths and weaknesses: NMR is the gold standard in terms of molecular identification, but low sensitivity makes it difficult to probe low-abundance features in biological samples; conversely, LC-MS/MS has excellent sensitivity, but the identification is generally limited to previously cataloged MS/MS spectra in databases.[6,7]

A key constraint of traditional mass spectrometry approaches is the limited detailed structural information (e.g. 3D structure, positional isomers, bond chirality, etc.) from these measurements. This, however, can be overcome in more advanced methodologies that provide more structural information on the ions, notably ion mobility mass spectrometry and ion spectroscopy. Vibrational spectroscopy in particular provides ample structural information on the chemical structures of analytes.

Due to the low number densities of ions in a mass spectrometer, direct absorption is a very challenging experiment. Conversely, action, or consequence, spectroscopy techniques allow the infrared spectra of ions within a mass spectrometer to be measured readily. Such techniques rely on the measurement of parameters other than direct absorption, such as the appearance of fragment ions, which effectively involves a change in mass-to-charge. Infrared multiple photon dissociation (IRMPD) spectroscopy is an action spectroscopy scheme that relies on the resonant absorption of multiple photons to induce cleavages of covalent bonds.8,9 As with traditional vibrational spectroscopy, the absorption of photons is dependent on the molecular structures of the ion. When an ion absorbs a photon, the energy is distributed throughout the ion by a process called intramolecular vibrational redistribution (IVR). Each time the ion absorbs a photon, the ion's internal energy increases. Eventually, the dissociation threshold is reached, where the ion fragments, a response detected by the mass spectrometer. IRMPD spectra generally exhibit broad vibrational bands, which are the result of the methodology that is employed. As room-temperature ions are photodissociated, an ensemble of dynamic structures are probed. In addition, the multiple-photon nature of the process further broadens vibrational features, due to anharmonic redshifting and broadening effects. The limited spectral resolution of IRMPD spectroscopy may constrain the usefulness of the technique in distinguishing closely-related analytes, notably isomers.

Infrared photodissociation (IRPD) spectroscopy at cryogenic temperatures typically offers enhanced resolution compared to IRMPD spectroscopy at room temperature. At cryogenic temperatures (e.g., 10-50 K), the molecular structures are less dynamic, and a smaller subset of more defined structures may be generated, resulting in narrower absorption spectra. Moreover, depending on the spectroscopic scheme, the cryogenic experiments are often carried out in a single-photon regime, and are thus not subject to anharmonic broadening effects. In infrared predissociation spectroscopy,[10-12] which is also known as the messenger[13] technique or tagging[14] spectroscopy, an inert gas molecule that is generally transparent to IR light, such as molecular $N_2$ [15] or $H_2$ [10] condenses onto the collisionally cooled ions, leading to a change in the mass-to-charge ratio of the precursor complex (e.g. +28 m/z for $N_2$ tag). A tunable IR light source is then scanned, and upon resonant absorption of a single photon, the tag is detached from the tagged complex. The single-photon nature of this process makes the technique a linear spectroscopy method, and thus facilitates comparison to computed absorption spectra of putative structures from quantum-chemical approaches. Moreover, the loss of the tag is the same for all analytes, and is thus completely predictable in mass, in contrast to IRMPD of the analyte ion. The advantage for tagging spectroscopy is that in principle multiple ions can be tagged and probed by IR spec troscopy simultaneously (if their masses do not overlap).[16,17]

Recent studies have illustrated the power of IR and IR-UV ion spectroscopy as bioanalytical tools for small molecule analysis.[18-25] Moreover, at least for cryogenic single-photon spectroscopy, benchtop light sources can now cover the entire 600-4000 $cm^{-1}$ range for spectroscopic interrogation.

Nonetheless, many improvements in instrumentation and methodology are required to make the technique truly analytically viable[16] Key parameters that need to be addressed are sensitivity and duty cycle of the experiment. We have recently shown the operation of the first mass-selective cryogenic linear ion trap for the purpose of recording cryogenic infrared spectra of analytes.[17]

This trap is compatible with low concentration analytes, as well as the ability to multiplex the infrared ion spectroscopy experiment. The setup is implemented here to provide a proof-of-principle demonstration for the potential of infrared ion spectroscopy, and in particular cryogenic infrared spectroscopy, in the differentiation of isobaric and isomeric metabolites.

Experimental Methods.

Sample preparation. All compounds were purchased from Sigma Aldrich (St Louis, Mo.). The samples for IRMPD spectroscopy were diluted to concentrations of $10^{-5}$ to $10^{-6}$ M using 70:29:1 MeOH:$H_2O$:HCOOH The samples for IRPD spectroscopy were diluted to $10^{-5}$-$10^{-7}$ M using 99:1 acetonitrile (ACN):HCOOH except for tryptophan which was diluted to $10^{-5}$ M using 70:29:1 MeOH:$H_2O$:HCOOH. Prior to being loaded into the syringe, the samples were centrifuged for 5 min at 3000 rpms to remove any fine particles.

Mass Spectrometry Instrumentation and Operation.

The IRMPD spectra were recorded on a previously described custom quadrupole mass filter-quadrupole ion trap-time of flight (QMF-QIT-ToF) mass spectrometer.[26] Ions were generated in an electrospray ionization (ESI) source (Analytica, Branford, Conn.) equipped with a heated metal capillary to aid desolvation, and an rf ion funnel to increase ion transmission. Ions were first accumulated in a hexapole and then pulsed through an ion bender, where the packet was deflected 90° into a QMF for mass selection. The ion packet was then deflected 90° by a second ion bender, through an RF guide and then trapped by a QIT equipped with a pulse valve for gas-assisted trapping. Due to the slightly harsher nature of trapping in a QIT, the ion may fragment via collisions with the pulsed helium buffer gas. In order to provide a background free experiment, the RF on the ring electrode was ramped up, ejecting the low mass fragments. After a pump down delay (100 ms), the ions were irradiated with the tunable output from an optical parametric oscillator/amplifier (OPO/A) (LaserVision, Bellevue, Wash.) pumped by a Surelite III, unseeded 1064 nm Nd AG laser (Continuum, San Jose Calif.) to induce IRMPD. A shutter, controlled by a delay generator (Stanford Research Systems, Sunnyvale, Calif.), allowed a single pulse from the OPO/A to irradiate the ions. The remaining precursor and photofragment ions were then pulsed into a time-of-flight for mass analysis.

For the IRPD experiments, the ions were generated in the same ion source described above, but were directed to a custom extension equipped with a cryogenic linear ion trap (cryoLIT), as described in a recent publication.[17] For solvent- tagged ions, care was taken to make the source conditions gentle in order to maximize ion signal on solvent-tagged ions (e.g. acetonitrile—ACN). These solvent-tagged ions were generated using a relatively cool ESI source (e.g., metal capillary at 100° C.). The hexapole was now operated as an ion guide, and at the second ion bender (after the QMF), the ions passed straight to an accumulation trap. The accumulated ions were then pulsed through a series of Einzel lenses for focusing and into the cryoLIT, where they were collisionally cooled to cryogenic temperatures (and tagged in the case of $N_2$-tagged protonated tryptophan). The tagged ions were mass isolated using a stored waveform inverse Fourier transform (SWIFT)[27] waveform generated via an arbitrary waveform generator. Lastly, the tagged ions were irradiated with an OPO pulse at a particular wavelength, and were radially ejected to a conversion dynode-electron multiplier for detection. This experiment was repeated at different OPO wavelengths. All data acquisition was under control of a custom LabView™ software.

Infrared Action Spectroscopy.

Figure 48:
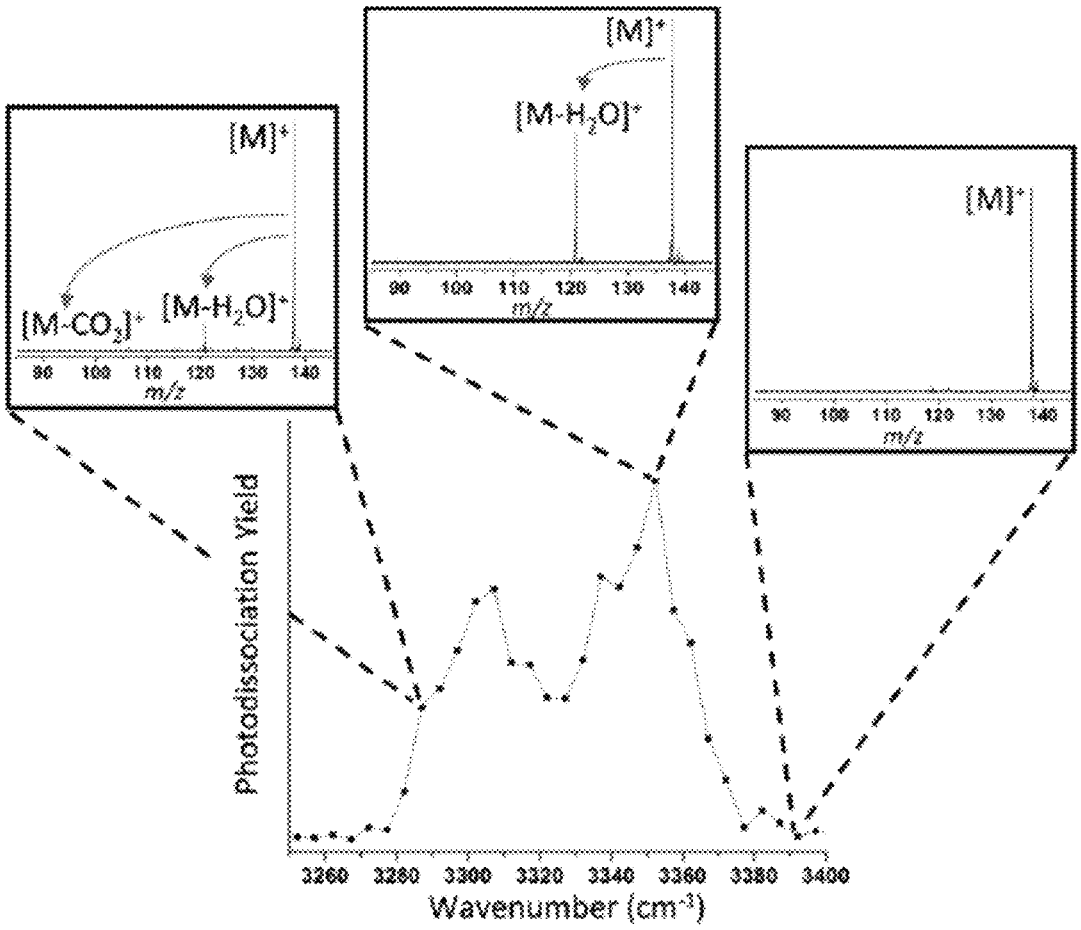
FIG. 48 shows a comparison of IR "action" spectra for protonated tyramine (Top) IRMPD.
Figure 49:
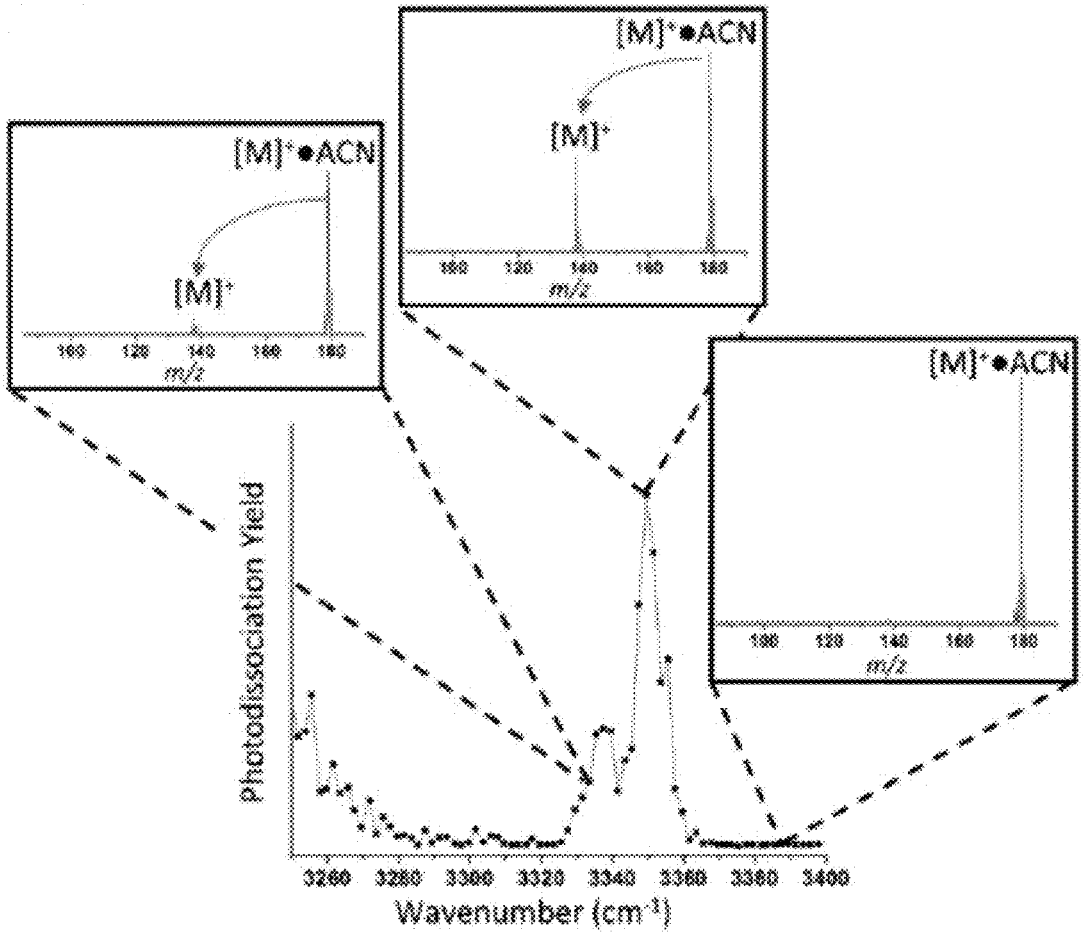
FIG. 49 shows IRPD for tyramine•ACN. Insets show raw mass spectra at several irradiation frequencies.

FIGS. 48-49 can illustrate how IRMPD and IRPD spectroscopy are implemented with mass spectrometry for the example of protonated tyramine. FIG. 48 depicts the IRMPD spectrum of 4-hydroxyphenylacetaldehyde (tyramine) with the raw mass spectra from the ToF for three specific points on the spectra. At some IR frequencies, no photodissociation is observed (e.g. 3390 $cm^{-1}$), whereas at other frequencies (e.g. 3350 $cm^{-1}$) extensive dissociation is seen. The basic premise upon which IRMPD spectroscopy rests is that the ion absorbs multiple photons at a specific frequency due to resonant absorption from a vibrational mode, causing cleavage of covalent bonds (e.g. loss of $H_2O$ and CO2 here). The IRMPD spectrum is obtained by plotting the photodissociation yield as a function of the light source frequency. As the photodissociation yield is a measure of the number of photons that are absorbed, the IRMPD spectrum is an indirect measure of the absorption spectrum of the ion, even if the non-linear nature of multiple-photon absorption can complicate this analysis.

FIG. 49 depicts the IRPD spectrum of the same analyte tagged with acetonitrile (ACN). Upon resonant absorption, the tag, in this case ACN, is knocked off, causing the mass of the bare molecular ion to appear. Once again, there is a strong wavelength dependence in terms of photodissociation yield, and the IRPD spectrum is an indirect measure of the absorption spectrum of the tagged analyte ion. Both IRMPD and IRPD spectroscopy have the advantage of a background-free photodissociation scheme, which is advantageous when there is random fluctuation in the ion intensity from the ion source. Nonetheless, it is also apparent that the cryogenic IRPD spectra have much narrower IR bands.

The photodissociation yields for both IRMPD and IRPD experiments are expressed through the following equations:

$$\text{Yield}_{IRMPD} = -\ln\left[1 - \frac{\sum(\text{photofragments})}{\sum(\text{photofragments} + \text{precursor})}\right] \quad \text{Equation (5)}$$

$$\text{Yield}_{IRPD} = -\ln\left[1 - \frac{\text{precursor}}{\text{precursor} + \text{precursor}\cdot ACN}\right] \quad \text{Equation (6)}$$

Computational Analysis. Calculated structures of protonated tyramine and 2-phenyl-1-ethanolamine were generated with chemical intuition in Gabedit 2.4.8.28 Gaussian 09 was then utilized to perform DFT calculations for energy optimizations and IR frequencies for each conformation at the B3LYP/cc-pVTZ level of theory. All spectra were broadened with a Gaussian linewidth FWHM (full-width half-maximum)=10 $cm^{-1}$ and scaled by 0.960 for more facile comparison with experimental data.

Results and Discussion

Functional Group Identifier. Vibrational ion spectroscopy can be a useful technique to distinguish between different chemical moieties via diagnostic vibrational modes. For example, sulfotyrosine-containing peptides that have an SO—H vibrational mode at about 3590 $cm^{-1}$ can be distinguished from phosphotyrosine-containing peptides that exhibit a PO—H vibrational mode at about 3670 $cm^{-1}$.[29] Similar trends were seen for carbohydrates, where the respective sulfate (3595 $cm^{-1}$) and phosphate (3666 $cm^{-1}$) bands were observed[30]

Figure 50:
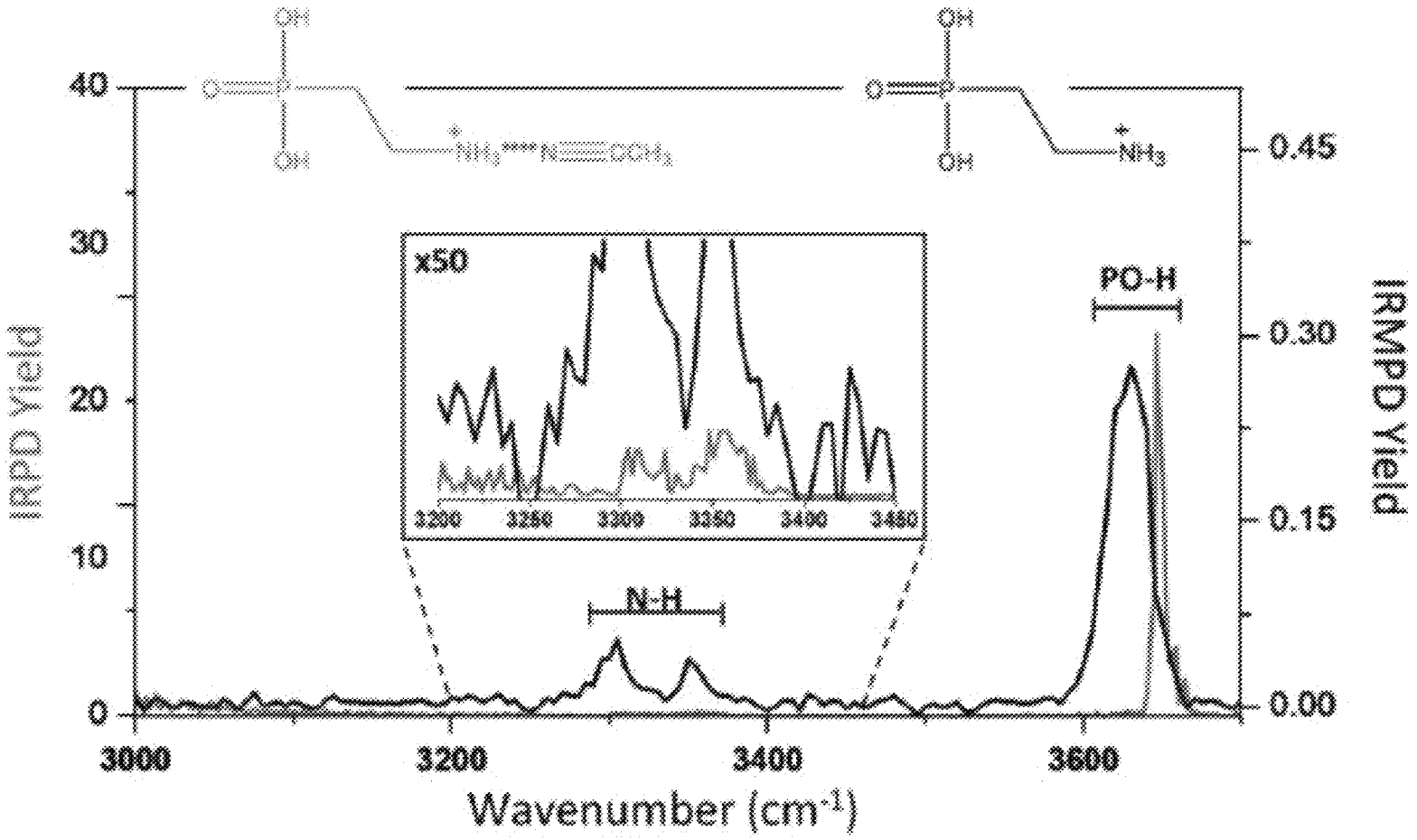
FIG. 50 shows the IRPD spectrum of 2-AEP•ACN (blue) compared to the IRMPD spectrum of the 2-AEP bare ion (black).
Figure 51:
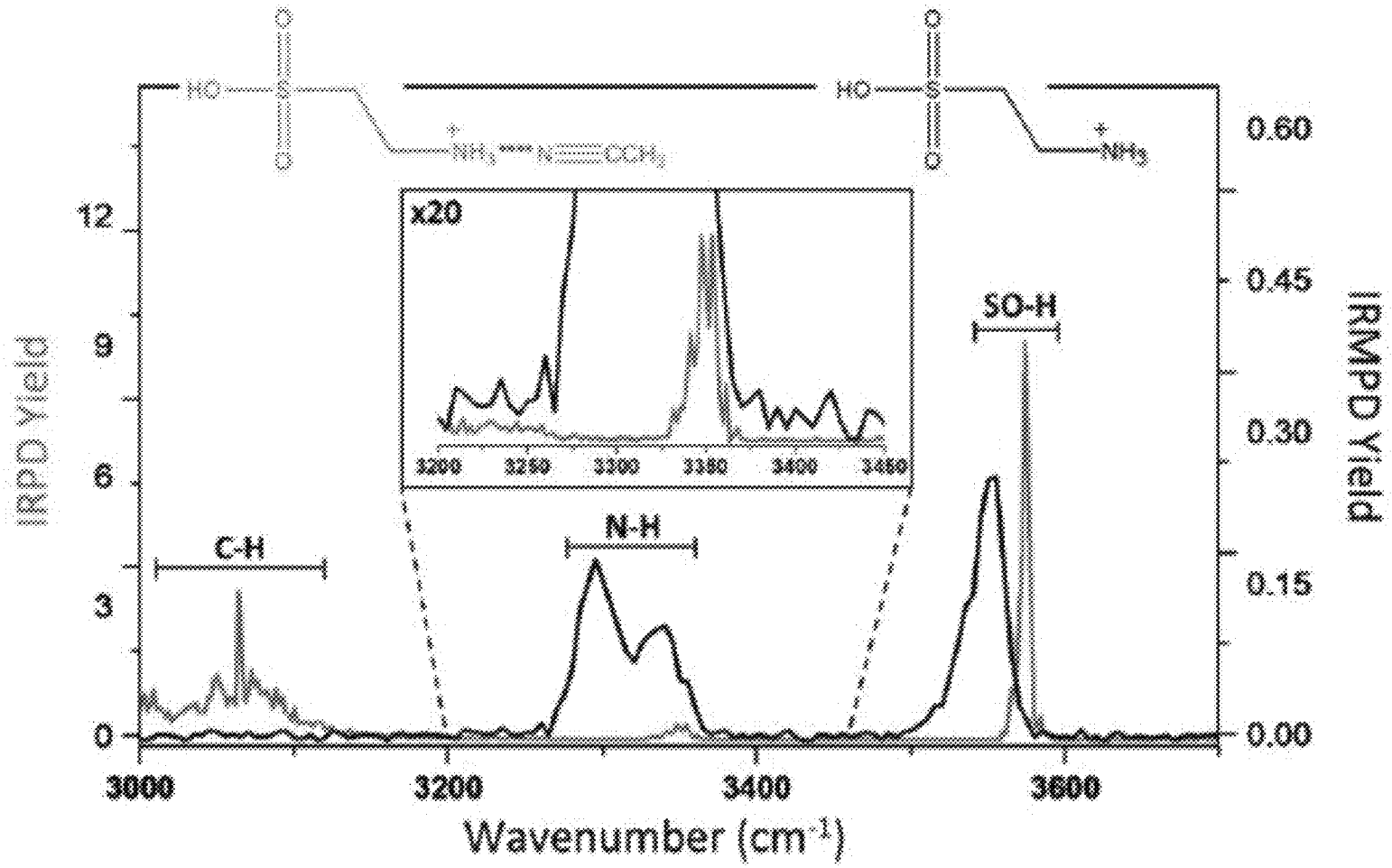
FIG. 51 shows the IRPD spectrum of taurine•ACN (blue) compared to the IRMPD spectrum of the taurine bare ion (black).

Here, this method is applied to smaller, isobaric metabolites such as taurine (m/z 126.02), a semi-essential amino acid and metabolite found in mammalian tissues,[31] and 2-amino-ethylphosphonic acid (2-AEP or Ciliatine) (m/z 126.03), which has also been detected in human organ tissue.[32] Both the room temperature IRMPD and cryogenic IRPD infrared spectra for these isobars are displayed in FIGS. 50-51. It is quite clear that the SO—H and PO—H modes are readily distinguishable, both by IRMPD and IRPD. As summarized in FIG. 54, the SO—H stretch is red shifted by about 75 $cm^{-1}$ compared to the PO—H stretch. It is striking how narrow the IRPD bands are compared to the respective IRMPD bands (e.g., FWHMIRPD=5 $cm^{-1}$ vs. FWHMIRMPD=25 $cm^{-1}$), which increases the molecular specificity of the measurement. There are also visible N—H modes for both molecules, but the high chemical similarities of the amine groups yield less marked differences. Finally, several prominent C—H stretching modes were noticed in the IRPD spectrum of taurine, which are not visible in the IRMPD spectrum. The more challenging detection of C—H stretching modes in IRMPD results from the generally weak absorbances of these modes, coupled with the lower energy per photon in the multiple-photon dissociation scheme.

Figure 52:
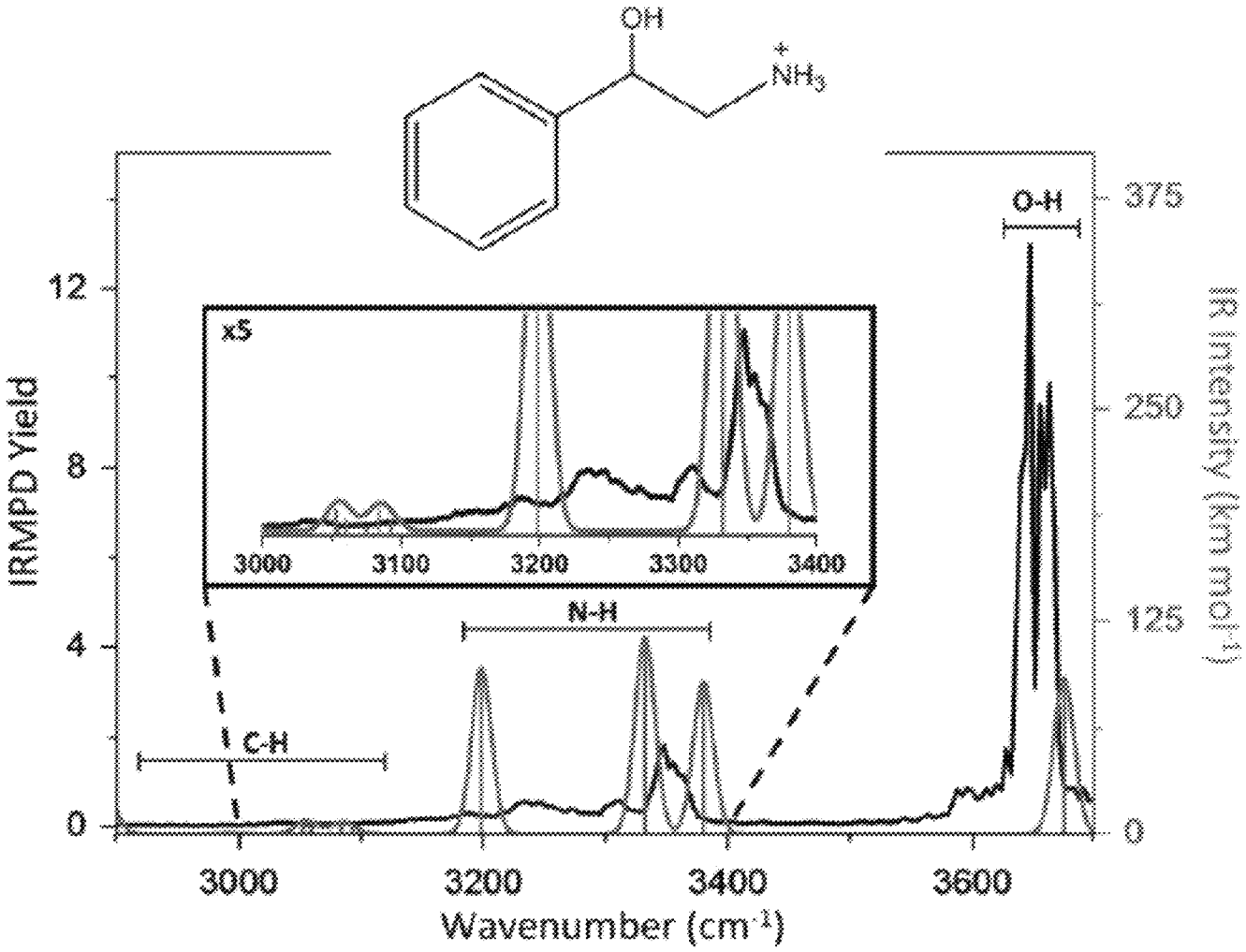
FIG. 52 shows the IRMPD spectrum of 2P1EA (black) compared o the computed IR spectrum of 2P1EA bare ion (red).
Figure 53:
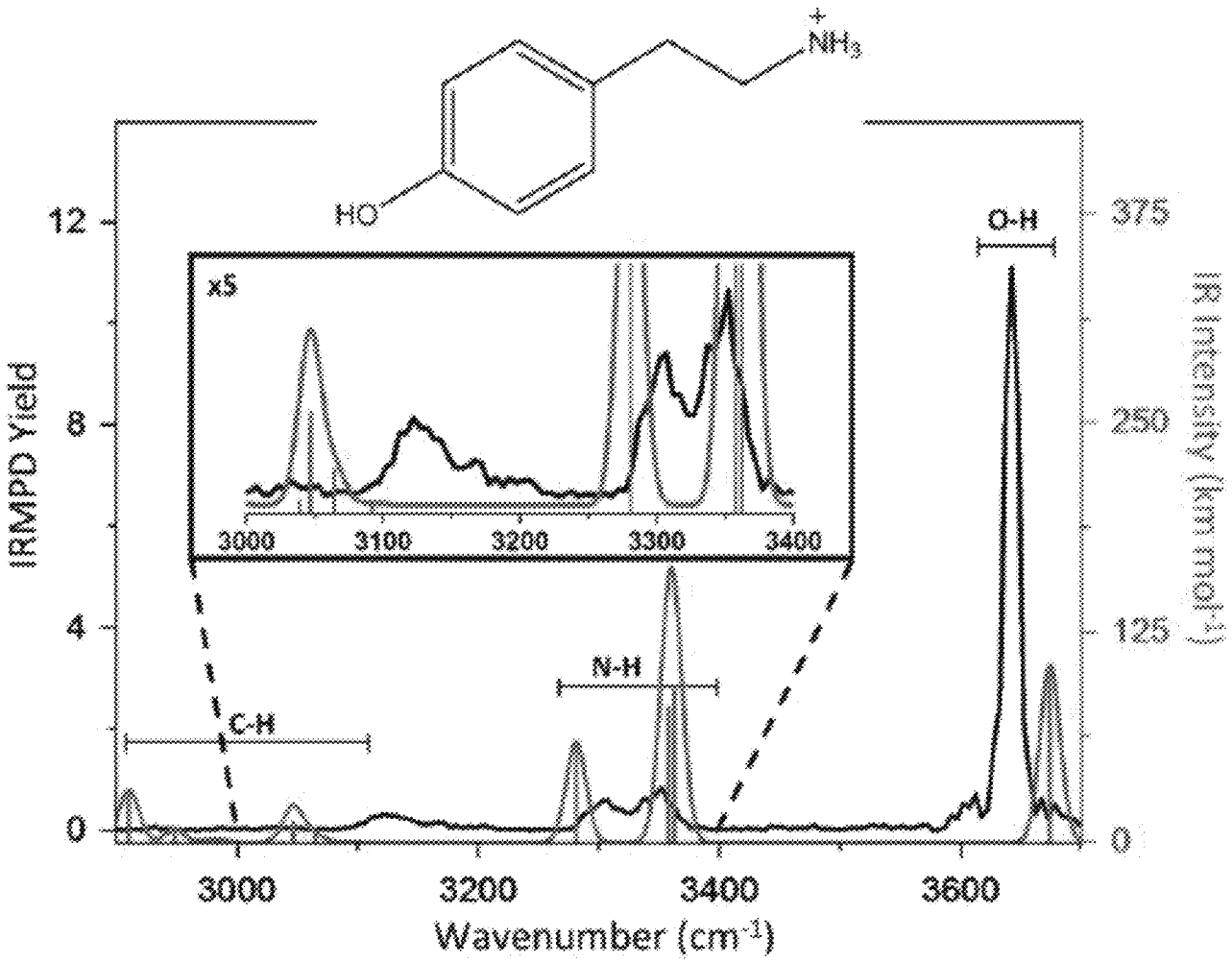
FIG. 53 shows the IRMPD spectrum of tyramine (black) compared to the computed IR spectrum of tyramine bare ion (red).
Figure 56:
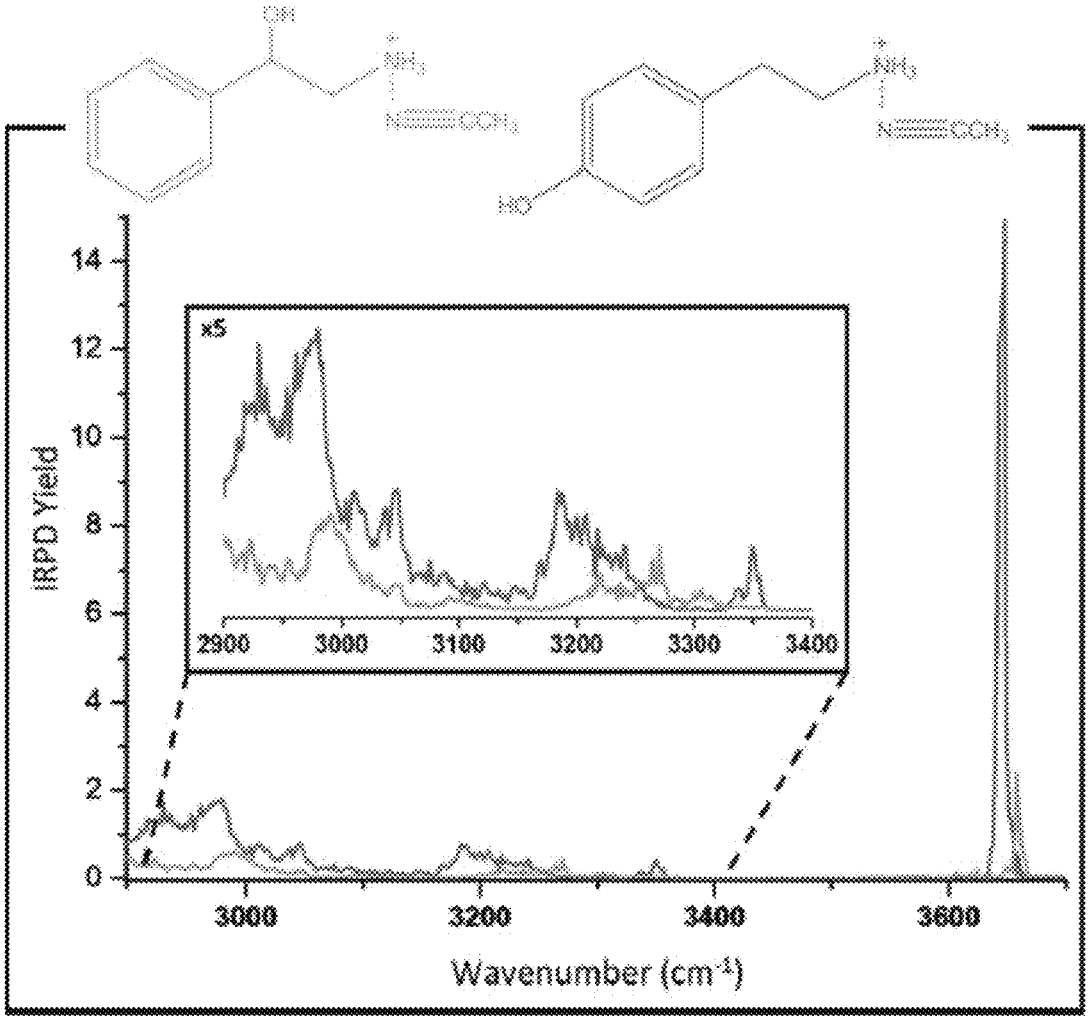
FIG. 56 shows a comparison of IRPD spectra of 2P1EA•ACN (orange) and tyramine•ACN (blue) at a trap temperature of 16.4 K.
Figure 63:
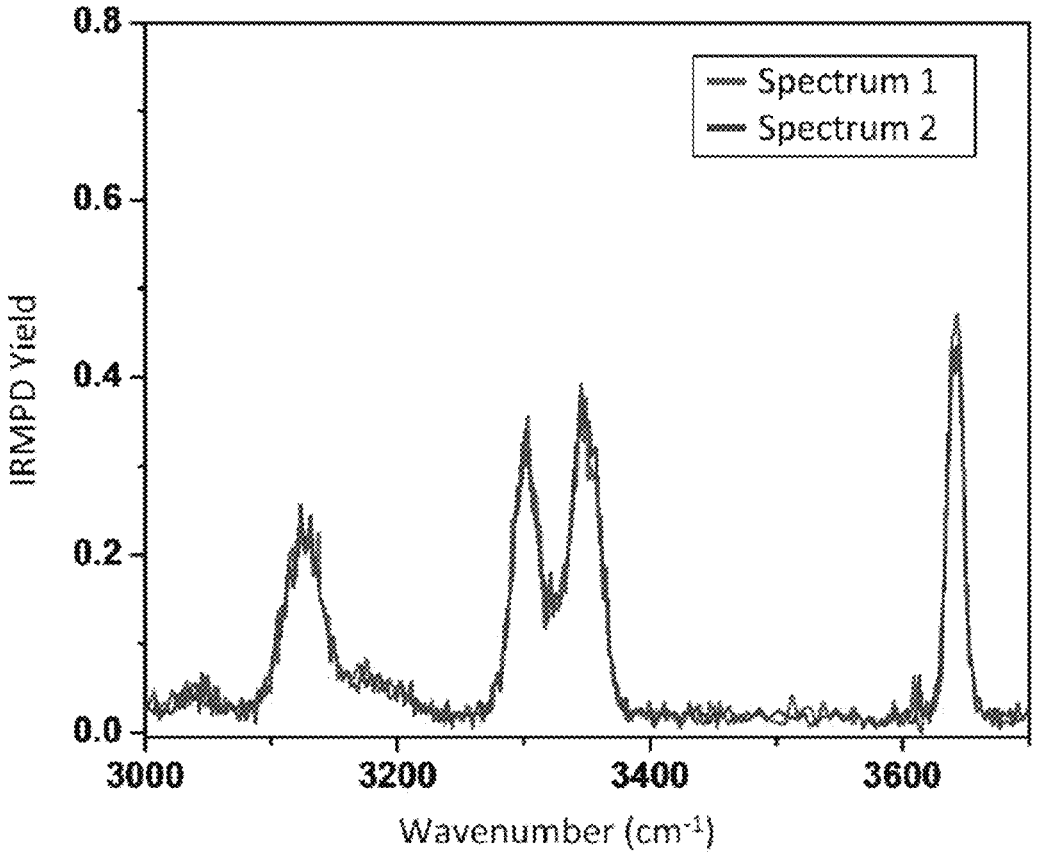
FIG. 63 shows reproducibility of spectra for IRMPD of tyramine.
Figure 64:
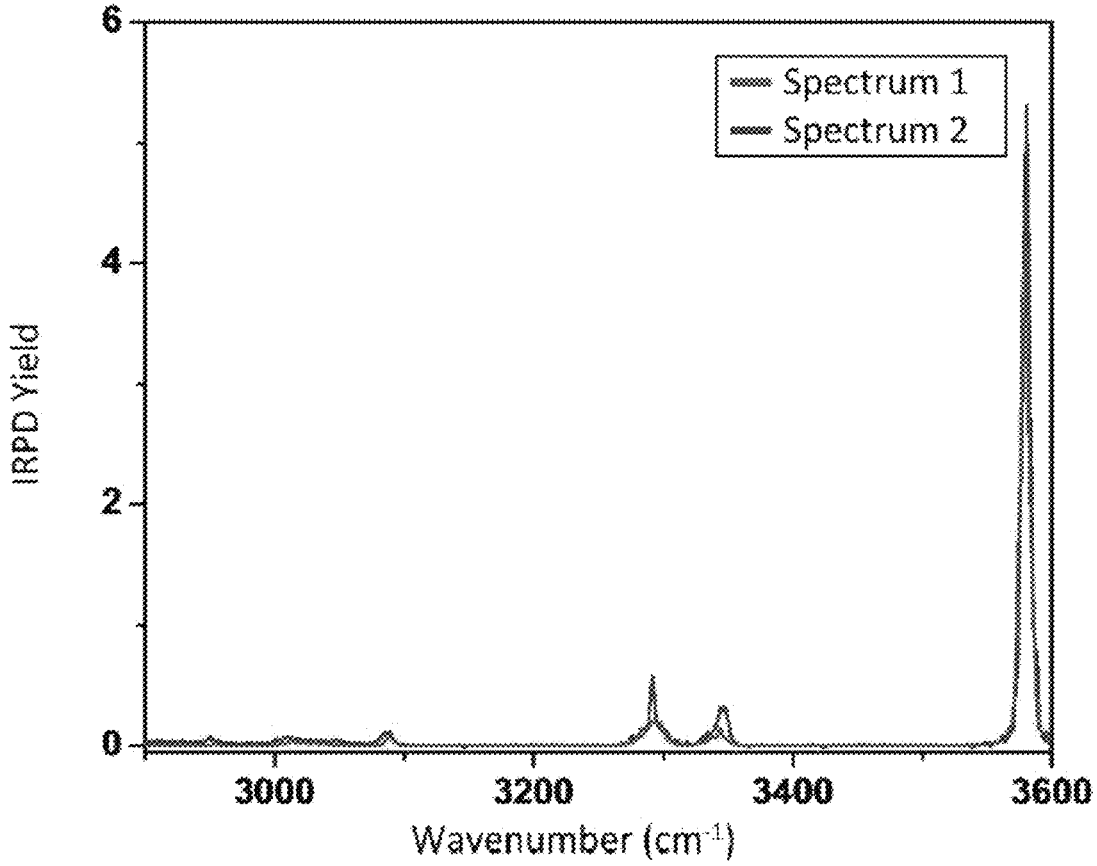
FIG. 64 shows reproducibility of IRPD of PABA●CAN.

Isomeric structure identification. While vibrational spectroscopy is inherently powerful in elucidating functional groups, the differentiation of isomeric compounds is analytically more challenging, and is an especially prominent problem in mass spectrometry. Sometimes, the differences in IR spectra are exclusively due to conformational differences between isomers, and a comparison to theoretical calculations is required to assign vibrational modes and Confirm specific conformations. FIGS. 52-53 can depict IMP spectra on isomeric metabolites, 2-phenyl-1-ehtanolamine (2P1EA) and tyramine along with their calculated vibrational absorption spectra. At first glance, it appears that the two IRMPD spectra have many overlapping features, but a detailed analysis (see FIG. 55) reveals some subtler differences in peak positions and peak shapes. The broad doublet (3660 $cm^{-1}$ and 3645 $cm^{-1}$) for 2P1EA in the O—H stretching region is reproducible, whereas tyramine only has the one O—H stretch at 3642 $cm^{-1}$. There are also some differences in the 3100-3300 $cm^{-1}$ N—H stretching region, where the IRMPD spectrum of 2P1EA has a peak at 3242 (probably the symmetric N—H stretching mode) which appears more redshifted for tyramine at 3128 $cm^{-1}$. It should be noted that these differences, while minor, are reproducible (see for instance FIGS. 63-64 in the ESI†). FIGS. 63-64 shows Reproducibility of spectra for IRMPD of tyramine (FIG. 63) and IRPD of PABA●CAN (FIG. 64) Nonetheless, the poor resolution of these spectral features is not ideal in terms of differentiating a large number of isomers (FIG. 56) shows the cryogenic IRPD spectra for the same isomers, 2P1EA and tyramine, using the solvent tag acetonitrile (ACN). The higher spectral resolution allows a separation of most of the vibrational features. For instance, the O—H modes between the isomers are separated by 15 $cm^{-1}$.

Figure 65:
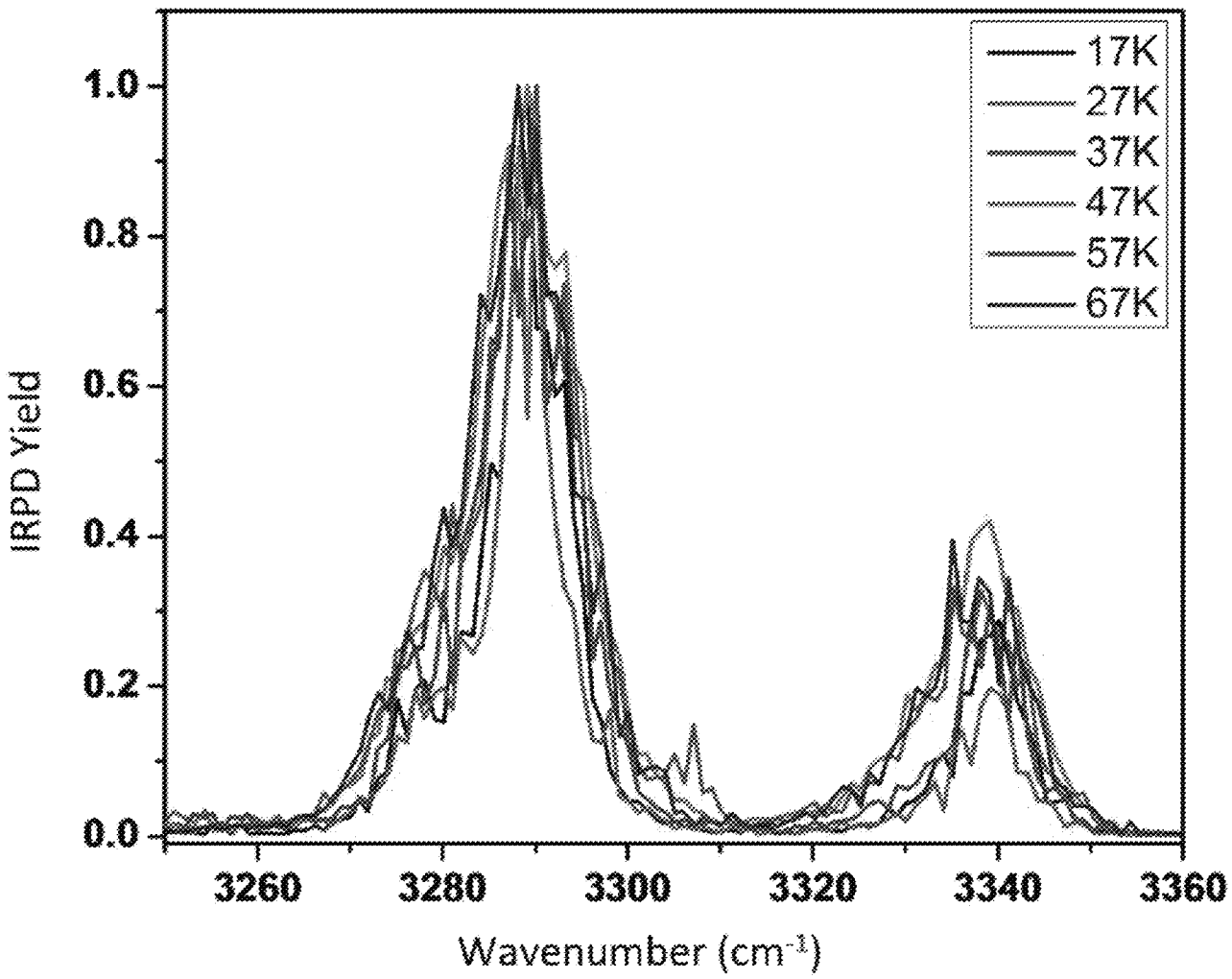
FIG. 65 shows results from a temperature study of PABA●ACN over the N—H modes from 17-67K.

Furthermore, there are several peaks in the N—H and C—H regions that allow for a much clearer differentiation between the isomers compared to the respective IRMPD spectra. It should be noted that the spectral resolution in these cryogenic IRPD spectra does depend on the temperature of the cryoLIT, and that colder temperatures result in narrower spectral features (see FIG. 65 in the ESI†). FIGS. 63-64 show reproducibility of spectra for IRMPD of tyramine (FIG. 63) and IRPD of PABA●ACN (FIG. 64).

Figure 57:
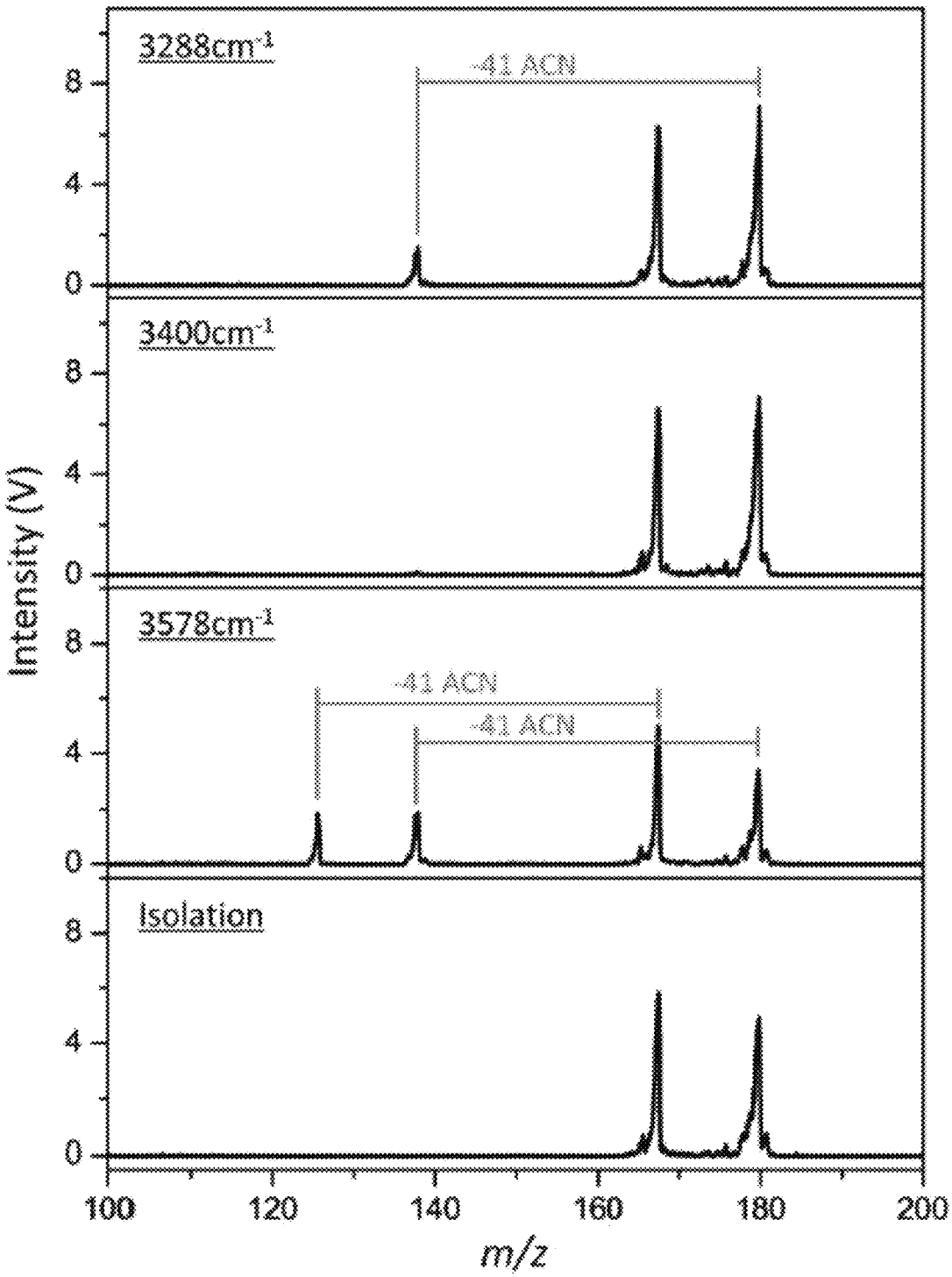
FIG. 57 shows Raw mass spectra of mass isolated taurine•ACN (m/z 167) and PABA•ACN (m/z 179), following irradiation at various IR frequencies.
Figure 59:
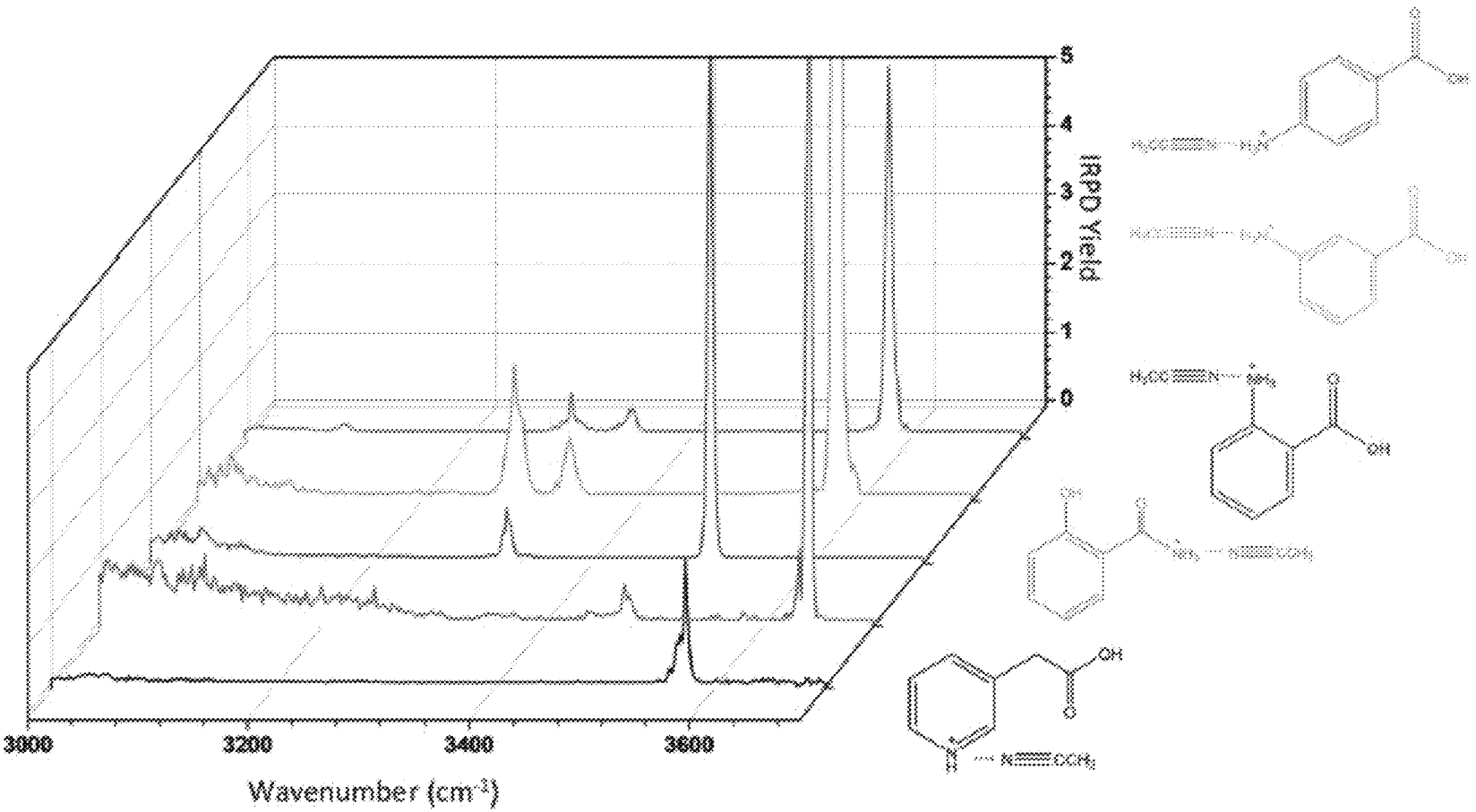
FIG. 59 shows a 3D comparison of IRPD spectra of five m/z 138 solvent-tagged isomeric ions (m/z 179): PABA•ACN (red), MABA•ACN (orange), OABA•ACN (green), salicylamide•ACN (blue) and 3-PAA•(black).

Apart from narrower IR spectral features, another key advantage of tagging spectroscopy is the ability to measure the IR spectra of multiple analytes in the same measurement. This is illustrated in FIG. 57, where the mass isolated ACN-tagged analytes taurine and p-aminobenzoic acid are probed simultaneously. Each IRPD mass channels is clearly distinguishable, selectively showing the diagnostic vibrations of these analytes.

A challenge is to apply IR spectroscopy to multiple isomers with subtle differences in structures. FIG. 60 contains the cryogenic IRPD spectra for a set of five isomeric metabolites: p-aminobenzoic acid (PABA), m-aminobenzoic acid (MABA), o-aminobenzoic acid (OABA), salicylamide, and 3-pyridylacetic acid (3-PAA). From a structural point of view, PABA, MABA, and OABA are all positional isomers and all but salicy-lamide contain a carboxylic acid. The peak positions and assignments are summarized in FIG. 58. It is interesting then that there are noticeable differences in the O—H band positions for almost all of these isomers with the exception of PABA and MABA. In fact, PABA and MABA have very similar spectra, except for a slight shift in peak position for their asymmetric $NH_3$+ modes, and some differences in the C—H stretching region. To quantify the spectral differences between these isomers, the absolute value differences of integrated intensities over a spectral range was summed to generate difference scores, as summarized in FIG. 60. Eq. (7) shows the mathematical formula to obtain this difference score, where f (v˜) and g(v˜) denote relative IRPD intensities at different IR frequencies (v˜) in the IRPD spectra f and g. By taking the absolute value of the intensity differences, the differences cumulatively add up over the IR spectral range that the integration is done; the integration was performed here using the python library NumPy's trapz method. Note that others have employed matrix-based approaches to analyze photofragmentation data for the purpose of structural identification.[24]

It is clear from these scores that the IR spectra of PABA and MABA are most similar, followed by OABA. As PABA, MABA and OABA are positional isomers with the same functional groups, there appears to be a correlation between the spectral similarities and the molecular similarities between the isomers. It is promising that this trend is observed even for an imperfect tag such as ACN, which is known to affect the inherent IR spectrum of the analyte, as a result of intermolecular interactions. For instance, there are a couple of bands that seem to be missing in these IRPD spectra, particularly N—H modes of the charged moiety, due to interactions of ACN with this group. A more detailed study on the effect of a solvent tag on the IRPD spectra of analytes is the subject of a forthcoming study,[33] and this has been the subject of a large number of studies in the literature.[34-38] It should also be noted that the binding energy of ACN exceeds the energy of a single IR photon, and thus these IRPD spectra reflect a multiple-photon dissociation regime.

$$\text{difference score} = \int_{\tilde{\nu}_1}^{\tilde{\nu}_1} |f(\tilde{\nu}) - g(\tilde{\nu})|\, d\tilde{\nu} \qquad \text{Equation (7)}$$

Using a more innocent Tag: $N_2$

Ideally, the role of the tag is to be an innocent reporter on the absorption of a single photon.[13] Additionally, the tag should be generic, and stick to any ion, which is not readily implemented for solvent-tagged ions from ESI. Here, we demonstrate IRPD of an N2-tagged complex, based on a weak van der Waals interaction, which dissociates via absorption of a single photon. The choice of $N_2$ (rather than $H_2$ or He) is motivated by the larger mass shift (e.g., 28 amu), which is large enough to ensure mass isolation in our mass-selective cryogenic trap without knocking off the tag due to RF heating.

Figure 61:
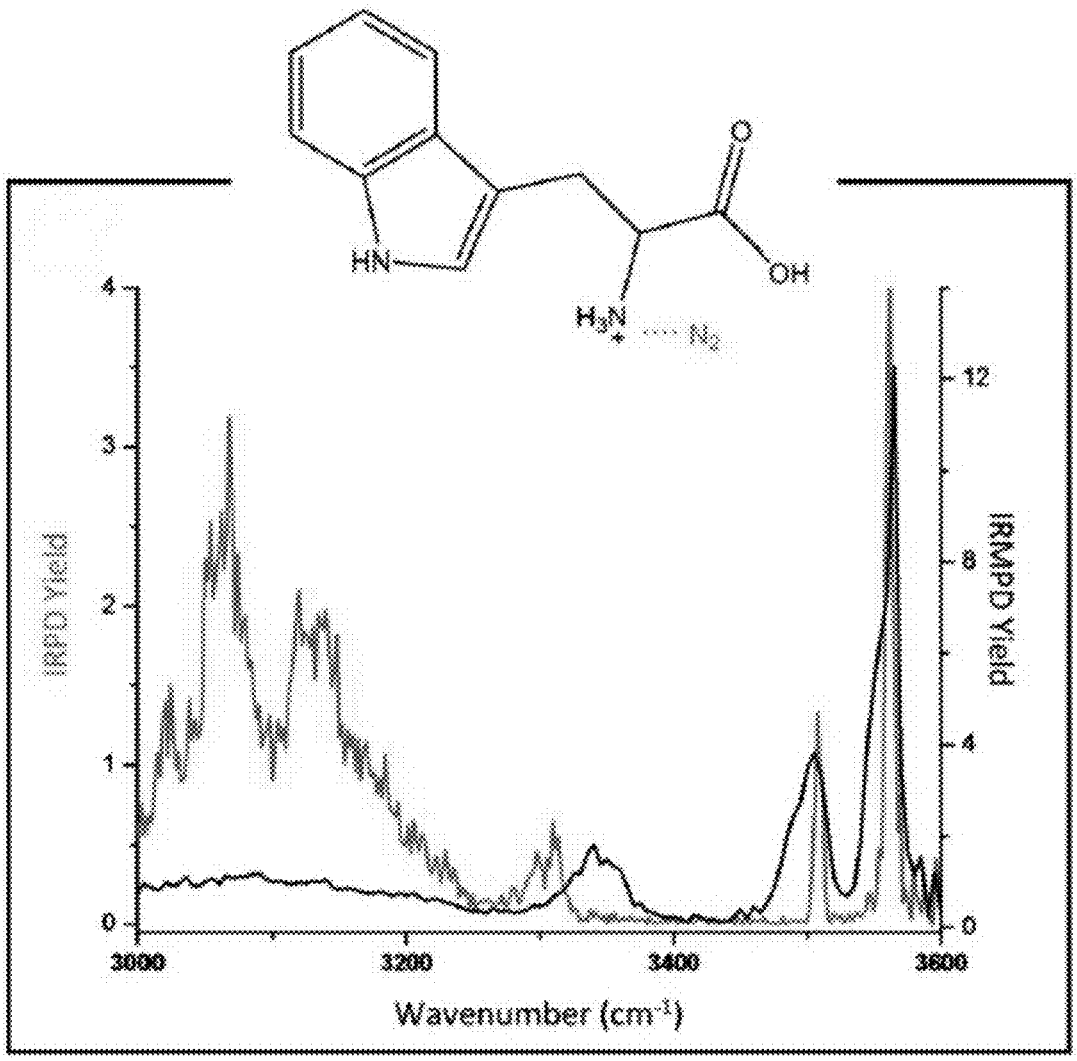
FIG. 61 shows an IRPD spectrum of protonated tryptophan tagged with $N_2$ (blue) compared with the IRMPD spectrum of the bare tryptophan ion.
Figure 62:
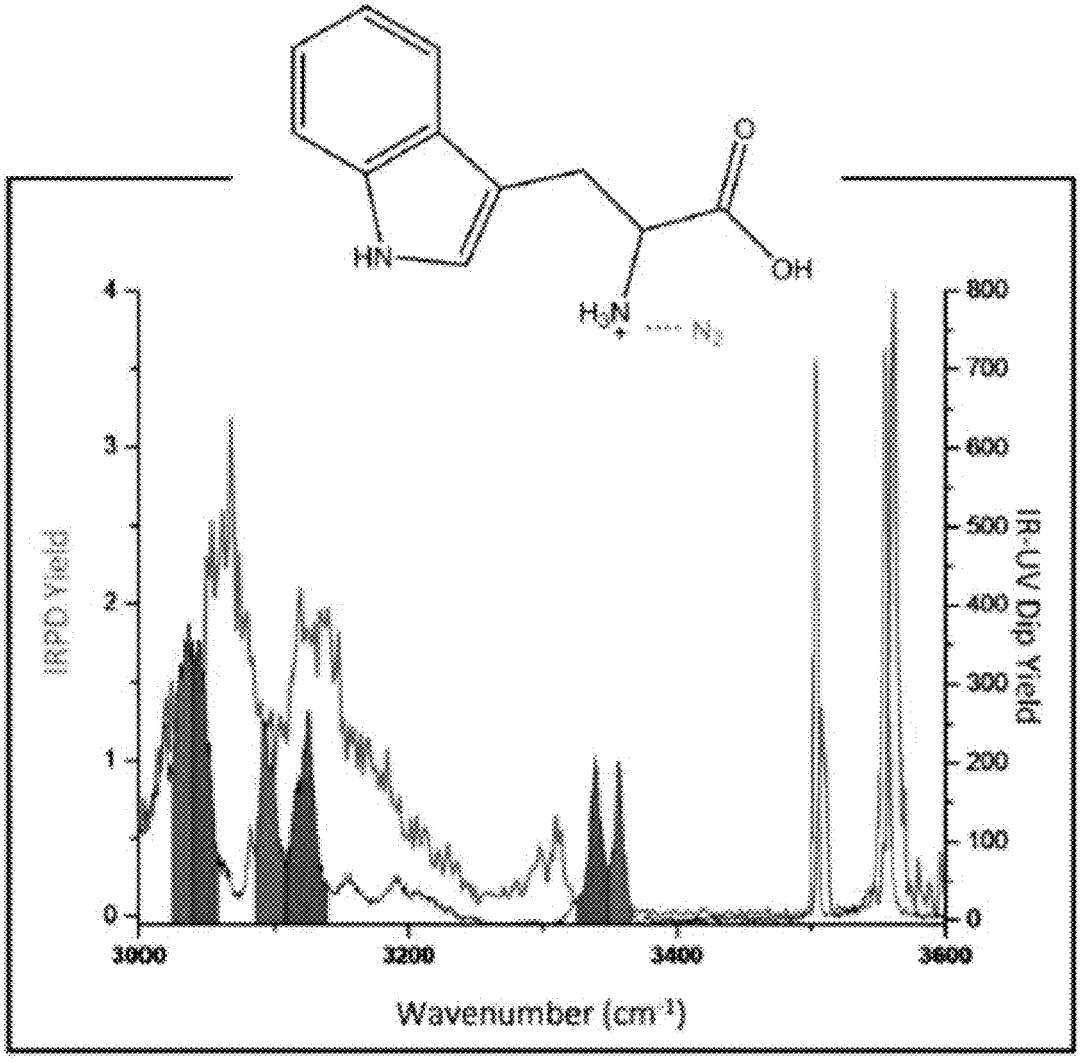
FIG. 62 shows an IRPD spectrum of protonated tryptophan tagged with $N_2$ (blue) compared with) the IR-IR-UV hole burning spectrum of the bare tryptophan ion•38 Diagnostic IR modes for two prominent conformations are labeled (in blue and red).

FIG. 61 compares the cryogenic IRPD spectrum of $N_2$-tagged protonated tryptophan to the IRMPD spectrum of protonated tryptophan. Protonated tryptophan is a good model system for interpretation, as it has been previously studied by both IRMPD spectroscopy,[37] and cryogenic IR-IR-UV hole burning spec- troscopy.38 It is clear that for both IRMPD and IRPD the carboxylic OH stretch and the indole NH mode appear in relatively the same positions but with the IRPD spectrum exhibiting better resolved peaks. It is interesting to note that there is a red shift in the IRPD spectrum for the free N—H stretching modes and that there are actually two resolvable peaks. Furthermore, there are also quite clearly resolved peaks in the 3000 $cm^{-1}$-3200 $cm^{-1}$ range which are not apparent in the IRMPD spectrum. FIG. 62 shows a comparison to the previously published data by Boyarkin et al.[38] The latter data was interpreted by the presence of two conformers (labeled in blue and red). The $N_2$-tagged IRPD spectrum exhibits similar features, but these appear to be shifted. These results illustrate that cryogenic IR spectra are often the sum of multiple conformations, and that even a van der Waals tag can have an effect on the measured IR action spectrum. Nonetheless, the high resolution, and therefore high chemical specificity of these measurements can serve as a powerful fingerprint for identification and differentiation of isomeric species.

Summary

Vibrational ion spectroscopy methods such as IRMPD and IRPD offer a wealth of structural information on isomeric and isobaric metabolites. IRMPD spectroscopy is implementable in commercially available mass spectrometers, and can be a powerful tool for identifying specific functional groups, especially among isobaric metabolites with different functional groups. Nonetheless, the low resolution of IRMPD limits its usefulness for differentiating closely related molecules, such as isomers. Cryogenic IRPD spectroscopy provides enhanced spectral resolution to distinguish multiple isomers, even positional isomers that differ by only a single substituent around a benzene ring. An important aspect of IRPD spectroscopy involves "tagging" the analyte non-covalently, which opens the door to a multiplexed scheme, in which the IR spectra of multiple analytes can be recorded in parallel. It was shown here that using the solvent tag acetonitrile, high resolution IR spectra can be recorded (in a multiplexed fashion). On the one hand, the tagging efficiency for solvent tagging can be high for some analytes,[17] which is advantageous from a sensitivity point of view. On the other hand, the solvent tag can have a significant effect on the infrared spectra of analytes. The use of a van der Waals tag such as $N_2$ is more ideal in terms of employing an innocent tag, even if there are also subtle band shifts in the measured IR spectra compared to measuring IR spectra of bare ions. This illustrates the importance of employing a reference tag in terms of building up a library of IR spectra of known standards. A strong point of IR spectroscopy is that this IR spectral library would not have to be complete in order to allow a partial structural characterization of an unknown. As spectral similarity correlates with structural similarity, especially in the fingerprint (1000-1400 $cm^{-1}$) region, a classification of the unknown into the chemical class of a library reference compound should be possible.

REFERENCES FOR EXAMPLE 2

1 L. M. Samuelsson and D. G. J. Larsson, Mol. BioSyst., 2008, 4, 974.
2 J. Kang, L. Zhu, J. Lu and X. Zhang, J. Neuroimmunol., 2015, 279, 25.
3 A. Zhang, H. Sun, H. Xu, S. Qiu and X. Wang, OMICS, 2013, 17, 495.
4 E. A. Mahrous and M. A. Farag, J. Adv. Res., 2015, 6, 3.
5 Q. L. Guo-Fang Zhang, L. Ling and K. Takhar, Metabolomics Research with Tandem Mass Spectrometry, InTech, 2012.
6 M. Vinaixa, E. L. Schymanski, S. Neumann, M. Navarro, R. M. Salek and O. Yanes, TrAC, Trends Anal. Chem., 2016, 78, 23.
7 S. Naz, M. Vallejo, A. Garcia and C. Barbas, J. Chromatogr., A, 2014, 1353, 99.
8 T. D. Fridgen, Mass Spectrom. Rev., 2009, 28, 586.
9 N. C. Polfer and J. Oomens, Mass Spectrom. Rev., 2009, 28, 468.
10 M. Z. Kamrath, E. Garand, P. A. Jordan, C. M. Leavitt, A. B. Wolk, M. J. Van Stipdonk, S. J. Miller and M. A. Johnson, J. Am. Chem. Soc., 2011, 133, 6440.
11 M. C. Thompson, J. Ramsay and J. M. Weber, Angew. Chem., Int. Ed., 2016, 55, 15171.
12 E. M. Duffy, B. M. Marsh, J. M. Voss and E. Garand, Angew. Chem., Int. Ed., 2016, 55, 4079.
13 M. Okumura, L. I. Yeh, J. D. Myers and Y. T. Lee, J. Chem. Phys., 1986, 85, 2328.
14 D. J. Goebbert, T. Wende, R. Bergmann, G. Meijer and K. R. Asmis, J. Phys. Chem. A, 2009, 113, 5874.
15 J. Jašik and J. Roithová, Int. J. Mass Spectrom., 2015, 377, 109.
16 A. P. Cismesia, L. S. Bailey, M. R. Bell, L. F. Tesler and N. C. Polfer, J. Am. Soc. Mass Spectrom., 2016, 27, 757.
17 A. P. Cismesia, L. F. Tesler, M. R. Bell, L. S. Bailey and N. C. Polfer, J. Mass Spectrom., 2017, 52, 720.
18 O. Gorlova, S. M. Colvin, A. Brathwaite, F. S. Menges, S. M. Craig, S. J. Miller and M. A. Johnson, J. Am. Soc. Mass Spectrom., 2017, 28, 2414.
19 J. Martens, V. Koppen, G. Berden, F. Cuyckens and J. Oomens, Anal. Chem., 2017, 89, 4359.
20 O. Hernandez, S. Isenberg, V. Steinmetz, G. L. Glish and P. Maitre, J. Phys. Chem. A, 2015, 119, 6057.
21 J. Wattjes, B. Schindler, S. Trombotto, L. David, M. Moerschbacher Bruno and I. Compagnon, Pure Appl. Chem., 2017, 89, 1349.
22 V. Kopysov, A. Makarov and O. V. Boyarkin, Anal. Chem., 2017, 89, 544.
23 E. Mucha, A. I. Gonzalez Florez, M. Marianski, D. A. Thomas, W. Hoffmann, W. B. Struwe, H. S. Hahm, S. Gewinner, W. Schollkopf, P. H. Seeberger, G. von Helden and K. Pagel, Angew. Chem., Int. Ed., 2017, 56, 11248.
24 V. Kopysov, A. Makarov and O. V. Boyarkin, Anal. Chem., 2015, 87, 4607.
25 C. Masellis, N. Khanal, M. Z. Kamrath, D. E. Clemmer and T. R. Rizzo, J. Am. Soc. Mass Spectrom., 2017, 28, 2217.
26 K. Gulyuz, C. N. Stedwell, D. Wang and N. C. Polfer, Rev. Sci. Instrum., 2011, 82, 054101.
27 S. Guan and A. G. Marshall, Anal. Chem., 1993, 65, 1288.
28 A.-R. Allouche, J. Comput. Chem., 2011, 32, 174.
29 A. L. Patrick, C. N. Stedwell and N. C. Polfer, Anal. Chem., 2014, 86, 5547.
30 B. Schindler, J. Joshi, A.-R. Allouche, D. Simon, S. Chambert, V. Brites, M.-P. Gaigeot and I. Compagnon, Phys. Chem. Chem. Phys., 2014, 16, 22131.
31 G. B. Schuller-Levis and E. Park, FEMS Microbiol. Lett., 2003, 226, 195.
32 S. A. Tan and L. G. Tan, Clin. Physiol. Biochem., 1989, 7, 303.
33 M. R. Bell, W. D. Vinicius, A. P. Cismesia, L. F. Tesler, A. E. Roitberg and N. C. Polfer, In Preparation.

Example 3

The infrared spectra of mass-selected ions in a mass spectrometer can be recorded via "action" or "consequence" spectroscopy approaches, where the ion is photodissociated with a tunable light source. The most readily implementable infrared ion spectroscopy technique is infrared multiple-photon dissociation (IRMPD) spectroscopy[1,2], where typically room-temperature ions are subjected to intense radiation to cause absorption of several IR photons, leading to the cleavage of covalent bonds. IRMPD spectroscopy has been shown to be powerful in answering certain chemical questions about the structures of ions.[3,5] nonetheless, the broader spectral features in IRMPD are an impediment to differentiate between closely related molecules, especially when the number of putative structures is large. Higher resolution IR spectra can be generated at cryogenic temperatures; however, those approaches require custom instrumentation.

The first cryogenic IR "action" spectra of ions were recorded in supersonic experimentations in the 19080's in the so-called messenger spectroscopy scheme.[6] In the expansion, ions are cooled to cryogenic temperatures, allowing inert gas atoms such as Ar (or e.g. Ne or He) to condense onto the ion. As the binding energy of this Van der Waals-tagged atom is lower than the energy of a single IR photon, resonant absorption of an IR photon leads o detachment of the Ar atom. The basic premise of the messenger spectroscopy scheme is that detachment of the weakly-bound tag reports on photon absorption. Another assumptions that the weak binding of the tag only subtly affects the inherent absorption spectrum of the ion. In the 2000's, it was demonstrated that ions could also be cooled and tagged in cryogenic ion traps,[7] and that this approach could then be employed to measure cryogenic IR spectra of ions.[8-10] This major advance allowed the coupling of any ionization technique with cryogenic spectroscopic interrogation. In terms of biomolecular structure identification, the coupling of electrospray ionization (ESI) especially stands out, and correspondingly there has been a surge in papers in recent years to demonstrate bioanalytical applications of IR spectroscopy.[3, 11-15]

As discussed in a recent report[16], cryogenic IR ion spectroscopy has the potential to become a gold standard technique for molecular identification in mass spectrometry, but still faces some significant challenges with respect to instrumentation and methodology to make the technique analytically useful. A key challenge in this respect is the low duty cycle of the experiment, as typically only one molecular species is probed at one light frequency at one time. In principle, the tagging scheme in cryogenic IR ion spectroscopy lends itself to a multiplexed approach, as the mass decrease/increase upon (de)tagging is completely predictable. Thus, the IR spectra of multiple tagged ions could be probed in parallel. As tagging efficiencies are generally low (e.g. a few %), and ion intensities fluctuate from shot-to-shot, for signal-to-noise reasons it is not ideal to measure the depletion of the tagged ion as a function of IR frequency. Instead, by mass selecting the tagged ion, the appearance of the photodissociated untagged ion can be recorded in a background-free scheme. The measurement of the photodissociation ion yield compensates for random fluctuations in the tagged ion signal. In order to carry out such a background-free scheme on multiple tagged ions, it is important that the ions can be mass isolated inside a mass-selective cryogenic trap.

Recently, IR spectroscopy results from the first mass-selective cryogenic 2D linear ion trap (cryoLIT).[17] The rectilinear electrodes of this design combine simplicity in machining with the higher trapping efficiencies and capacities of 2D linear ion traps vis-à-vis 3D ion traps[18-21]. The high dynamic range and low detection limits make 2D linear ion traps a compelling choice for ion spectroscopy, in order to enhance signal-to-noise in these ion intensity measurements. In this Example, operation and performance of a custom LIT at both cryogenic and room temperatures is examined.

Experimental

CryoLIT Design. The cryoLIT is set up as an extension to a previously described custom mass spectrometer.[22] Ions from an ESI source (Analytica of Branford, Branford, Conn.) are directed to a quadrupole mass filter (QMF), from where they can proceed to either a Quadrupole Ion Trap (QIT), or a rectilinear accumulation trap. After accumulation in the rectilinear accumulation trap, ions are transferred to the cryoLIT.

Figure 66A:
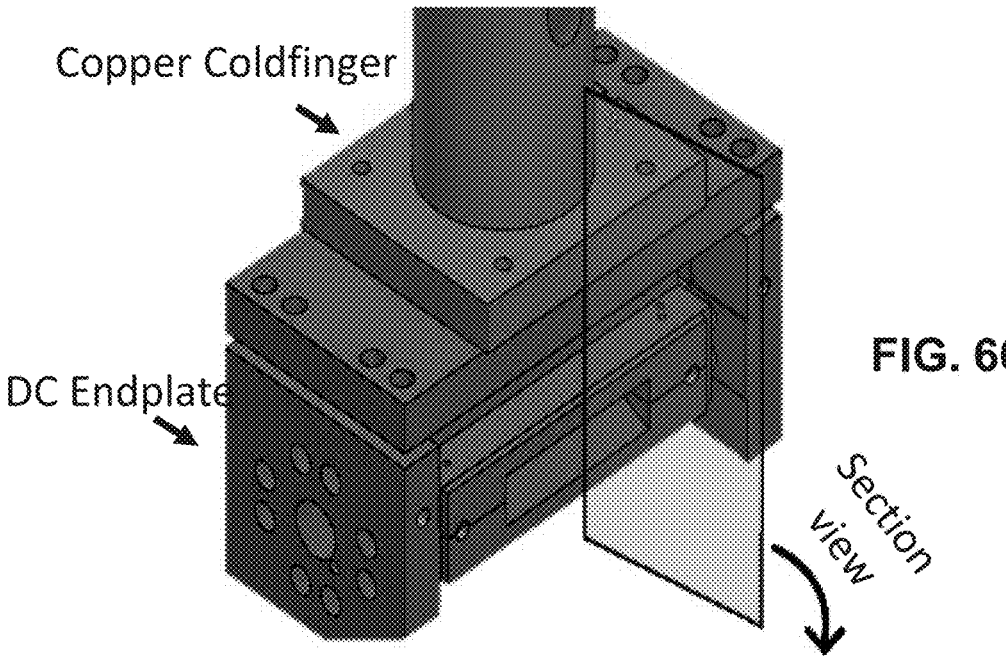
FIGS. 66A-66B shows a CAD model (FIG. 66A) of the cryoLIt assembly with a cross-sectional view (FIG. 66B) illustrating the x- and y-electrodes.
Figure 66B:
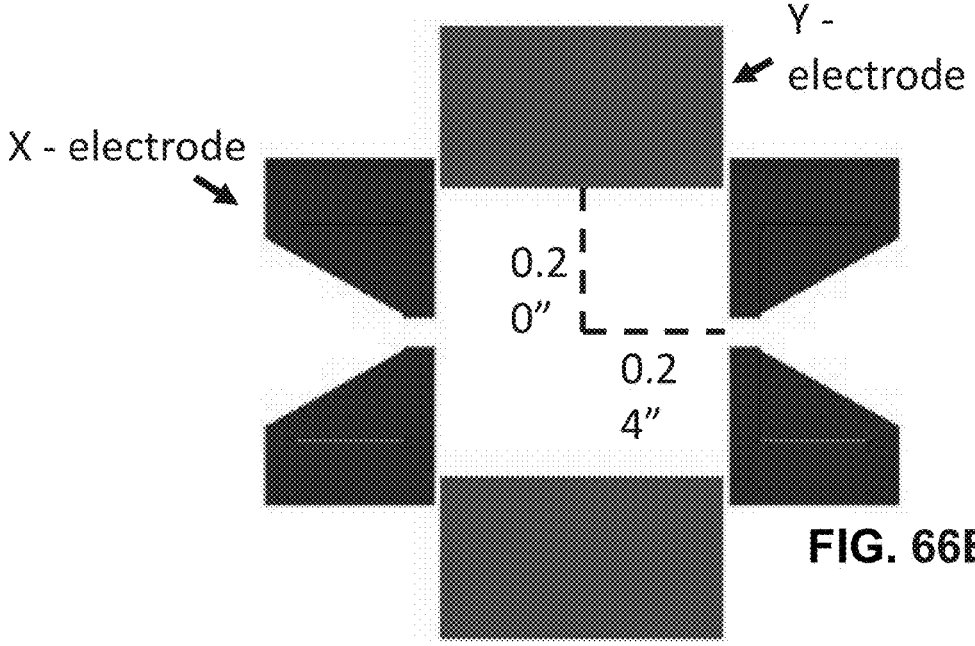

FIGS. 66A-66B shows a schematic of the cryoLIT, which is a rectilinear ion trap (RIT).[19,20] The cryoLIT features an x-stretched geometry with an x to y electrode spacing ratio of 1.2. Specifically, the x-electrode half-spacing is 0.24", and the y-electrode half-spacing is 0.20" (x/y=1.2). The stretched geometry is advantages for enhanced mass manipulation of ions, as it can partially compensate for field imperfections due to the slits.[19] A dynode/electrode multiplier detector (not shown in FIGS. 66A-66B) is placed in the line with the slits of the x electrodes. The slits are 0.04" wide. This value is a trade-off between adequate mass selectivity capabilities, good ejection efficiencies, and a sufficiently low gas conductance of the trap. The latter characteristic is important in order to achieve sufficient pressurization in the trap for cooling and Van der Waals-tagging of ions. The electrodes are held apart at a small distance of 0.02" to further reduce gas conductance. The electrodes are made from 17-4PH stainless steel to prevent possible warping of the trap during cooling. Sapphire spacers are employed to electrically insulate the electrodes, while also providing thermal conductance.

A closed-cycle helium cryostat (AirProducts DE202, Allensville Pa., 1 W cooling power at 15K) cools the cryoLIT; the cryoLIT is mounted on the copper coldfinger of the cryostat, which is mounted on top of a custom vacuum chamber. Several strategies are employed to reduce the thermal load on the cryoLIT. The DC electrode wires are wrapped around the coldfinger to achieve thermalzation, a polished aluminum heatshield, held at 50K, encloses the trap to minimize blackbody heating, and the rf wires are (partially) thermalized via a heat sink on the heatshield. Two thermocouples (LakeShore DT-670 CU, Westerville, Ohio) monitor the temperature at the copper coldfinger and at one of the DC endplates. A heater cartridge, controlled by a cryogenic thermostat (LakeShore 335), regulates the coldfinger temperature. The buffer gas is introduced into the cryoLIT via a solenoid valve (Parker Series 99, Hollis, N.H.).

Electronics. A commercial Velos rf power supply (Thermo-Fisher) drives the cryoLIT at a fixed frequency of 1.108 MHz. The rf power supply is operated in a closed-loop mode to ensure that the rf amplitude does not fluctuate and broaden the mass spectra. A secondary transformer, inside the rf power supply, allows an auxiliary dipolar or "tickle" waveform to be coupled to the x-electrodes. The purpose of this tickle waveform is to radially excite ions in the x-plane to eject them from the trap either for mass selection or detection (via a dynode electron multiplier). The tickle waveform is generated by either a PCI-5421 NI AWG for the Stored Waveform Inverse Fourier Transform (SWIFT), or a Stanford Research DS345 function generator for the fixed frequency dipolar waveform. The two function generators are coupled together by a BNC t-connector. The experimental timing is controlled via a combination of a Stanford Research DG645 elay generator and an ARM microcontroller (Teensy LC, Sherwood, Oreg.), with a maximum timing jitter of +/−250 ms.

Figure 67:
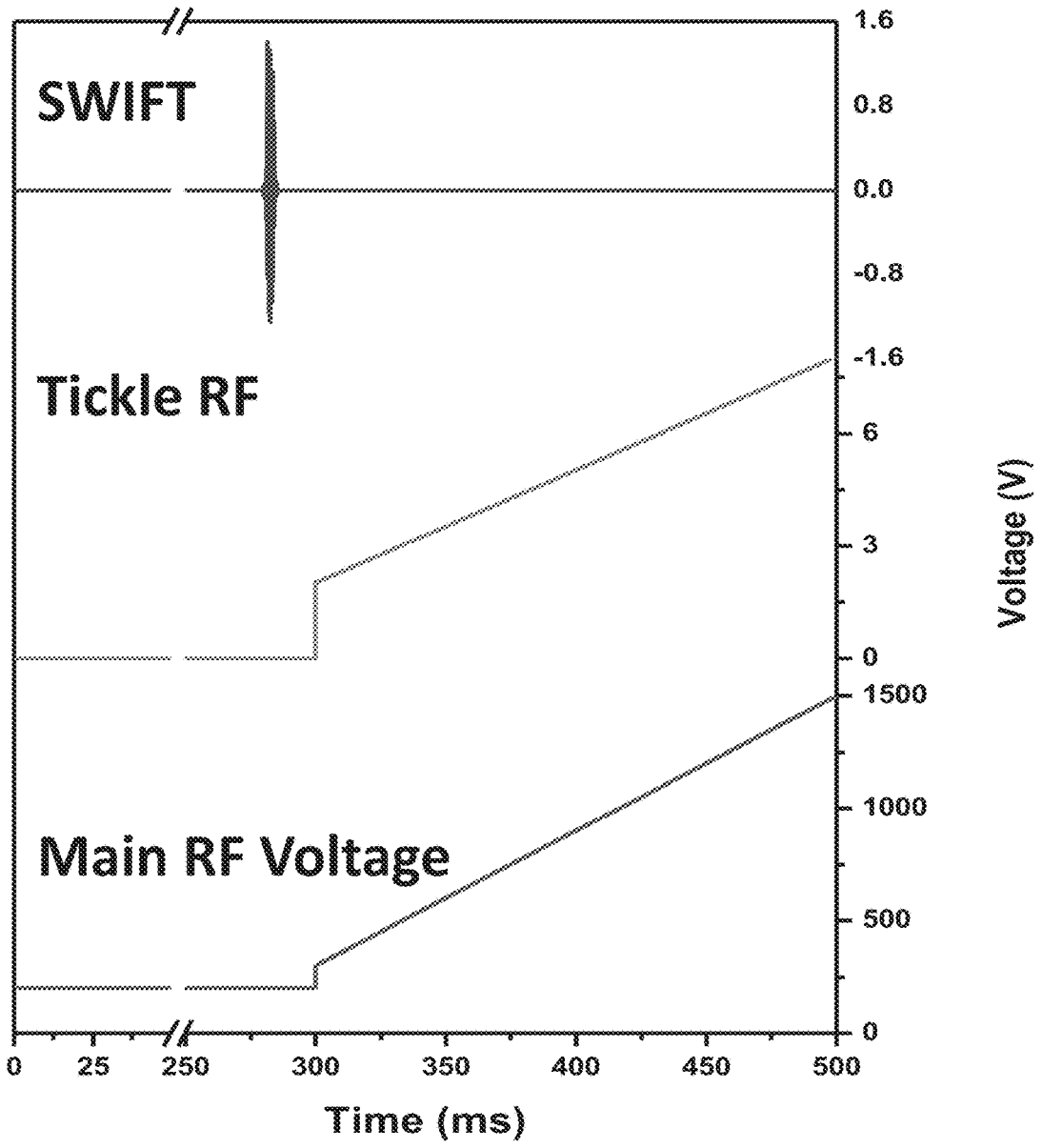
FIG. 67 shows the experimental scheme for the mass instability scans. A SWIFT waveform is applied 20 ms before the scan, for 8 ms. During the mass scan both of the resonant auxiliary frequency and the main rf amplitude are ramped up.
Figure 68:
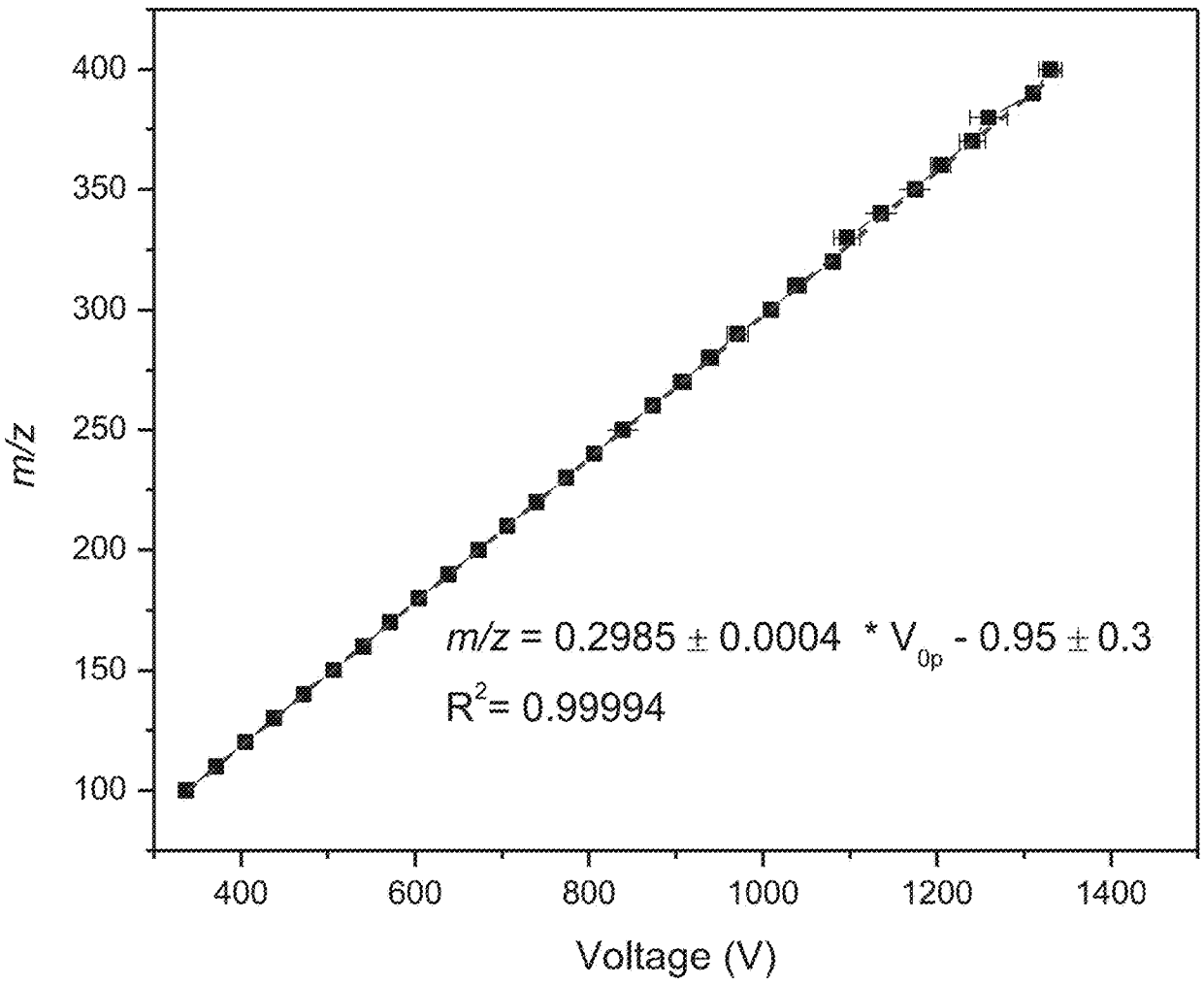
FIG. 68 shows the SIMON-simulated mass calibration curve, the mean rf amplitude and standard deviation needed to eject a particular m/z ion from the croLIT, from triplicate measurements. $A_2$ is calculated from the linear fit slope.

Experimental Design. FIG. 67 shows important voltages on the rf electrodes during the experiment. After external ion injection, the ions are held at a constant main rf amplitude for the first 280 ms (e.g. 200$V_{0p}$), and are allowed to collisionally cool with the injected helium gas pulse (5 ms duration at about 10-20 torr backing pressure). At 300 ms, the main rf is scanned from 300 to 1500 $V_{0p}$ over 200 ms, while simultaneously, a 369 kHz dipolar "tickle" excitation waveform is applied to the x-electrodes. The amplitude of this "tickle" waveform is also linearly increased (from 1 to 4 $V_{0p}$), to keep the amplitude low initially, and thus improve the resolution, while still being able to properly eject the higher m/z ions.[18] this frequency corresponds to a q-value of 0.784 and β32 2/3, and thus introduces a notch in the stability diagram. The purpose of this "tickle" waveform is at least twofold: (1) ions are selectively excited in the x plane (as opposed to the y-plane) to increase their detection efficiency through the slits in the x-electrodes to the dynode/electron multiplier detector; (2) the lower critical q value results in an extension of the m/z range. The effective scan rate is 200Th $S^{-1}$ from m/z 100 to 500.

In the $N_2$ tagging experiment, 5% nitrogen gas is added to the helium pulse, and the experiment is significantly shortened; the ions are only held at a constant rf amplitude for 100 ms, and the scan rate is increased of 4000 Th $S^{-1}$ from m/z 200 to 600, to give an overall experiment time of 200 ms.

For mas isolation, a 5 ms dipolar SWIFT waveform[9] is applied to the x-electrodes to the mass isolate the calibrant ions, while keeping the rf amplitude constant. Mass isolation windows are calculated using a custom Python program, which converts mass ranges into frequency ranges using the Mathieu equation. The frequency ranges are then converted using inverse Fourier transform procedure described by Chen et al. [23]. A frequency step size of 200 Hz is used to generate a 5 ms long SWIFT waveform. No windowing function is used as it does not significantly affect SWIFT performance.[24]

Solutions containing a mixture of L-proline (M.W.=115 Da), glutathione (M.W. 307 Da), brucine (M.W.=394 Da), and loperamide (M.W.=476 Da) (Sigma Aldrich, St. Louis, Mo.) are made at $10^{-5}$ M in a 70:30 methanol:water solution with 0.1% formic acid added into it to assist with ionization. ESI is used to protonate and nebulize the calibration solution. The solution flows to the ESI source at a flow rate of 2 microliter per minute.

Trajectory Simulations. SIMION 8.0 (Scientific Instruments Services, Inc.) is used to simulate and characterize the cryoLIT at room temperature, using a grid size of 0.1 mm to calculate the electrode potentials. For simulation, ions are initialized in a 3D Gaussian distribution at the center of the trap, and are given a kinetic energy of 25 meV (room temperature kT) with a randomized orientation. Single ions with masses between about 100 and 400 Th in steps of 10 are considered here. The ions are given 10 ma to equilibrate in the middle of the trap before the main rf is ramped form 300 to 1500 V0p, with no dipolar excitation applied. Ions' time of flights are recorded when they exit the slit of the x-electrodes to determine the ejection rf amplitude for each m/z value. The simulations are carried out until there at least 3 data points for each mass to obtain a mean and standard deviation for the ejection of rf amplitude.

Determination of $A_2$ via fitting of the multipole expansion. For a two dimensional linear ion trap, the electric potential, φ, at any point inside of the trap can be approximated by a multipole expansion (Equation 8) [47]:

$$\phi(r,\theta) = \phi_0 \sum_{n=0} \left(\frac{r}{r_N}\right)^n (A_n \cos(n\theta) + B_n \sin(n\theta)) \quad \text{Eq. 8}$$

Where r and θ are the distance and angle from the center of the trap, $r_N$ and $\varphi_0$ are the normalization radius of the trap and the field-free potential of the trap, and n is the index of multipole (i.e. quadrupole, hexapole, etc.). $A_2$ can be obtained by fitting Eq. 8 to the trap potential using the method described by Barlow [46]: Using SIMION 8.0, a set of potentials are sampled from a ring of 40 points, 1 mm away from the center of the trap. Since r is fixed at 1 mm and $r_N$ is the y-radius of the trap, 0.20" (5.08 mm), the potentials only vary as a function of θ. As an initial guess, $\varphi_0$ is estimated to be the average of the 40 potentials. Using Excel's Data Analysis Toolpak to minimize the square differences between the sampled potentials and Eq.S1, $\varphi_0$, $A_n$, and $B_n$ are found. An additional constraint can be placed by setting all $B_n$ values to 0, but this was not used in this paper. This method calculates the cryoLIT's $A_2$ to be equal to 0.866. All other calculated $A_n$ values are tabulated in Table 1.

TABLE 1

Calculated $A_n$ values for the cryoLIT using the multipole expansion fitting method.

| $A_0$ | $A_1$ | $A_2$ | $A_3$ | $A_4$ | $A_5$ | $A_6$ | $A_7$ | $A_8$ |
|---|---|---|---|---|---|---|---|---|
| 0.261 | 0.000860 | 0.866 | 0.000165 | −0.164 | −0.0370 | 0.0517 | 0.238 | 2.75 |

Calculating the thermal contraction of the radius in the cryoLIT. To calculate the change in radius in either the x or y direction of the cryoLIT, the thermal contraction, $$\frac{\Delta L}{L}, \quad \text{(Eq. 9)}$$

of both the rf electrodes and the DC endplate must be considered. The rf electrodes undergo thermal contraction, and thus increase the trap radius, $$\text{by } \frac{\Delta L}{L} * \frac{L_{rf}}{2}, \quad \text{(Eq. 10)}$$

where $L_{rf}$ is the thickness of the rf electrode in either the x or y direction; the factor of ½ comes from the fact that only the interior side of the electrode contributes to the trap radius. While the rf electrodes shrink, the DC endplate mounting holes, which keep the rf electrodes in place, contract towards the center of the trap by $$\frac{\Delta L}{L} * L_m, \quad \text{(Eq. 11)}$$

where $L_m$ is me distance from the center of the mounting hole to the center of the cryoLIT. Thus the change in the cryoLIT radius can be calculated with the following equation:

$$\Delta r = \frac{\Delta L}{L}\left(L_m - \frac{L_{rf}}{2}\right) \quad \text{Eq. 12}$$

Note, $$\frac{\Delta L}{L}$$

is a negative number, to the trap radius does in fact decrease as $L_m$ is greater than $L_{rf}$. The calculations for the change in radius in the x and y directions are shown below:

$$\left(\frac{\Delta r}{r}\right)_x = \frac{\frac{\Delta L}{L}\left(L_{m_x} - \frac{L_{rf_x}}{2}\right)}{r_x} = \frac{-0.00202 \times \left(0.353\text{ in} - \frac{0.230}{2}\text{in}\right)}{0.240\text{ in}} \times 100\% = -0.200\% \quad \text{Eq. 13}$$

$$\left(\frac{\Delta r}{r}\right)_y = \frac{\frac{\Delta L}{L}\left(L_{m_y} - \frac{L_{rf_y}}{2}\right)}{r_y} = \frac{-0.00202 \times \left(0.313\text{ in} - \frac{0.230}{2}\text{in}\right)}{0.200\text{ in}} \times 100\% = -0.200\% \quad \text{Eq. 14}$$

Figure 81:
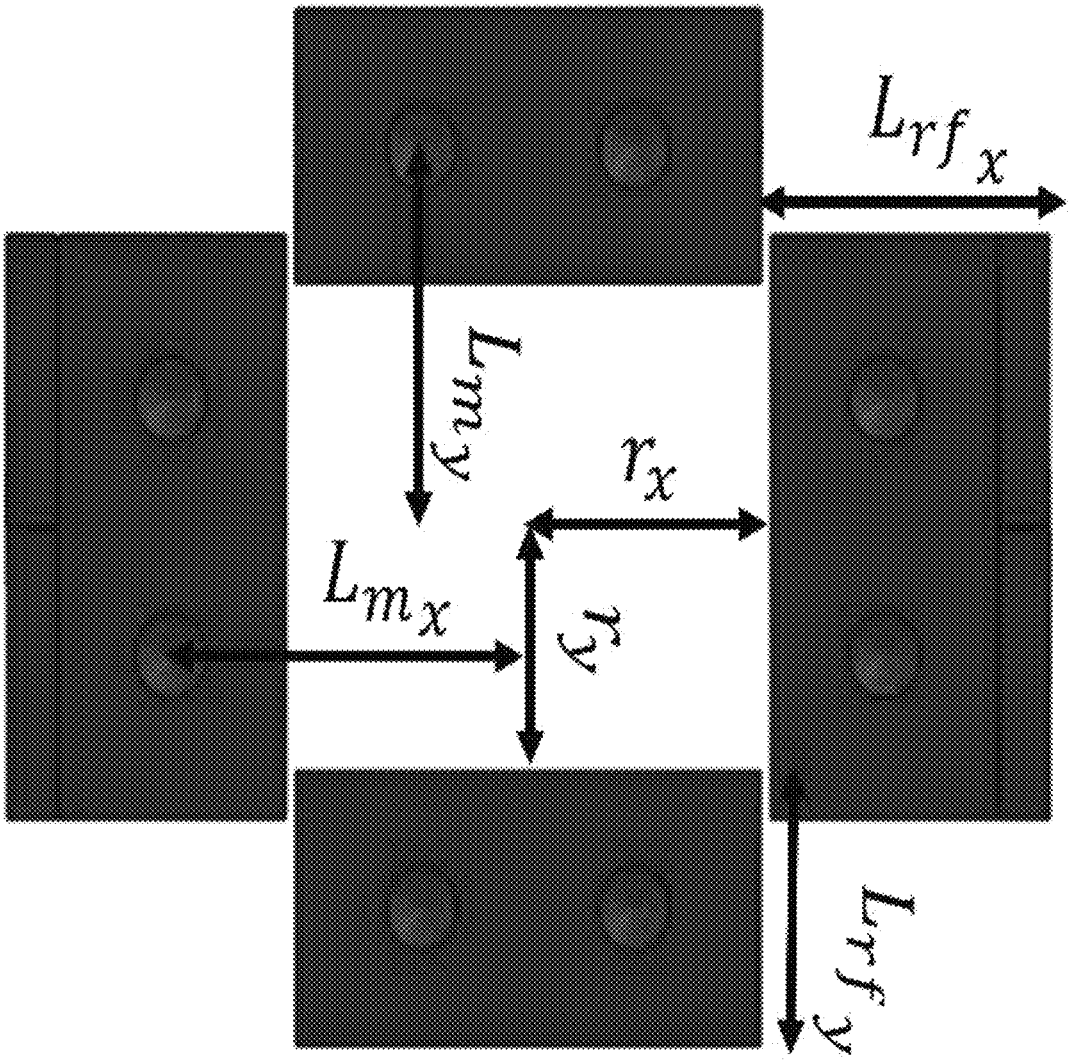
FIG. 81 shows the dimensions used in the calculation of ion trap shrinkage.

FIG. 81 shows the dimensions used in the calculation of ion trap shrinkage.

Results and Discussion

Mass Calibration of the CryoLIT at Room Temperature. The relationship between the mas-to-change ratio of the ejection ions, $$\frac{m}{z}$$

(Th) and the applied main rt, $V_{0p}$ (V) is given by Eq. 15

$$\frac{m}{z} = A_2 \frac{4eV_{0p}}{qN_a r_N^2 \Omega^2} \quad \text{Equation (15)}$$

where $A_2$ is the quadrupole coefficient (unitless) in the multipole expansion of the potential inside the trap, representing the contribution of the quadrupolar field to the potential, e is the elementary charge (in C), $N_a$ is Avogadro's number ($mol^{-1}$), q is the Mathieu parameter for the rf (unitless), Ω is the angular frequency of the rf (in rad $s^{-1}$), and rn is the normalization radius (in m), which is taken to be as half of the y-electrode spacing, $5.08\times10^{-3}$ m or 0.20 inches (as this is the smaller dimension).

In an idealized quadrupolar field $A_2$=1, and can hence be neglected. Conversely, in stretched geometries, or rectilinear ion traps, it is expected that $A_2$<1. There are various approaches to estimate $A_2$, either by simulation, where ions in a m/z range 100-400 are ejected through the x-electrodes via a mass instability scan. A best fit line of m/z vs. ejection rf amplitude $V_{0p}$ yields a slope of 0.2985. By dividing this slope by $$\frac{4e}{qN_a r_N^2 \Omega^2} \quad \text{(Eq. 16)}$$

(where q=0.908), $A_2$ is found to be equal to 0.884. An alternative approach to estimate $A_2$ theoretically involves fitting the SIMON-obtained potentials inside the trap to a multipole expansion equation[25,26], and with this method it is predicted that $A_2$ is 0.866. Experimentally, $A_2$ is estimated to be 0.867, based on a mass instability scan obtained at room temperature. Note that for the experimental result, the same equation as above is used but, as dipolar tickle excitation waveform is employed q is changed to 0.784. These experimental results are shown below (e.g. 295K data in FIG. 72).

It appears therefore that the multiple expansion equation yields the most accurate determination of $A_2$, even if there are some caveats here in terms of grid size and boundaries.

Figures 69, 70A:
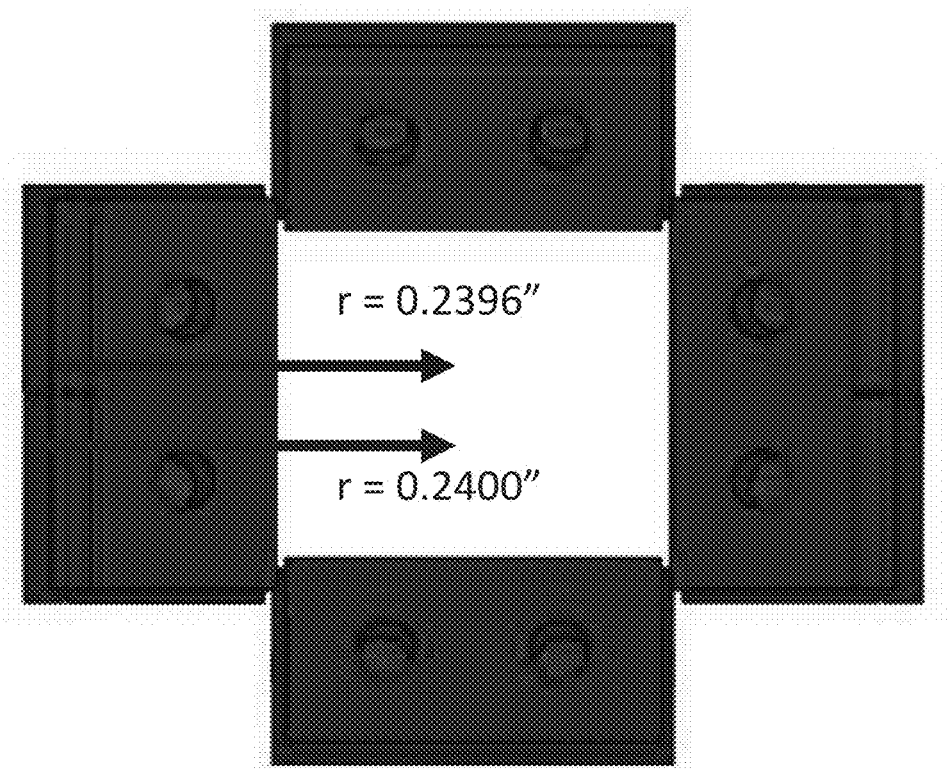
FIG. 69 shows a table demonstrating different $A_2$s.
FIGS. 70A-70B show an illustration of the thermal contraction undergone when the cryoLIt is cooled. The contraction of the mounting holes of the DC endplate (FIG. 70B), at cryogenic temperature causes the rf rods (FIG. 70A) to move inwards, decreasing the trap radius, the contraction shown here is magnified about 300 fold.

FIG. 69 contains a summary of the $A_2$ values determined for the cryoLIT, along with the simulation-derived $A_2$ values for the rectilinear ion trap designed by Cooks and Wang.[19,20] The cryoLIT features a larger $A_2$, and thus a greater quadrupolar field, than these other two traps. This may be a result of the smaller electrode gaps in the cryoLIT. In principle, a greater $A_2$ suggests a better approximation to an ideal quadrupolar ion trap. However, the higher order fields (e.g. octupolar, dodecapolar) also play an important part in improving the mass resolution during a mass instability scan by compensating for the reduction in electric field caused by the trap slits.[19]

Figure 70B:
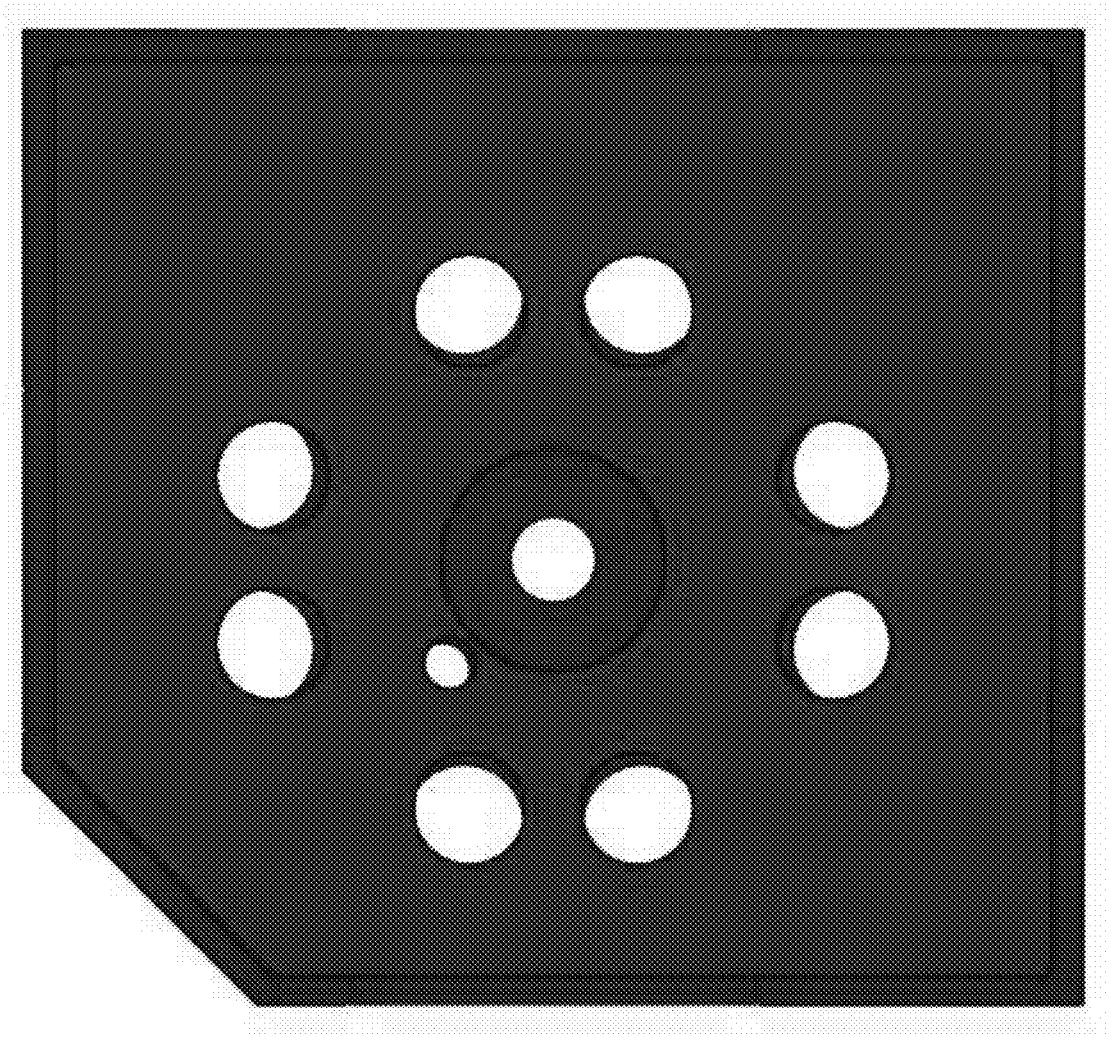
Figure 71B:
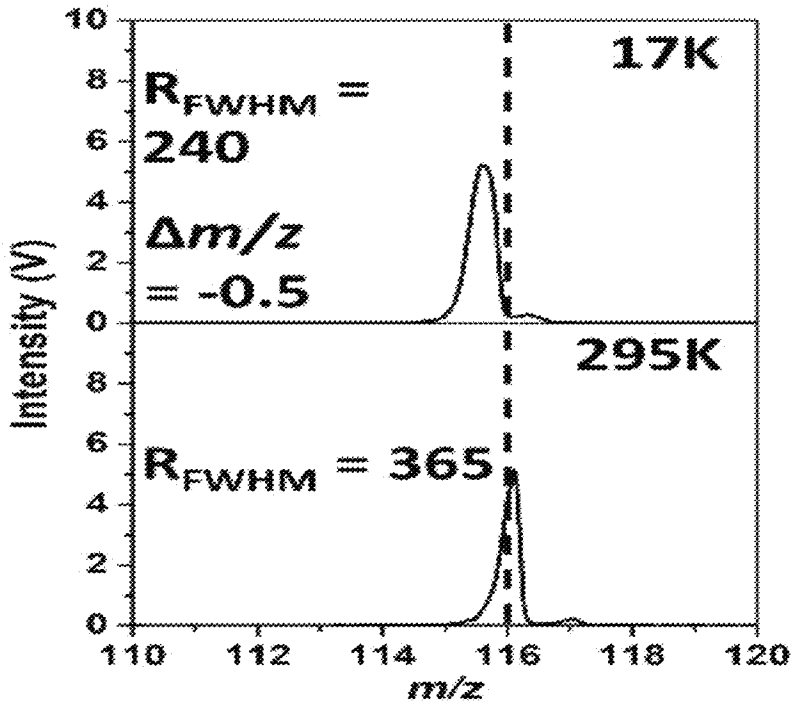
FIGS. 71A-71D shows a comparison between the room temperature (295K) (bottom spectra) and cryogenic (top mass spectra) mass spectra. The mass shift is more pronounced at higher masses as shown in the zoomed portions of the mass spectra.
Figure 71A:
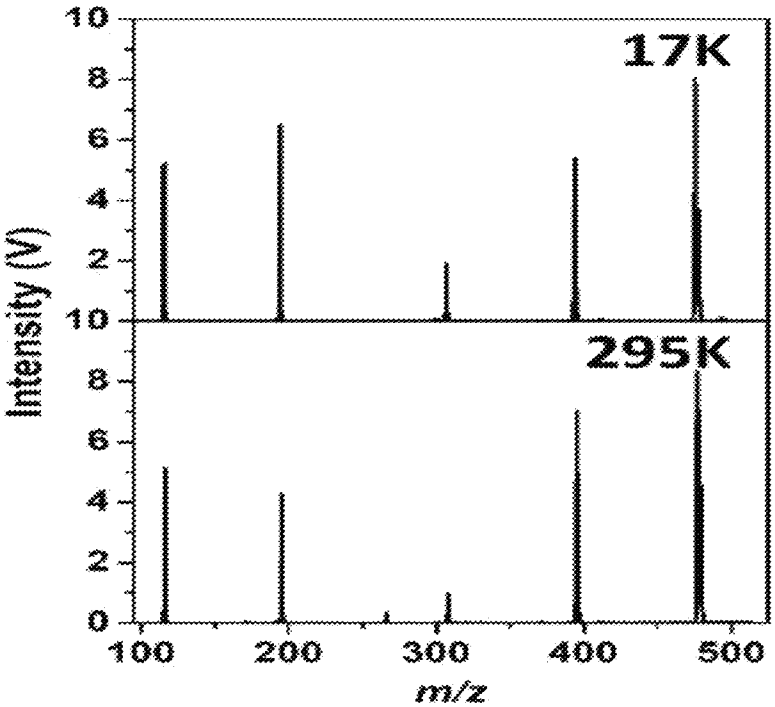
Figure 71D:
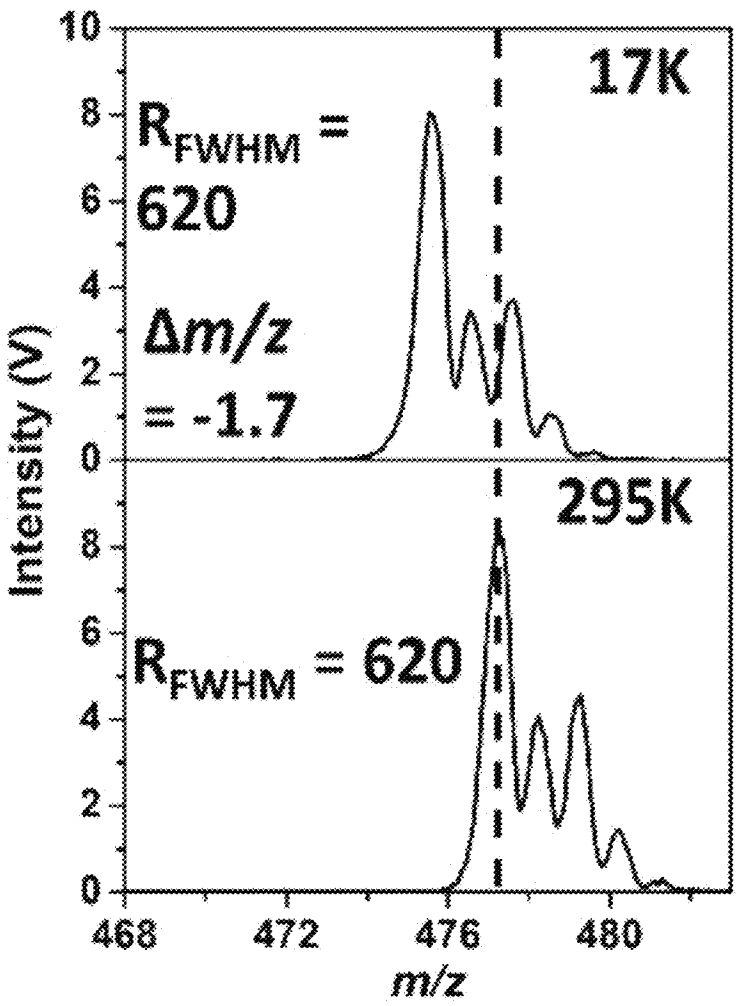
Figure 71C:
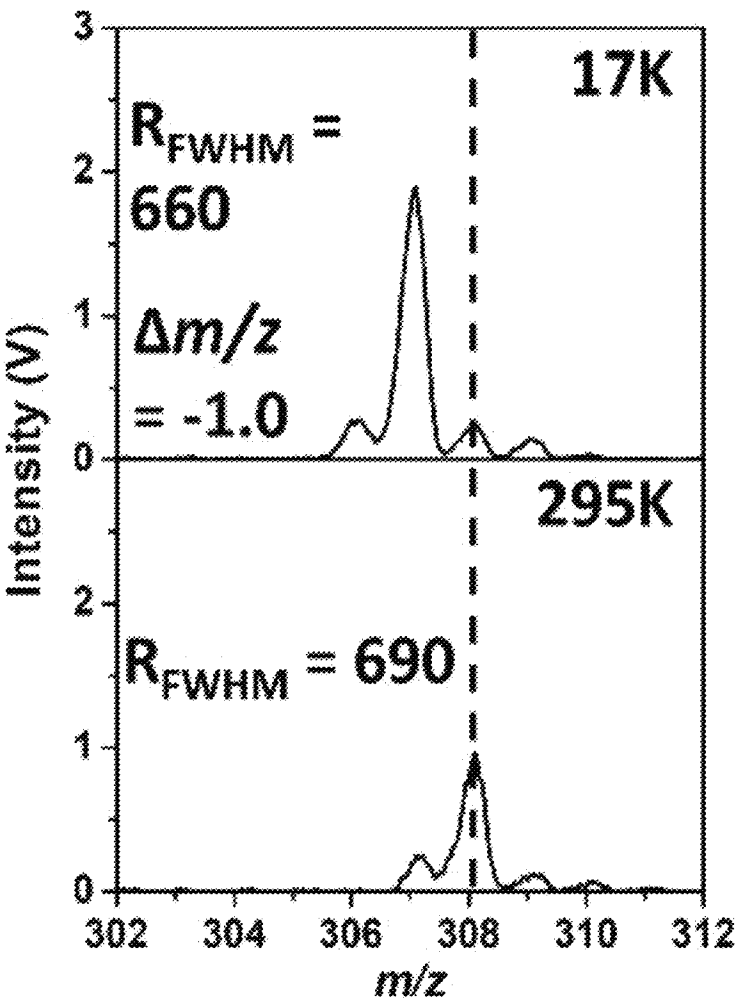

Modeling the Thermal contraction of the CryoLIT. As the temperature of the cyoLIT is brought down to cryogenic levels, the trap is expected to experience thermal contraction, which will naturally affect its performance. The cryoLIT can be cooled down to 17K, and according to the linear thermal expansion data for 17-4HP stainless steel, the electrodes are expected to contract by 0.197%.[11] If the rf electrodes did not move, the trap radius should increase as the rf electrodes contract, but since the rf electrodes are held in positon by the DC endcaps, which are larger than the rf electrodes, the overall trap radius should decrease. This is shown in FIGS. 70A-70B. By taking both the shrinking of the rf electrodes and the DC endcaps into account, the trap radius should decrease by 0.195% in the y-direction and 0.193% in the x-direction. Given that the rf voltage at which an ion of a particular mass ejects from the cryoLIT is dependent on the trap radius (Equation 15), it should be expected that if the trap radius does in fact decrease with all other parameters held constant, the observed mass spectra at cryogenic temperatures should be shifted to lower masses (with respect to calibrated room-temperature mass spectra).

Figure 72:
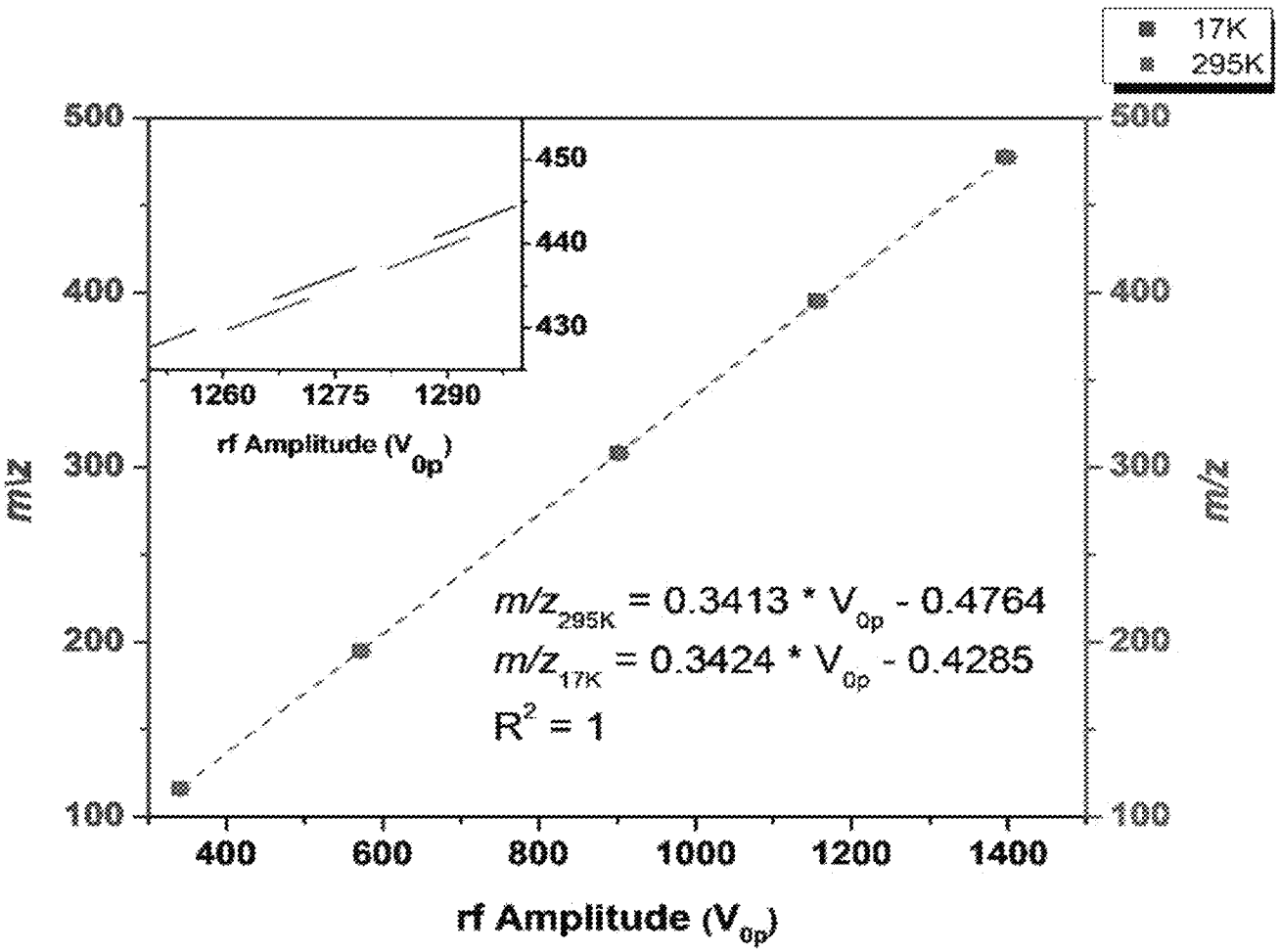
FIG. 72 shows the mass calibration lines for room (red-right y-axis) and cryogenic (blue-left y-axis) mass instability scan. The cryogenic temperature scan features a higher slope which corresponds to lower ejection voltages.
Figure 73:
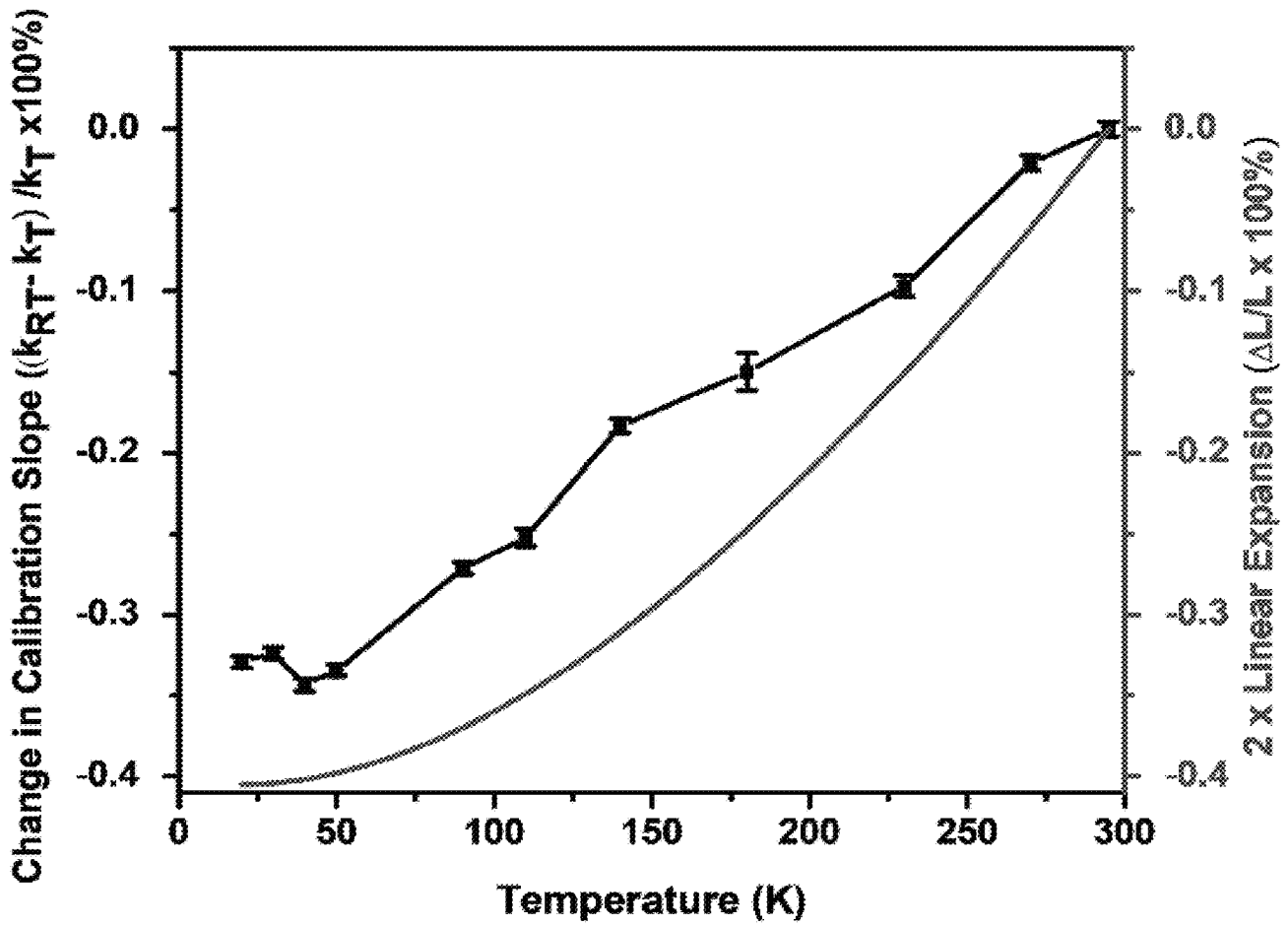
FIG. 73 shows the relative difference of calibration slopes relative to room temperature as plotted as the function of temperature (black) alongside with the thermal contraction relative to room temperature (blue), multiplied by 2.

Effect of Cold on Mass Spectra. FIGS. 71A-71D compares the mass spectra recorded at room temperature and cryogenic temperature (17K). The zoomed-in plots highlight that at cryogenic temperatures, the apparent m/z of the ions are lower with respect to the room temperature calibration. This suggests that the ejection voltages for each ion are lower at cryogenic temperature. A slight reductions in resolving power is observed when cooling the trap from 295K to 17K. FIG. 72 shows the equivalent data in FIGS. 71A-71D as a calibration slope of actual m/z vs. measured rf ejection voltage, based on a linear regression fit. For the cryogenic temperature mass spectrum, the slope is 0.35 higher than the room-temperature slope, so correspondingly, the ejection voltages are lower. If Equation 15 is looked to, it can be observed that the change in slope must be caused by a change in one of the parameters. Based on the thermal contraction of the trap, one expects a decrease in trap radius, and thus an increase in the calibration slope. To systematically determine how the temperature affects the calibration slope, mass spectra of the calibration mixture are collected at a series of temperatures. In FIG. 73, the relative differences between the cryogenic and room temperature calibration slopes, $$\frac{k_T - k_{295K}}{k_T} \quad \text{(Eq. 17)}$$

are plotted as function of temperature, and this is contrasted to the thermal expansion from the literature.[27] This relative difference expression is used, as it can be converted and simplified to an expression containing the thermal contraction, showing that the relative difference in calibration slope is equal to twice the thermal contraction (Eq. 18)

$$\frac{k_T - k_{295K}}{k_T} = \frac{\frac{1}{(r-\Delta r)^2} - \frac{1}{r^2}}{\frac{1}{(r-\Delta r)^2}} = 1 - \frac{(r-\Delta r)^2}{r^2} \approx 1 - \frac{r^2 - 2r\Delta r}{r^2} = \frac{2\Delta r}{4} \quad \text{(Equation 18)}$$

Using the thermal contraction data for 17-4HP stainless steel[27], the cryoLIT radius should shrink by 0.197%, and therefore, the relative difference in the calibration slope should be equal to 0.394%, which is a reasonable match with the maximum change in the slope of −0.344%. Furthermore, there is no measurable mass shift below 50K, which mirrors the flattening of the thermal contraction curve in that temperature range. While the general trend of the change in slopes matches the change in trap radius, the slope differences are systematically lower; this could potentially be attributed to the fact the contraction in the radius is slightly compensated by the shrinking of the rf electrodes, as discussed earlier, or there could be a change in $A_2$ that occurs during cooling.

Figure 76:
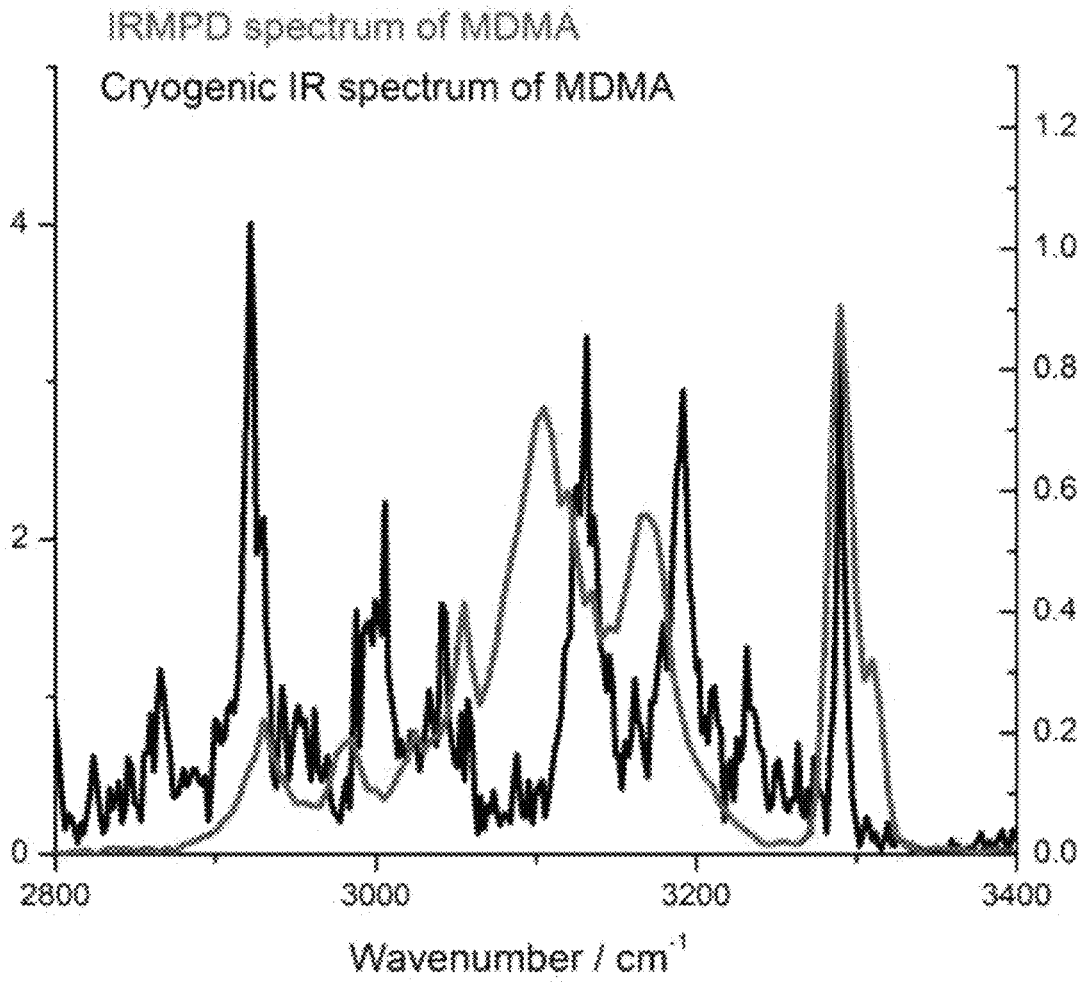
FIG. 76 shows a comparison of room-temperature IRMPD spectrum and cryogenic IR spectrum of protonated 3,4 methylenedioxymethamphetamine (MDMA).

FIG. 76 shows the comparison of IRMPD spectrum of MDMA and the cryogenic spectrum of tagged MDMA.

Interday Repeatability

After operating the cryoLIT (typically about 8 hours), it is warmed back to room temperature to get rid of adsorbed water and gasses. Repeated cooling and warming may result in accumulated geometrical changes that adversely affect the calibration of the mass spectra. To determine how repeatable the mass spectra are from day to day, the mass spectra of the calibration mixture are collected over several days, bringing the trap repeatedly back to room temperature at the end of each experiment. The average deviation of the masses over these runs at 17K is 0.04±0.03 m/z, significantly less than the mass resolution of the cryoLIT. Therefore, even with repeated temperature cycling of the cryoLIT, the mass spectra are highly reproducible.

Figures 74A, 74B:
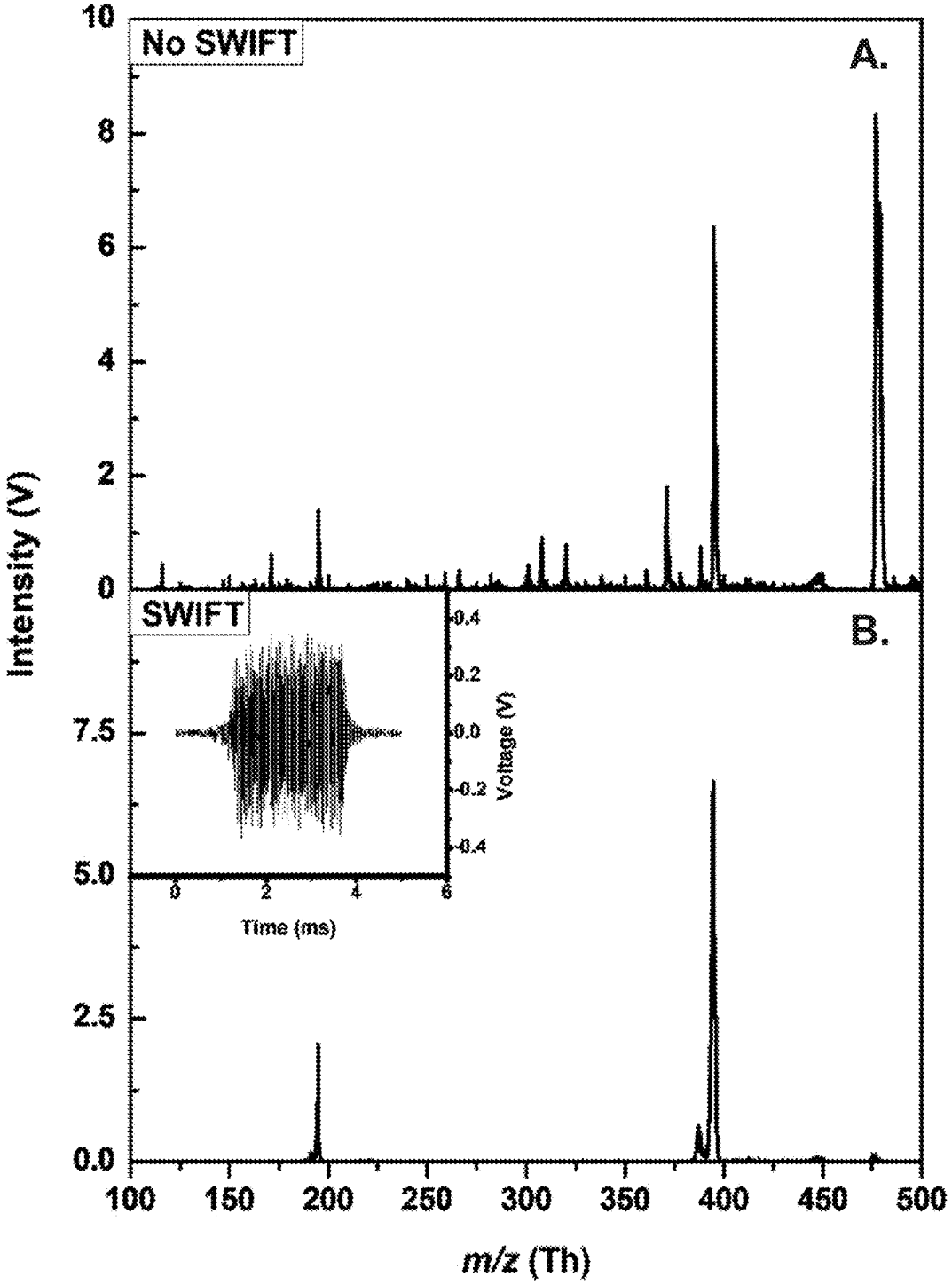
FIGS. 74A-74B shows SWIFT isolation of caffeine (m/z 195) and brucine (m/z 395) from a mixture of proline, caffeine, glutathione, brucine, and loperamide performed at 17K. The SWIFT waveform is shown on the bottom left insert.
Figures 75A, 75B:
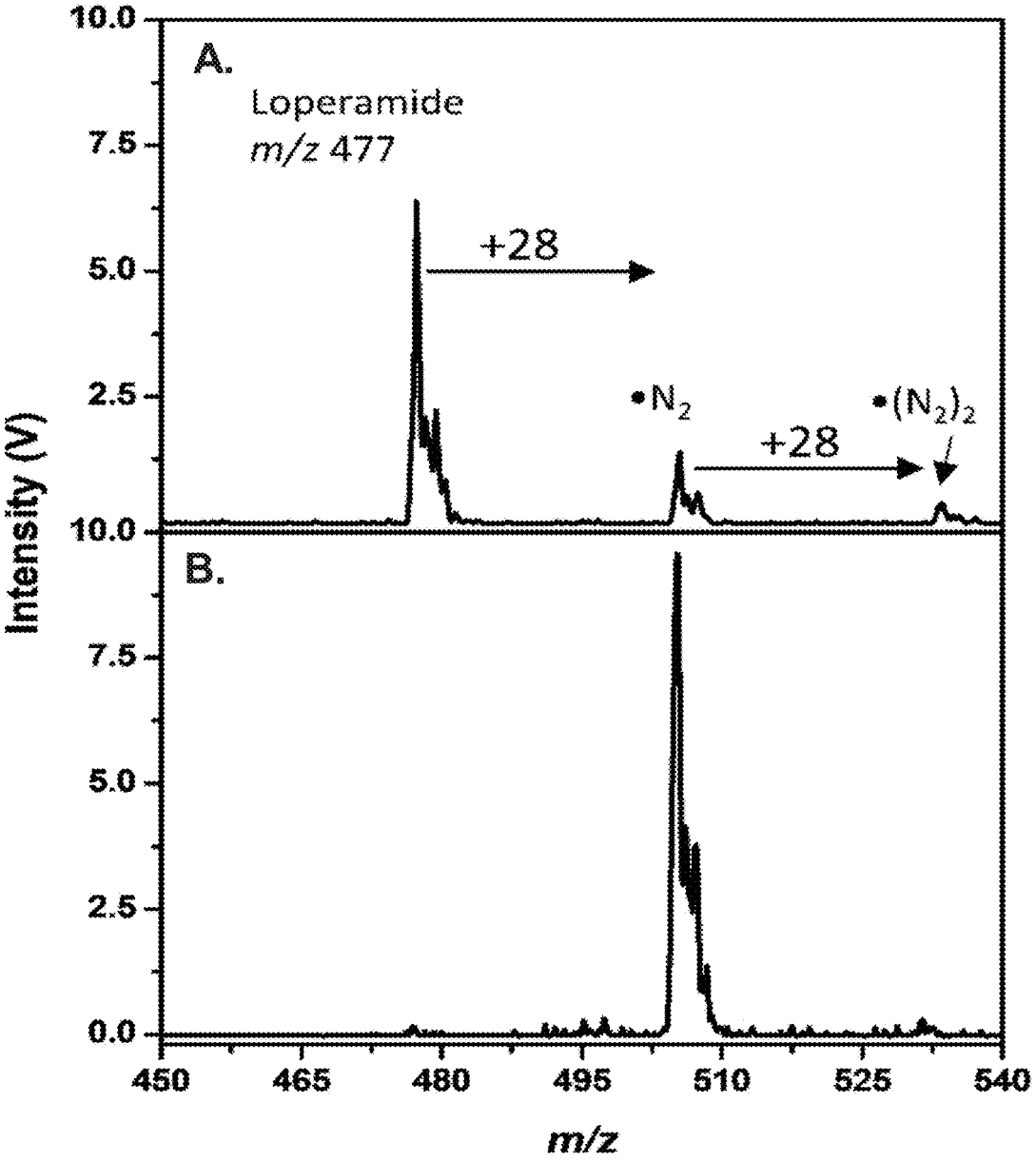
FIGS. 75A-75B shows the (FIG. 75A) mass spectrum of loperamide and its singly and doubly $N_2$-tagged ions at an electron multiplier voltage of 1.8 kV and (FIG. 75B) SWIFT-isolated mass spectrum of the singly $N_2$ tagged loperamide ion at an electron multiplier voltage of 1.9 kV.

SWIFT Mass Isolation. To perform infrared photodissociation (IRPD), the tagged analyte ions need to be isolated by ejecting the reminder of the untagged species. For a single untagged-tagged pair, this can be achieved by increasing the rf amplitude to the point where the untagged ion m/z is above the stability diagram critical value q=0.908. However, when attempting to acquire the IRPD spectra of several tagged ions simultaneously (i.e. multiplexing), this method is insufficient. SWIFT isolation waveforms can be used to isolate multiple tagged ions by using a broadband signal, which notches in the frequency spectrum for each isolated mass. FIGS. 74A-74B shows caffeine (m/z 195) and brucine (m/z 395) being isolated from the rest of the calibration mixture. There is no significant loss of intensity for a 5 ms 350 $V_{0p}$ SWIFT waveform with ±110 m/z notches, and the mass spectrum is generally low in noise; however, there is a peak at m/z 387 that is not removed, as it falls inside the mass isolation window.

Summary

In this Example it is demonstrate that the cryoLIT is mass selective in the temperature range between 17 and 298K, without any significant loss in performance. Mass shifts upon cooling can be rationalized by a thermal contraction of the trap. These shifts are reproducible on a day-to-day basis, and they can be corrected for by a simple calibration. Multiple analyte ions can be mass isolated via a SWIFT waveform, and this is a basic prerequisite for multiplexed IR spectroscopy on multiple tagged analytes, which can significantly improve throughput. When mass isolating tagged ions (e.g. loperamide•$N_2$), extra consideration must be taken when generating a SWIFT waveform. Since the tagged ions are fragile, wider notches must be employed to prevent activation the tagged ions. With a mass range of 100-800 m/z (the upper mass limit is not shown here), the cryoLIT is suitable for the study of small molecules and metabolites.

REFERENCES FOR EXAMPLE 3

1. Polfer, N. C., Oomens, J.: Vibrational spectroscopy of bare and solvated ionic complexes of biological relevance. Mass Spectrom. Rev. 28, 468-494 (2009). doi: 10.1002/mas.20215
2. Fridgen, T. D.: Infrared consequence spectroscopy of gaseous protonated and metal ion cationized complexes. Mass Spectrom. Rev. 28, 586-607 (2009). doi:10.1002/mas.20224
3. Hernandez, O., Isenberg, S., Steinmetz, V., Glish, G. L., Maitre, P.: Probing Mobility-Selected Saccharide Isomers: Selective Ion-Molecule Reactions and Wavelength-Specific IR Activation. J. Phys. Chem. A. 119, 6057-6064 (2015). doi:10.1021/jp511975f
4. Lanucara, F., Chiavarino, B., Scuderi, D., Maitre, P., Fornarini, S., Crestoni, M. E.: Kinetic control in the CID-induced elimination of H3PO4 from phosphorylated serine probed using IRMPD spectroscopy. Chem. Commun. 50, 3845-3848 (2014). doi:10.1039/C4CC00877D
5. Prell, J. S., Flick, T. G., Oomens, J., Berden, G., Williams, E. R.: Coordination of Trivalent Metal Cations to Peptides: Results from IRMPD Spectroscopy and Theory. J. Phys. Chem. A. 114, 854-860 (2010). doi:10.1021/jp909366a
6. Rizzo, T. R., Stearns, J. A., Boyarkin, O. V.: Spectroscopic studies of cold, gas-phase biomolecular ions. Int. Rev. Phys. Chem. 28, 481-515 (2009). doi:10.1080/01442350903069931
7. Okumura, M., Yeh, L. I., Myers, J. D., Lee, Y. T.: Infrared spectra of the cluster ions H7O+3.H2 and H9O+4.H2. J. Chem. Phys. 85, 2328-2329 (1986). doi:10.1063/1.451079
8. Robertson, W. H., Kelley, J. A., Johnson, M. A.: A pulsed supersonic entrainment reactor for the rational preparation of cold ionic complexes. Rev. Sci. Instrum. 71, 4431-4434 (2000). doi:10.1063/1.1326931
9. Wang, X.-B., Wang, L.-S.: Development of a low-temperature photoelectron spectroscopy instrument using an electrospray ion source and a cryogenically controlled ion trap. Rev. Sci. Instrum. 79, 073108 (2008). doi:10.1063/1.2957610
10. Gunther, A., Nieto, P., Muller, D., Sheldrick, A., Gerlich, D., Dopfer, O.: BerlinTrap: A new cryogenic 22-pole ion trap spectrometer. J. Mol. Spectrosc. 332, 8-15 (2017). doi:10.1016/j.jms.2016.08.017
11. Fanghänel, S., Asvany, O., Schlemmer, S.: Optimization of RF multipole ion trap geometries. J. Mol. Spectrosc. 332, 124-133 (2017). doi:10.1016/j.jms.2016.12.003
12. Roithová, J., Gray, A., Andris, E., Jašik, J., Gerlich, D.: Helium Tagging Infrared Photodissociation Spectroscopy of Reactive Ions. Acc. Chem. Res. 49, 223-230 (2016). doi: 10.1021/acs.accounts.5b00489

13. Jašik, J., Roithová, J.: Infrared spectroscopy of CHCl2+ molecular dications. Int. J. Mass Spectrom. 377, 109-115 (2015). doi:10.1016/j.ijms.2014.07.001

14. Kamrath, M. Z., Relph, R. A., Guasco, T. L., Leavitt, C. M., Johnson, M. A.: Vibrational predissociation spectroscopy of the H2-tagged mono- and dicarboxylate anions of dodecanedioic acid. Int. J. Mass Spectrom. 300, 91-98 (2011). doi:10.1016/j.ijms.2010.10.021

15. Masson, A., Kamrath, M. Z., Perez, M. A. S., Glover, M. S., Rothlisberger, U., Clemmer, D. E., Rizzo, T. R.: Infrared Spectroscopy of Mobility-Selected H+-Gly-Pro-Gly-Gly (GPGG). J. Am. Soc. Mass Spectrom. 26, 1444-1454 (2015). doi:10.1007/s13361-015-1172-4

16. Leavitt, C. M., Wolk, A. B., Fournier, J. A., Kamrath, M. Z., Garand, E., Van Stipdonk, M. J., Johnson, M. A.: Isomer-Specific IR-IR Double Resonance Spectroscopy of D2-Tagged Protonated Dipeptides Prepared in a Cryogenic Ion Trap. J. Phys. Chem. Lett. 3, 1099-1105 (2012). doi:10.1021/jz3003074

17. Marsh, B. M., Voss, J. M., Garand, E.: A dual cryogenic ion trap spectrometer for the formation and characterization of solvated ionic clusters. J. Chem. Phys. 143, 204201 (2015). doi:10.1063/1.4936360

18. Masellis, C., Khanal, N., Kamrath, M. Z., Clemmer, D. E., Rizzo, T. R.: Cryogenic Vibrational Spectroscopy Provides Unique Fingerprints for Glycan Identification. J. Am. Soc. Mass Spectrom. 28, 2217-2222 (2017). doi: 10.1007/s13361-017-1728-6

19. Andrei, H.-S., Solcà, N., Dopfer, O.: Interaction of Ionic Biomolecular Building Blocks with Nonpolar Solvents: Acidity of the Imidazole Cation (Im+) Probed by IR Spectra of Im+-Ln Complexes (L=Ar, N2; n≤3). J. Phys. Chem. A. 109, 3598-3607 (2005). doi:10.1021/jp0441487

20. Kamrath, M. Z., Garand, E., Jordan, P. A., Leavitt, C. M., Wolk, A. B., Van Stipdonk, M. J., Miller, S. J., Johnson, M. A.: Vibrational Characterization of Simple Peptides Using Cryogenic Infrared Photodissociation of H2-Tagged, Mass-Selected Ions. J. Am. Chem. Soc. 133, 6440-6448 (2011). doi:10.1021/ja200849g 21. Goebbert, D. J., Wende, T., Bergmann, R., Meijer, G., Asmis, K. R.: Messenger-Tagging Electrosprayed Ions: Vibrational Spectroscopy of Suberate Dianions. J. Phys. Chem. A. 113, 5874-5880 (2009). doi:10.1021/jp809390x 22. Dillinger, S., Klein, M. P., Steiner, A., McDonald, D. C., Duncan, M. A., Kappes, M. M., Niedner-Schatteburg, G.: Cryo IR Spectroscopy of N2 and H2 on Ru8+: The Effect of N2 on the H-Migration. J. Phys. Chem. Lett. 9, 914-918 (2018). doi:10.1021/acs.jpclett.8b00093

23. Duffy, E. M., Marsh, B. M., Voss, J. M., Garand, E.: Characterization of the Oxygen Binding Motif in a Ruthenium Water Oxidation Catalyst by Vibrational Spectroscopy. Angew. Chem. Int. Ed Engl. 55, 4079-4082 (2016). doi:10.1002/anie.201600350

24. Burke, N. L., Redwine, J. G., Dean, J. C., McLuckey, S. A., Zwier, T. S.: UV and IR spectroscopy of cold protonated leucine enkephalin. Int. J. Mass Spectrom. 378, 196-205 (2015). doi:10.1016/j.ijms.2014.08.012

25. Mohrbach, J., Lang, J., Dillinger, S., Prosenc, M., Braunstein, P., Niedner-Schatteburg, G.: Vibrational fingerprints of a tetranuclear cobalt carbonyl cluster within a cryo tandem ion trap. J. Mol. Spectrosc. 332, 103-108 (2017). doi:10.1016/j.jms.2016.11.008

26. Thompson, M. C., Ramsay, J., Weber, J. M.: Solvent-Driven Reductive Activation of CO2 by Bismuth: Switching from Metalloformate Complexes to Oxalate Products. Angew. Chem. Int. Ed. 55, 15171-15174 (2016). doi: 10.1002/anie.201607445

27. Martens, J., Koppen, V., Berden, G., Cuyckens, F., Oomens, J.: Combined Liquid Chromatography-Infrared Ion Spectroscopy for Identification of Regioisomeric Drug Metabolites. Anal. Chem. 89, 4359-4362 (2017). doi:10.1021/acs.analchem.7b00577

28. Gorlova, O., Colvin, S. M., Brathwaite, A., Menges, F. S., Craig, S. M., Miller, S. J., Johnson, M. A.: Identification and Partial Structural Characterization of Mass Isolated Valsartan and Its Metabolite with Messenger Tagging Vibrational Spectroscopy. J. Am. Soc. Mass Spectrom. 28, 2414-2422 (2017). doi:10.1007/s13361-017-1767-z 29. Patrick, A. L., Stedwell, C. N., Polfer, N. C.: Differentiating Sulfopeptide and Phosphopeptide Ions via Resonant Infrared Photodissociation. Anal. Chem. 86, 5547-5552 (2014). doi:10.1021/ac500992f 30. Schindler, B., Barnes, L., Renois, G., Gray, C., Chambert, S., Fort, S., Flitsch, S., Loison, C., Allouche, A.-R., Compagnon, I.: Anomeric memory of the glycosidic bond upon fragmentation and its consequences for carbohydrate sequencing. Nat. Commun. 8, 973 (2017). doi: 10.1038/s41467-017-01179-y 31. Cismesia, A. P., Bell, M. R., Tesler, L. F., Alves, M., Polfer, N. C.: Infrared ion spectroscopy: an analytical tool for the study of metabolites. Analyst. 143, 1615-1623 (2018). doi: 10.1039/C8AN00087E 32. Seo, J., Hoffmann, W., Warnke, S., Huang, X., Gewinner, S., Schöllkopf, W., Bowers, M. T., Heiden, G. von, Pagel, K.: An infrared spectroscopy approach to follow β-sheet formation in peptide amyloid assemblies. Nat. Chem. 9, 39-44 (2017). doi:10.1038/nchem.2615

33. Kopysov, V., Makarov, A., Boyarkin, O. V.: Identification of Isomeric Ephedrines by Cold Ion UV Spectroscopy: Toward Practical Implementation. Anal. Chem. 89, 544-547 (2017). doi:10.1021/acs.analchem.6b04182

34. Cismesia, A. P., Bailey, L. S., Bell, M. R., Tesler, L. F., Polfer, N. C.: Making Mass Spectrometry See the Light: The Promises and Challenges of Cryogenic Infrared Ion Spectroscopy as a Bioanalytical Technique. J. Am. Soc. Mass Spectrom. 27, 757-766 (2016). doi:10.1007/s13361-016-1366-4

35. Meyer, J., Tombers, M., van Wüllen, C., Niedner-Schatteburg, G., Peredkov, S., Eberhardt, W., Neeb, M., Palutke, S., Martins, M., Wurth, W.: The spin and orbital contributions to the total magnetic moments of free Fe, Co, and Ni clusters. J. Chem. Phys. 143, 104302 (2015). doi:10.1063/1.4929482

36. Wong, R. L., Paech, K., Williams, E. R.: Blackbody infrared radiative dissociation at low temperature: hydration of X2+(H2O)n, for X=Mg, Ca. Int. J. Mass Spectrom. 232, 59-66 (2004). doi:10.1016/j.ijms.2003.11.008

37. Fourier transform ion cyclotron resonance mass spectrometry: A primer-Marshall-1998 Mass Spectrometry Reviews-Wiley Online Library, https://onlinelibrary.wiley.com/doi/abs/10.1002/%28SICI%291098-2787%281998%2917%3A1%3C1%3A%3AAID-MAS1%3E3.0.CO%3B2-K 38. Cismesia, A. P., Tesler, L. F., Bell, M. R., Bailey, L. S., Polfer, N. C.: Infrared ion spectroscopy inside a mass-selective cryogenic 2D linear ion trap. J. Mass Spectrom. 52, 720-727 (2017). doi:10.1002/jms.3975

39. Schwartz, J. C., Senko, M. W., Syka, J. E. P.: A two-dimensional quadrupole ion trap mass spectrometer. J. Am. Soc. Mass Spectrom. 13, 659-669 (2002). doi:Pii S1044-0305(02)00384-7 Doi 10.1016/S1044-0305(02)00384-7

40. Ouyang, Z., Wu, G., Song, Y., Li, H., Plass, W. R., Cooks, R. G.: Rectilinear Ion Trap: Concepts, Calculations, and Analytical Performance of a New Mass Analyzer. Anal. Chem. 76, 4595-4605 (2004). doi:10.1021/ac049420n 41. Wang, L., Xu, F. X., Dai, X. H., Fang, X., Ding, C. F.: Development and Investigation of a Mesh-Electrode Linear Ion Trap (ME-LIT) Mass Analyzer. J. Am. Soc. Mass Spectrom. 25, 548-555 (2014). doi:10.1007/s13361-013-0803-x 42. Quarmby, S. T., Yost, R. A.: Fundamental studies of ion injection and trapping of electrosprayed ions on a quadrupole ion trap22Dedicated to J. F. J. Todd and R. E. March in recognition of their original contributions to quadrupole ion trap mass spectrometry. Int. J. Mass Spectrom. 190-191, 81-102 (1999). doi:10.1016/51387-3806(98)14268-9

43. Gulyuz, K., Stedwell, C. N., Wang, D., Polfer, N. C.: Hybrid quadrupole mass filter/quadrupole ion trap/time-of-flight-mass spectrometer for infrared multiple photon dissociation spectroscopy of mass-selected ions. Rev. Sci. Instrum. 82, 054101 (2011). doi:doi:http://dx.doi.org/10.1063/1.3585982

44. Chen, L., Wang, T. C., Ricca, T. L., Marshall, A. G.: Phase-modulated stored waveform inverse Fourier transform excitation for trapped ion mass spectrometry. Anal. Chem. 59, 449-54 (1987)

45. Soni, M. H., Cooks, R. G.: Selective Injection and Isolation of Ions in Quadrupole Ion Trap Mass Spectrometry Using Notched Waveforms Created Using the Inverse Fourier Transform. Anal. Chem. 66, 2488-2496 (1994). doi:10.1021/ac00087a013

46. Barlow, S. E., Taylor, A. E., Swanson, K.: Determination of analytic potentials from finite element computations. Int. J. Mass Spectrom. Ion Process. 207, 19-29 (2001). doi:Doi 10.1016/S1387-3806(00)00452-8

47. Krishnaveni, A., Verma, N. K., Menon, A. G., Mohanty, A. K.: Numerical observation of preferred directionality in ion ejection from stretched rectilinear ion traps. Int. J. Mass Spectrom. Ion Process. 275, 11-20 (2008). doi:10.1016/j.ijms.2008.05.011

48. Schwartzberg, F. R., Osgood, S. H., Keys, R. D., Kiefer, T. F., MARTIN CO DENVER CO.: CRYOGENIC MATERIALS DATA HANDBOOK. Defense Technical Information Center, Ft. Belvoir (1964)

49. Ishiuchi, S., Wako, H., Kato, D., Fujii, M.: High-cooling-efficiency cryogenic quadrupole ion trap and UV-UV hole burning spectroscopy of protonated tyrosine. J. Mol. Spectrosc. 332, 45-51 (2017). doi:10.1016/j.jms.2016.10.011

Example 4

Figure 77:
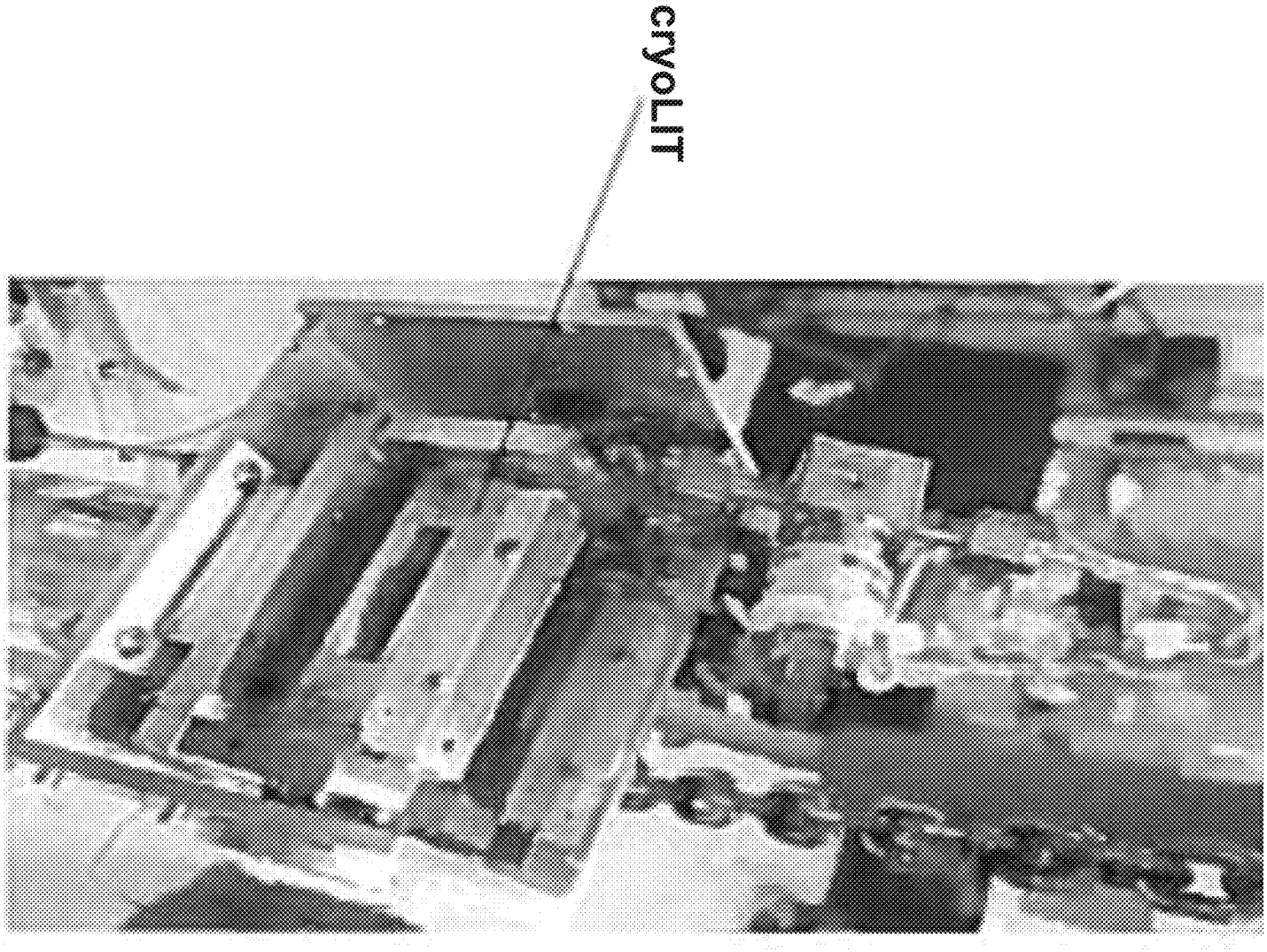
FIG. 77 shows a photographic image of a copper cryoLIT.
Figure 78A:
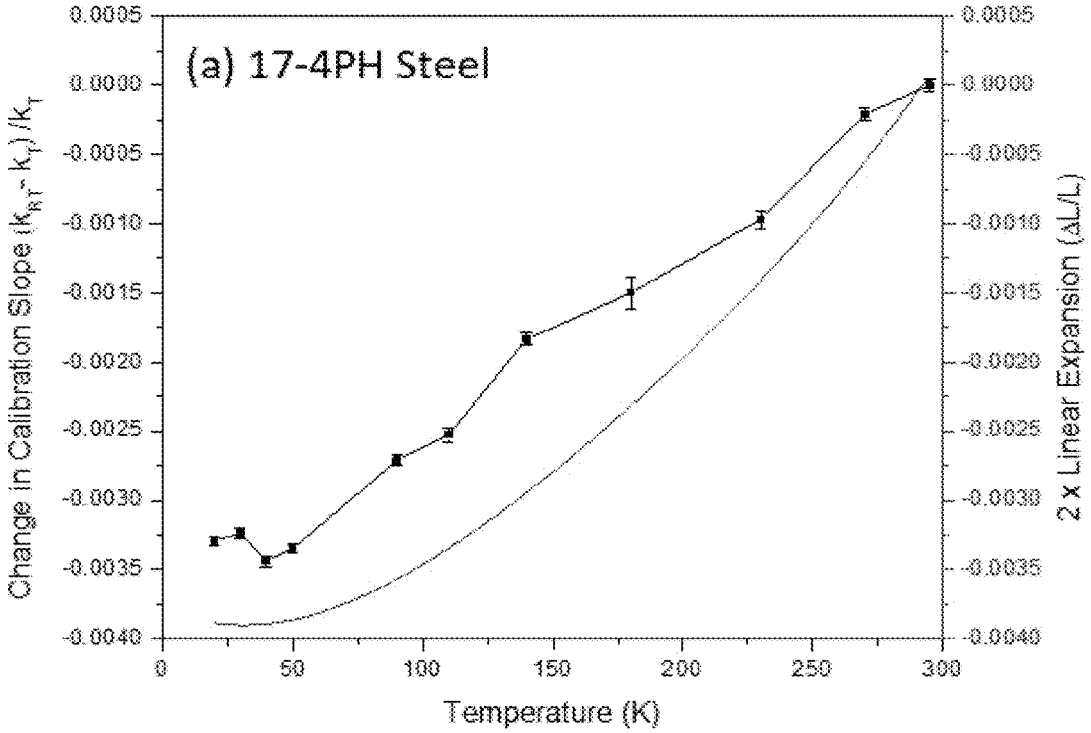
FIGS. 78A-78B show a comparison of the performance of a cryoLIT made out of 17-4PH stainless steel (FIG. 78A) and OFHC copper (FIG. 78B). When operating the cryoLIT at different temperatures, a progressive mass shift is observed (expressed as a relative change in the mass calibration slope). A change in the mass calibration between the two metal types can be rationalized by the contraction of the metal.
Figure 78B:
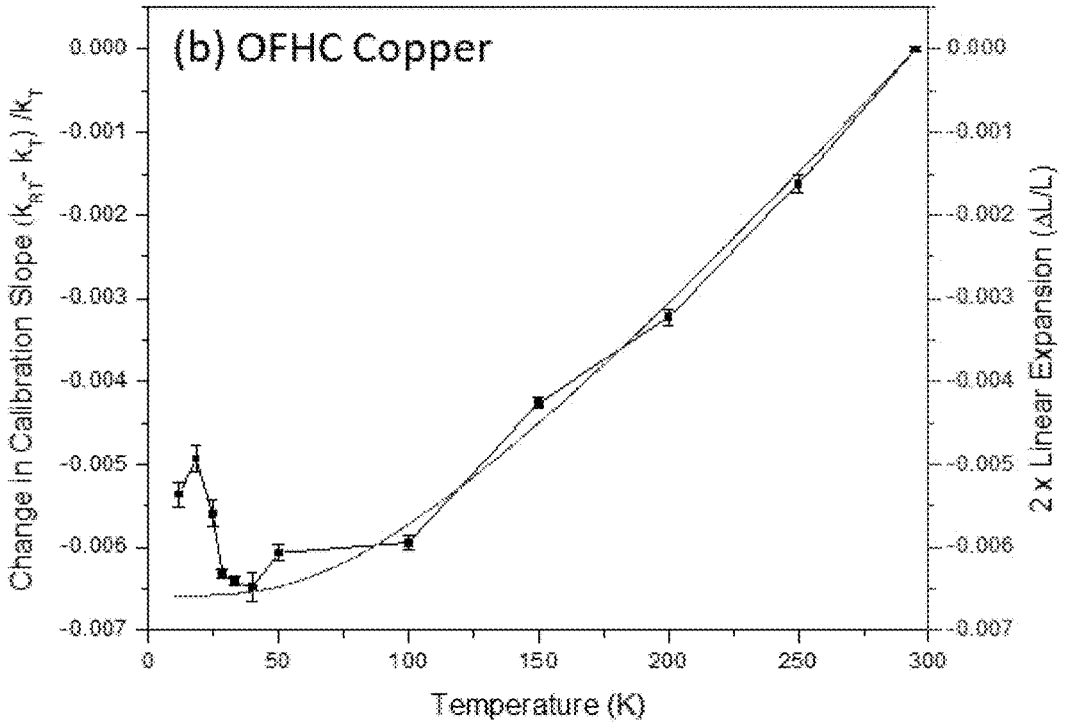
Figure 79A:
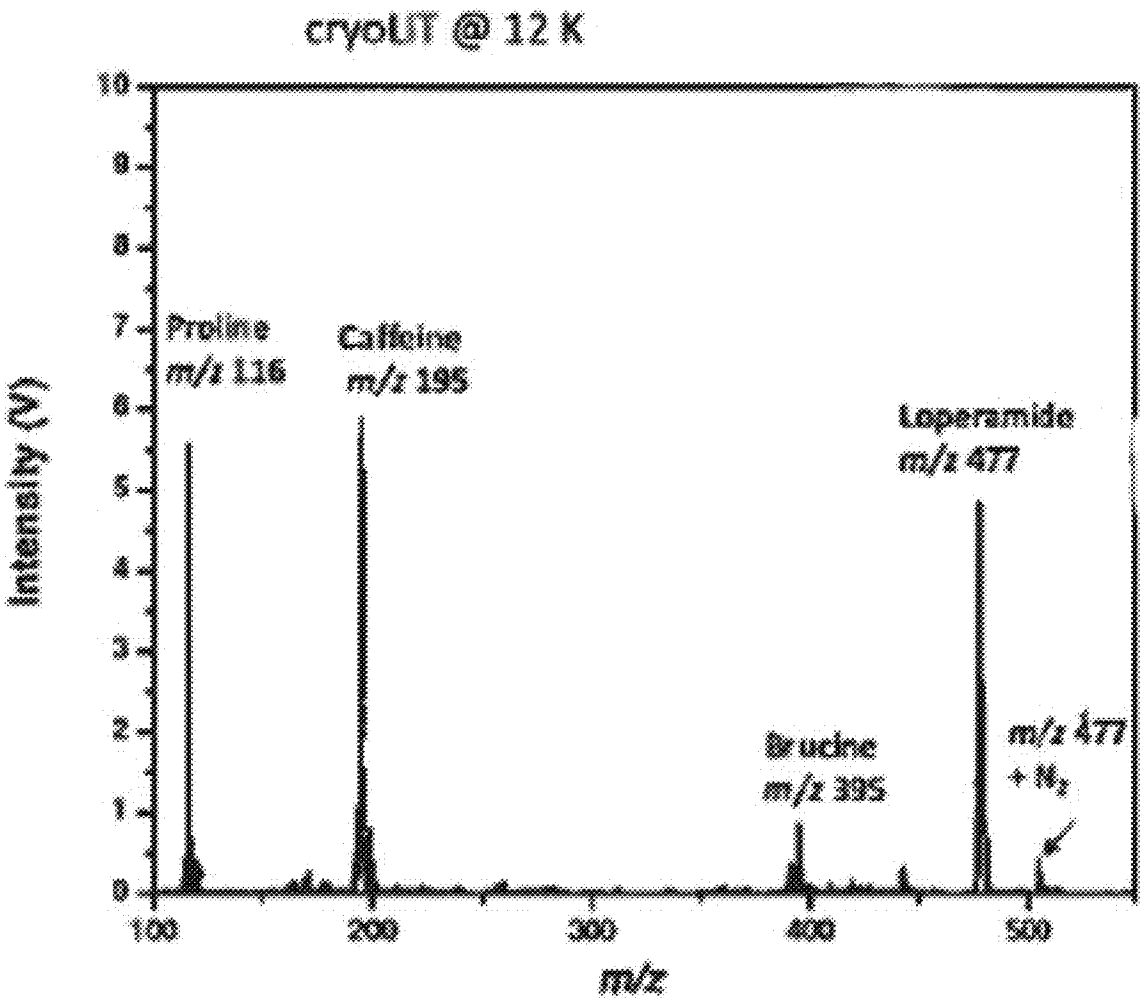
FIGS. 79A-79B show the spectra produced (FIG. 79A) and mass range (FIG. 79 B) of a copper cryoLIT operated at 12K.
Figure 79B:
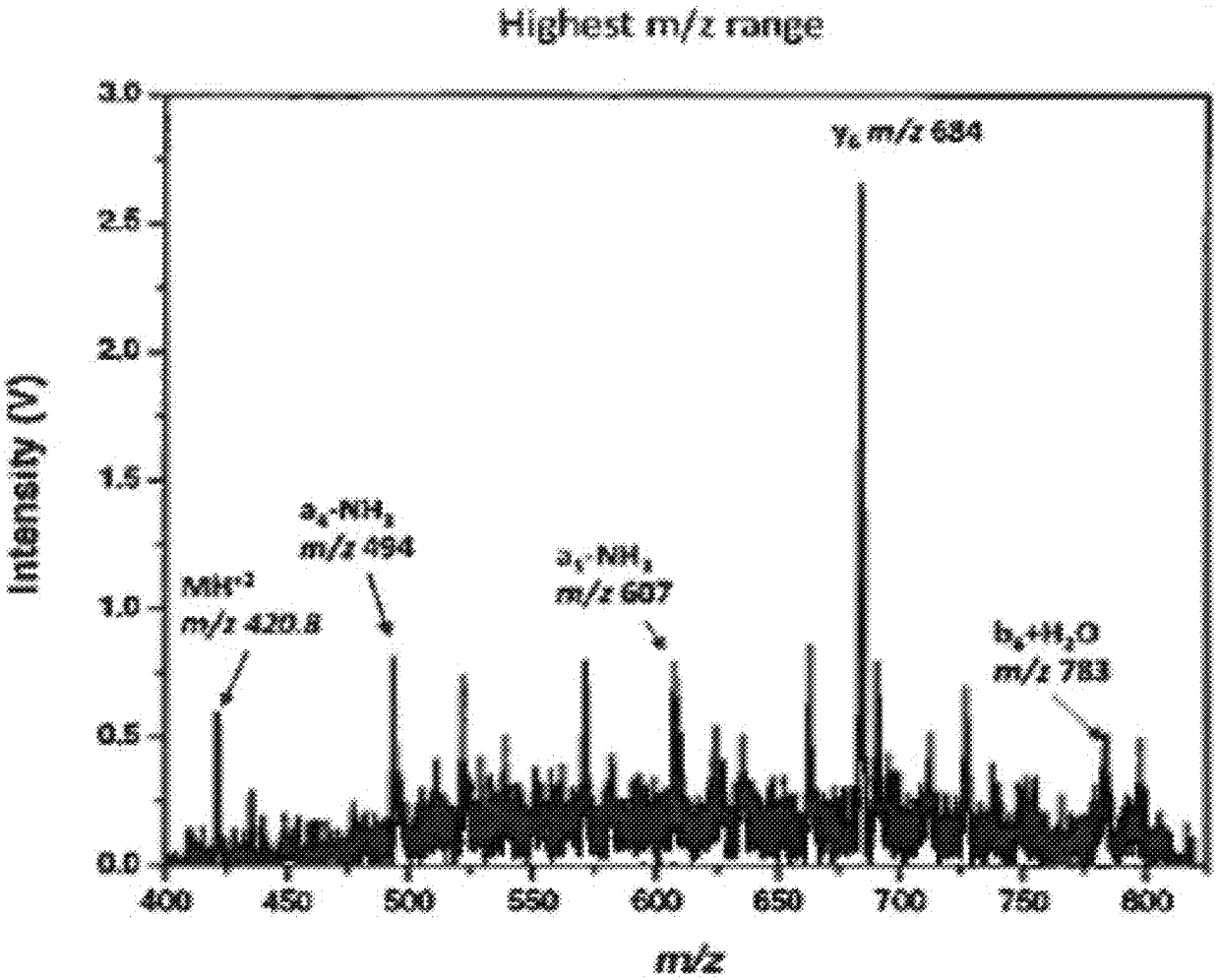
Figures 80A, 80B:
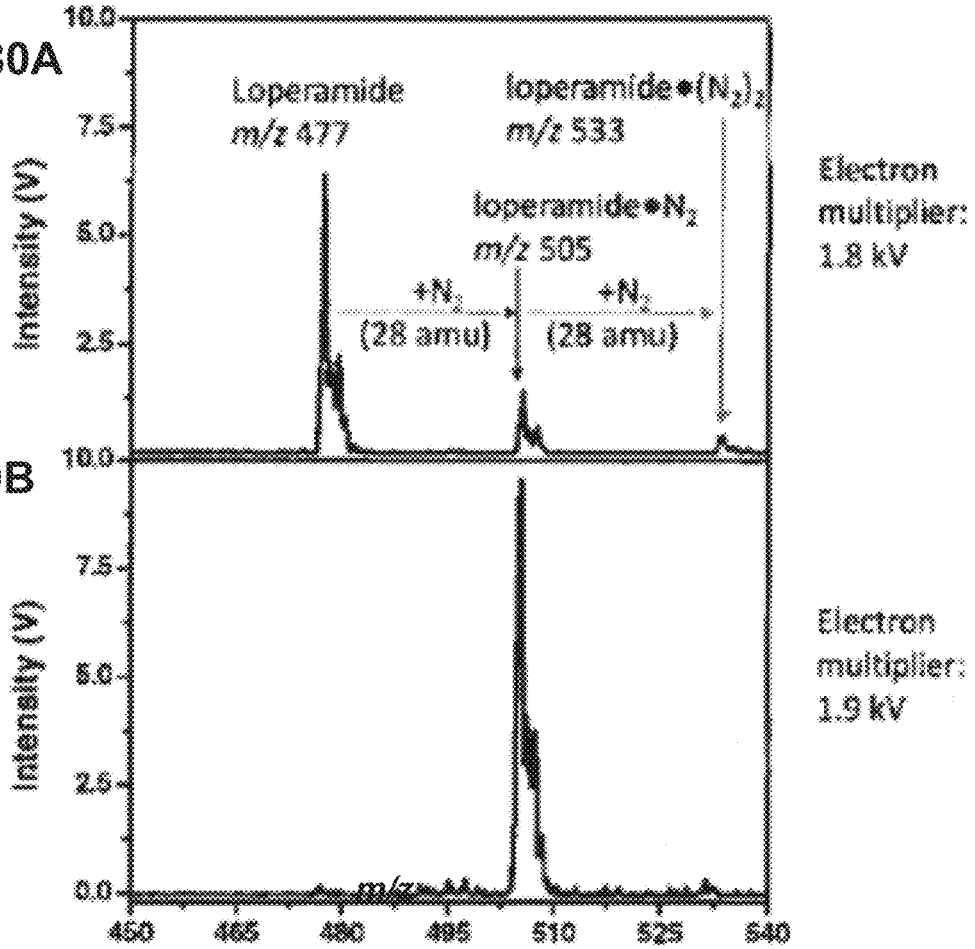
FIGS. 80A-80B show the mass spectrum of bare loperamide and singly-tagged loperamide•$N_2$.

The cryoLIT described in Examples 1-3 was further modified using OFHC copper as opposed to 17-4PH steel and including insulating spacers between the RF electrodes. The performance of modified cryoLIT was examined and the two were then compared. Insulating spacers made of an insulating material (Kel-F) were placed at the ends of the top and bottom RF electrodes (see e.g. FIG. 77). The inclusion of copper and insulting material between the electrodes was observed to increase performance of the cryoLIT. Results are shown in FIGS. 78-78B, 79A-79B and 80A-80B. The change in the mass calibration can be rationalized by the contraction of the metal (i.e. negative expansion). The modified cyroLIT could be operated at a lower cryogenic temperature (down to about 12K). Thus the cryoLIT can be suitable for use with other tag molecules such as $H_2/D_2$ and Ne. The modified cryoLIT had better shielding of the rf electrodes sharp edges and can allow for an extended mass range to m/z of 850.

We claim:

1. A rectilinear ion trap comprising:

spaced x and y pairs of flat RF electrodes disposed in the zx and zy plane to define a trap volume, wherein each of the x flat RF electrodes comprise a slit;

a pair of DC plates, wherein the DC plates are coupled to the x and y pairs of flat RF electrodes, wherein the DC plates are disposed in the xy plane, and wherein each DC plate comprises holes configured to receive a fastener;

a base plate, wherein the base pate is coupled to the DC plates, wherein the base plate is positioned on top of the spaced x and y pairs of flat RF electrodes, and wherein the base plate is disposed of in the zy plane, wherein the base plate is parallel to the Y pair of flat RF electrodes, and wherein the base plate comprises holes to receive a fastener, sapphire spacers, wherein the sapphire spacers have two holes configured to receive a fastener, wherein the sapphire spacers are placed between the base plate and the DC plate, wherein the sapphire spacers are placed between the DC plates and the ends of the x and y flat RF electrodes; and fasteners, wherein the fasteners are passed through the holes in the DC plates, base plates, x and y flat RF electrodes and sapphire spacers.

2. The rectilinear ion trap of claim 1, wherein the rectilinear ion trap is configured to operate a cryogenic temperatures.

3. The rectilinear ion trap of claim 1, further comprising insulating spacers, wherein the insulating spacers are positioned between the ends of the x and y RF electrodes.

4. The rectilinear ion trap of claim 3, wherein the insulating spacers comprise a Kel-F, PEEK, or Teflon insulating material.

5. The rectilinear ion trap of claim 1, wherein one or more components of the rectilinear ion trap comprises stainless steel.

6. The rectilinear ion trap of claim 5, wherein the rectilinear ion trap is configured to operate at cryogenic temperatures.

7. The rectilinear ion trap of claim 5, wherein one or more components of the rectilinear ion trap comprises copper.

8. The rectilinear ion trap of claim 7, wherein the rectilinear trap is configured to operate at cryogenic temperatures down to about 12K.

9. The rectilinear ion trap of claim 1, wherein one or more components of the rectilinear ion trap comprises copper.

10. The rectilinear ion trap of claim 9, further comprising insulating spacers, wherein the insulating spacers are positioned between the ends of the x and y RF electrodes.

11. The rectilinear ion trap of claim 10, wherein the rectilinear ion trap is configured to operate at cryogenic temperatures down to about 12K.

12. The rectilinear ion trap of claim 1, wherein the rectilinear ion trap is configured to perform mass selection of ions and infrared mass spectra analysis inside the rectilinear ion trap.

13. A mass spectrometer comprising:

a rectilinear ion trap comprising:

spaced x and y pairs of flat RF electrodes disposed in the zx and zy plane to define a trap volume, wherein each of the x flat RF electrodes comprise a slit;

a pair of DC plates, wherein the DC plates are coupled to the x and y pairs of flat RF electrodes, wherein the DC plates are disposed in the xy plane, and wherein each DC plate comprises holes configured to receive a fastener;

a base plate, wherein the base pate is coupled to the DC plates, wherein the base plate is positioned on top of the spaced x and y pairs of flat RF electrodes, and wherein the base plate is disposed of in the zy plane, wherein the base plate is parallel to the Y pair of flat RF electrodes, and wherein the base plate comprises holes to receive a fastener, sapphire spacers, wherein the sapphire spacers have two holes configured to receive a fastener, wherein the sapphire spacers are placed between the base plate and the DC plate, wherein the sapphire spacers are placed between the DC plates and the ends of the x and y flat RF electrodes; and fasteners, wherein the fasteners are passed through the holes in the DC plates, base plates, x and y flat RF electrodes and sapphire spacers.

14. The mass spectrometer of claim 13, wherein the rectilinear ion trap is configured to operate a cryogenic temperatures.

15. The mass spectrometer of claim 13, wherein the rectilinear ion trap further comprises insulating spacers, wherein the insulating spacers are positioned between the ends of the x and y RF electrodes.

16. The mass spectrometer of claim 15, wherein the insulating spacers comprise Kel-F, PEEK, or Teflon insulating material.

17. The mass spectrometer of claim 13, wherein one or more components of the rectilinear ion trap is made of stainless steel.

18. The mass spectrometer of claim 13, wherein in one or more components of the rectilinear ion trap is made of copper.

19. The mass spectrometer of claim 13, wherein the rectilinear ion trap is configured to perform mass selection of ions and infrared mass spectra analysis inside the rectilinear ion trap.

20. A method of mass spectrometry comprising:

trapping ions in a trap volume of a rectilinear ion trap, wherein the rectilinear ion trap comprises spaced x and y pairs of flat RF electrodes disposed in the zx and zy plane to define the trap volume, wherein each of the x flat RF electrodes comprise a slit;

a pair of DC plates, wherein the DC plates are coupled to the x and y pairs of flat RF electrodes, wherein the DC plates are disposed in the xy plane, and wherein each DC plate comprises holes configured to receive a fastener;

a base plate, wherein the base pate is coupled to the DC plates, wherein the base plate is positioned on top of the spaced x and y pairs of flat RF electrodes, and wherein the base plate is disposed of in the zy plane, wherein the base plate is parallel to the Y pair of flat RF electrodes, and wherein the base plate comprises holes to receive a fastener, sapphire spacers, wherein the sapphire spacers have two holes configured to receive a fastener, wherein the sapphire spacers are placed between the base plate and the DC plate, wherein the sapphire spacers are placed between the DC plates and the ends of the x and y flat RF electrodes; and fasteners, wherein the fasteners are passed through the holes in the DC plates, base plates, x and y flat RF electrodes and sapphire spacers;

removing mass interferences by ejecting some ions from the trap volume;

tagging the ions remaining in the trap volume by pulsing a cooled gas containing the tagging agent into the trap volume;

ejecting untagged ions from the trap volume based on mass; and irradiating the remaining ions in the trap volume with infrared radiation.

* * * * *